US006854432B2

(12) United States Patent
Hirano

(10) Patent No.: US 6,854,432 B2
(45) Date of Patent: Feb. 15, 2005

(54) VALVE GEAR OF INTERNAL COMBUSTION ENGINE

(75) Inventor: Makoto Hirano, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/257,319

(22) PCT Filed: Apr. 9, 2001

(86) PCT No.: PCT/JP01/03048

§ 371 (c)(1),
(2), (4) Date: Apr. 7, 2003

(87) PCT Pub. No.: WO01/77502

PCT Pub. Date: Oct. 18, 2001

(65) Prior Publication Data

US 2003/0154942 A1 Aug. 21, 2003

(30) Foreign Application Priority Data

Apr. 10, 2000 (JP) ..... 2000-113246
May 23, 2000 (JP) ..... 2000-155968
Jun. 6, 2000 (JP) ..... 2000-174233

(51) Int. Cl.[7] ..... F01L 1/34
(52) U.S. Cl. ..... 123/90.16; 123/90.48
(58) Field of Search ..... 123/90.16, 90.44, 123/90.39, 90.41, 90.48

(56) References Cited

U.S. PATENT DOCUMENTS 4,905,639 A * 3/1990 Konno ..... 123/90.16
5,036,807 A * 8/1991 Kaneko ..... 123/90.16
5,351,662 A * 10/1994 Dopson et al. ..... 123/90.16
5,603,294 A * 2/1997 Kawai ..... 123/90.16
5,960,754 A * 10/1999 Sugimoto et al. ..... 123/90.15

FOREIGN PATENT DOCUMENTS

| | | |
|---|---|---|
| JP | 59-101514 A | 6/1984 |
| JP | 8-177425 A | 7/1996 |
| JP | 9-166008 A | 6/1997 |
| JP | 9-184409 A | 7/1997 |
| JP | 10-77813 A | 3/1998 |
| JP | 11-62532 A | 3/1999 |

* cited by examiner

*Primary Examiner*—Thomas Denion
*Assistant Examiner*—Zelalem Eshete
(74) *Attorney, Agent, or Firm*—Birch, Stewart, Kolasch & Birch, LLP

(57) ABSTRACT

A valve operating system for an internal combustion engine including a main valve lifter, a subsidiary valve lifter, a low-speed cam operating the main valve lifter, a high-speed cam operating the subsidiary valve lifter, a connecting device switched over between a non-connecting state in which the valve lifters are disconnected from each other, and a connecting state in which the valve lifters are connected to each other, a valve spring for biasing the valve in a closing direction, a lifter spring for biasing the subsidiary valve lifter toward the cam; thus, in a low-speed mode, that is non-connected states, an influence of a load of the lifter spring on the valve can be prevented, and in a high-speed mode, that is connected states, a sum total of loads of the valve spring and the lifter spring cap be applied to both of the valve lifters to improve the closing responsiveness of the valve.

3 Claims, 52 Drawing Sheets

LOW-SPEED MODE

SWITCHOVER PREPARATORY STATE

HIGH-SPEED MODE

LOW-SPEED MODE

SWITCHOVER PREPARATORY STATE

HIGH-SPEED MODE

LOW-SPEED MODE

SWITCHOVER PREPARATORY STATE

HIGH-SPEED MODE

LOW-SPEED MODE

SWITCHOVER PREPARATORY STATE

HIGH-SPEED MODE

LOW-SPEED MODE

HIGH-SPEED MODE

LOW-SPEED MODE

MEDIUM-SPEED MODE

HIGH-SPEED MODE

VALVE GEAR OF INTERNAL COMBUSTION ENGINE

This application is the national phase under 35 U.S.C. § 371 of PC International Application No. PCT/JP01/03048 which has an International filing date of Apr. 9, 2001, which designated the United States of America.

FIELD OF THE INVENTION

The present invention relates to a valve-operating system for an internal combustion engine and particularly, to an improvement in a valve-operating system, including a main valve lifter moved in unison with valves mounted in an engine body, a subsidiary valve lifter adjoining the main valve lifter and slidable relative to the main valve lifter, a main cam for providing a first operational mode to the valve through the main valve lifter, a subsidiary cam capable of operating the subsidiary valve lifter with a lift amount larger than the main cam in a direction to open the valve, and a connecting means capable of being switched between a non-connecting state in which the individual movement of the main and subsidiary valve lifters is permitted, and a connecting state in which the main and subsidiary valve lifters are connected to each other and forced to be operated in unison with each other, so that when the main and subsidiary valve lifters are connected to each other by the connecting state of the connecting means, the subsidiary cam provides a second operational mode to the valve, in which the valve is opened more largely than in the first operational mode.

BACKGROUND ART

Such a valve-operating system for an internal combustion engine is already known, as disclosed, for example, in Japanese Patent Application Laid-open No. 9-184409.

The known valve-operating system further includes a valve spring mounted between the valve and engine body for biasing the valve in a closing direction, and a lifter spring mounted between the subsidiary valve lifter and the valve for biasing the subsidiary valve lifter toward the subsidiary cam. When the connecting means is in the non-connecting state in which the valve lifters are free for movement, the main cam opens and closed the main valve by cooperation with the main valve lifter and the valve spring, and the subsidiary cam provides an ineffective reciprocal motion to the subsidiary valve lifter by cooperation with the lifter spring. When the connecting means is in the connecting state in which the valve lifters are connected to each other, the subsidiary cam opens and closes the valve by cooperation with both of the valve lifters and the valve spring.

It should be noted here that because the lifter spring is mounted between the valve and the subsidiary valve lifter, the following disadvantage is encountered: When the connecting means is in the non-connecting state, whereby the subsidiary cam provides the ineffective reciprocal motion to the subsidiary valve lifter by cooperation with the lifter spring, inertia forces of the subsidiary cam and the lifter spring are applied to the valve, whereby the valve is liable to be jumped. Such jumping of the valve can be suppressed by setting the preset load of the valve spring for biasing the valve in the closing direction at a higher value. However, if the preset load is set at the higher value, the following new problems arise: the load of a camshaft is increased; the wear of sliding portions is hastened, and the like.

In such known valve-operating system, the cylindrical main valve lifter and the hollow cylindrical subsidiary valve lifter are relatively slidably fitted with each other, and the outer subsidiary valve lifter is slidably received in a lifter guide bore in the engine body. Radial main and subsidiary guide bores are provided in the main and subsidiary valve lifters, and a connecting plunger is fitted in both of the guide bores, thereby connecting the valve lifters to each other. In the system designed as described above, it is necessary to provide a high-accuracy positioning means between the main and subsidiary valve lifters in order to bring the main and subsidiary guide bores in the same line with each other.

However, such positioning means results in an increase in number of parts in the valve-operating system, and moreover, causes an increase in number of processing steps, resulting in the hindrance to a reduction in cost.

Further, in such known valve-operating system, a circular upper surface of the main valve lifter and an annular upper surface of the subsidiary valve lifter are formed as slipper faces with which the main and subsidiary cams are in sliding contact. The radial main and subsidiary guide bores are provided in the main and subsidiary valve lifters, and the connecting plunger is fitted in both of the guide bores, whereby the valve lifters are connected to each other.

It should be noted here that in a valve-operating system in which a valve lifter is moved directly by a cam, it is necessary to bring the rotating cam over the entire periphery thereof reliably into sliding contact with the slipper face of the valve lifter in order to operate the valve smoothly in conformity to a cam profile. However, if even a portion of the cam strikes against a peripheral edge corner of the slipper face of the valve lifter, the following disadvantage is encountered: A large side thrust is exerted to the valve lifter, whereby the resistance to the sliding movement of the valve lifter is increased, and moreover, the movement of the valve does not correspond to the cam profile. Therefore, it is required that the slipper face of the valve lifter should have a necessary and sufficient length in a direction of rotation of the cam.

However, in the conventionally known valve-operating system in which main and subsidiary slipper faces 011*s* and 012*s* are formed at upper ends of an inner main valve lifter 011 and an outer subsidiary valve lifter 012 disposed concentrically with each other, so that main and subsidiary cams 15 and 16 are in sliding contact with the slipper faces 011*s* and 012*s*, as shown in FIGS. 52A and 52B, it is required that the slipper faces 011*s* and 012*s* have extents having band-shaped sliding contact regions A and B caused by the rotation of the main and subsidiary cams 15 and 16 in order to meet the above-described demand. This brings about an increase in diameter of the main and subsidiary valve lifters 011 and 012 and accordingly, an increase in size of the valve-operating system.

DISCLOSURE OF THE INVENTION

The present invention has been accomplished in view of the various problems associated with the above-described conventionally known system, and it is a first object of the present invention to provide a valve-operating system for an internal combustion engine, wherein the jumping of the valve can be suppressed without specially increasing the preset load of the valve spring, and the load of the camshaft can be alleviated to enhance the durability of sliding portions.

It is a second object of the present invention to provide a valve-operating system for an internal combustion engine, wherein even if no special positioning means is provided, it is possible to prevent the rotation of the main and subsidiary valve lifters relative to each other without chattering, thereby contributing to a reduction in number of parts and accordingly, a reduction in cost.

Further, it is a third object of the present invention to provide a valve-operating system for an internal combustion engine, wherein the movement corresponding to a cam profile can be provided properly and smoothly to the valve lifter, namely, to the valve without bringing about an increase in diameter of the valve lifter.

To achieve the first object, according to a first aspect and feature, there is provided a valve-operating system for an internal combustion engine, comprising a main valve lifter moved in unison with valves mounted in an engine body, a subsidiary valve lifter adjoining the main valve lifter and slidable relative to the main valve lifter, a main cam for providing a first operational mode to a valve through the main valve lifter, a subsidiary cam capable of operating the subsidiary valve lifter with a lift amount larger than the main cam in a direction to open the valve, and a connecting means capable of being switched between a non-connecting state in which the individual movement of the main and subsidiary valve lifters is permitted, and a connecting state in which the main and subsidiary valve lifters are connected to each other and forced to be operated in unison with each other, so that when the main and subsidiary valve lifters are connected to each other by the connecting state of the connecting means, the subsidiary cam provides a second operational mode to the valve, in which the valve is opened more largely than in the first operational mode, characterized in that the system further includes a valve spring mounted between the valve and the engine body for biasing the valve in a closing direction, and a lifter spring mounted between the subsidiary valve lifter and the engine body for biasing the subsidiary lifter toward the subsidiary cam.

With the first feature, in the non-connecting state of the connecting means in which the main and subsidiary valve lifters are slidable relative to each other, a load received from the subsidiary cam by the lifter spring is received directly on the engine body and hence, cannot exert influence on the valve. Therefore, even if the subsidiary valve lifter is reciprocally moved at a stroke larger than that of the main valve lifter to flex the lifter spring largely, resulting large inertia forces of the subsidiary valve lifter and the lifter spring cannot be applied to the valve. Thus, it is possible to prevent the occurrence of the jumping of the valve and to suppress a useless increase in surface pressure on sliding portions and abutment portions extending from the main cam to the valve to prevent the wears of them as much as possible, and the load of the camshaft cannot be increased uselessly.

In the connecting state of the connecting means in which the main and subsidiary valve lifters have been connected to each other, a sum total of repulsive forces of the valve spring and the lifter spring is applied to both of the valve lifters. Therefore, notwithstanding that the valve lifters have been integrated, resulting in an increased inertia mass, inertia forces of the valve lifters can be suppressed effectively, thereby not only preventing the jumping of the valve, but also enhancing the return responsiveness of the valve lifters and accordingly, the closing responsiveness of the valve.

To achieve the second object, according to a second aspect and feature of the present invention, there is provided a valve-operating system for an internal combustion engine, comprising a main valve lifter moved in unison with valves mounted in an engine body, a subsidiary valve lifter adjoining the main valve lifter and slidable relative to the main valve lifter, a main cam for providing a first operational mode to a valve through the main valve lifter, a subsidiary cam capable of operating the subsidiary valve lifter with a lift amount larger than the main cam in a direction to open the valve, main and subsidiary guide bores provided in the main and subsidiary valve lifters to extend in a direction perpendicular to a direction of operation of the main and subsidiary valve lifters, and a connecting means having a connecting member for moving between a non-connecting position where the connecting member is received in only one of the main and subsidiary guide bores and a connecting position where the connecting member is received in both of the guide bores, so that when the main and subsidiary valve lifters are connected to each other by the connecting state of the connecting means, the subsidiary cams provide a second operational mode to the valve, in which the valve is opened more largely than in the first operational mode, characterized in that the main and subsidiary valve lifters have flat faces relatively slidably superposed on each other, and are formed so as to be slidably received in a common lifter guide bore in the engine body, the flat faces being formed to extend in parallel to an axis of the lifter guide bore, and the main and subsidiary guide bores are provided in the main and subsidiary valve lifters, so as to open into the corresponding flat faces, respectively.

With the second feature, it is possible to prevent the rotation of main and subsidiary valve lifters relative to each other without chattering by the abutment of the wide flat faces against each other and hence, it is possible to easily and properly bring the guide bores in the valve lifters in line with each other without provision of a special positioning means, thereby reducing the number of parts to contribute to a reduction in cost.

According to a third aspect and feature of the present invention, in addition to the second feature, the single subsidiary valve lifter is disposed adjacent the main valve lifter.

With the third feature, two different operational modes can be provided to the valve in the engine with a reduced number of parts.

According to a fourth aspect and feature of the present invention, in addition to the third feature, the main valve lifter is formed into an arcuate shape having an outer peripheral surface of a major arc shape; the subsidiary valve lifter is formed into an arcuate shape having an outer peripheral surface of a minor arc shape; the main guide bore in the main valve lifter is formed longer than the subsidiary guide bore in the subsidiary valve lifter; and the connecting member is supported in the main guide bore.

With the third feature, the longer main guide bore is easily defined in the main valve lifter, and a support span of the connecting plungers supported in the main guide bore can be prolonged, whereby the falling of the connecting plungers can be suppressed to the utmost. Therefore, a good state in which the valve lifters have been connected to each other can be provided in the connecting state of the connecting means.

According to a fifth aspect and feature of the present invention, in addition to the second feature, a pair of the subsidiary valve lifters are disposed on opposite sides of the main valve lifter, and a pair of the subsidiary cams of the same shape are disposed in correspondence to the subsidiary valve lifters, so that the main valve lifter can be connected to both of the subsidiary valve lifters through a pair of the connecting members.

With the fifth feature, when the main valve lifter is connected to both of the subsidiary valve lifters through the pair of connecting members, both of the subsidiary valve lifters are connected to opposite sides of the main valve lifter, and operational forces of the subsidiary cams are applied equally to the opposite sides of the main valve lifter through both of the subsidiary valve lifters and both of the connecting members. Therefore, the main valve lifter can be operated in a non-inclined appropriate attitude.

According to a sixth aspect and feature of the present invention, in addition to the second feature, the first and second subsidiary valve lifters are disposed on opposite sides of the main valve lifter, and the first and second subsidiary cams moved at different lift amounts are disposed in correspondence to the first and second subsidiary valve lifters, so that the main valve lifter can be connected individually to the first and second subsidiary valve lifters through the first and second connecting members.

With the sixth feature, when the first and second subsidiary valve lifters are separated from the main valve lifter, or when only the first subsidiary valve lifter is connected to the main valve lifter, or when the second subsidiary valve lifter is connected to the main valve lifter, any of three operational modes can be provided to the valve in the engine by cooperation with the main cam, the first subsidiary cam and the second subsidiary cam.

According to a seventh aspect and feature of the present invention, in addition to any of the second to sixth features, a pair of the circular lifter guide bores are disposed in a partially overlapped relation to each other, and flat faces are formed on two sets of the main and subsidiary valve lifters received in the lifter guide bores to come into abutment against each other at a border between both of the lifter guide bores.

With the seventh feature, when the two sets of main and subsidiary valve lifters are disposed adjacent each other, the two sets of main and subsidiary valve lifters restrict the rotation each other by bringing the flat faces formed on the main and subsidiary valve lifters into abutment against each other at the border between the pair of the lifter guide bores. Therefore, it is unnecessary to adopt a detent means between the main and subsidiary valve lifters and the lifter guide bore in each pair, leading to the simplification of the arrangement, and the two sets of main and subsidiary valve lifters as well as the pair of valves operated by these valve lifters can be disposed adjacent each other, leading to the compactness of the engine.

To achieve the third object, according to an eighth aspect and feature of the present invention, there is provided a valve-operating system for an internal combustion engine, comprising a main valve lifter moved in unison with a valve mounted in an engine body, a subsidiary valve lifter adjoining the main lifter and slidable relative to the main lifter, a main cam for providing a first operational mode to the valve through the main valve lifter, a subsidiary cam capable of operating the subsidiary valve lifter with a lift amount larger than the main cam in a direction to open the valve, main and subsidiary guide bores provided in the main and subsidiary valve lifters to extend in a direction perpendicular to a direction of operation of the main and subsidiary valve lifters, and a connecting means having a connecting member for moving between a non-connecting position where the connecting member is received in only one of the main and subsidiary guide bores and a connecting position where the connecting member is received in both of the guide bores, so that when the main and subsidiary valve lifters are connected to each other by the connecting state of the connecting means, the subsidiary cam provides a second operational mode to the valve, in which the valve is opened more largely than in the first operational mode, characterized in that a roller is carried on at least one of the main and subsidiary valve lifters to come into contact with the corresponding cam.

With the eighth feature, even if an upper end face of the valve lifter having the roller carried thereon is short in length in a direction of rotation of the cam, the movement corresponding to a cam profile can be provided smoothly to such valve lifter by bringing the cam into contact with the roller. Moreover, the valve lifter does not require a face of sliding contact with the cam and hence, it is possible to provide a reduction in diameter of the valve lifter and accordingly, a reduction in size of the valve-operating system.

According to a ninth aspect and feature of the present invention, in addition to the eighth feature, the main valve lifter is formed into an arcuate shape having an outer peripheral surface of a major arc shape; the subsidiary valve lifter is formed into an arcuate shape having an outer peripheral surface of a minor arc shape; both of the valve lifters are disposed, so that flat face thereof slidably abutting against each other are perpendicular to an axis of a camshaft having the main and subsidiary cams; a roller is carried on the subsidiary valve lifter to come into contact with the subsidiary cam; and the main valve lifter has a slipper face formed on an upper end face thereof, so that the main cam is in sliding contact with the slipper face.

With the ninth feature, the long slipper face, with which the main cam is in sliding contact over its entire periphery, can be ensured on the upper end face of the main valve lifter by effectively utilizing the largest diameter of the main valve lifter, and it is unnecessary to carry a roller on the main valve lifter and hence, the arrangement can be correspondingly simplified to contribute to a reduction in cost. On the other hand, even if the upper end face of the subsidiary valve lifter is short in length in a direction of rotation of the subsidiary cam, the subsidiary valve lifter can smoothly receive the movement corresponding to a profile of the subsidiary cam by provision of the roller on the subsidiary valve lifter.

According to a tenth aspect and feature of the present invention, in addition to the eighth or ninth feature, the guide bores are provided in roller support shafts secured to the corresponding valve lifters to support the rollers.

With the tenth feature, the roller support shafts and the connecting members received in the guide bores can be disposed concentrically, leading to the simplification of the arrangement and a reduction in size.

The above and other objects, features and advantages of the present invention will become apparent from the following description of the preferred embodiments taken in conjunction with the accompanying drawings.

BEST MODE FOR CARRYING OUT THE INVENTION

A first embodiment of the present invention shown in FIGS. 1 to 8 will be first described.

Figure 1:
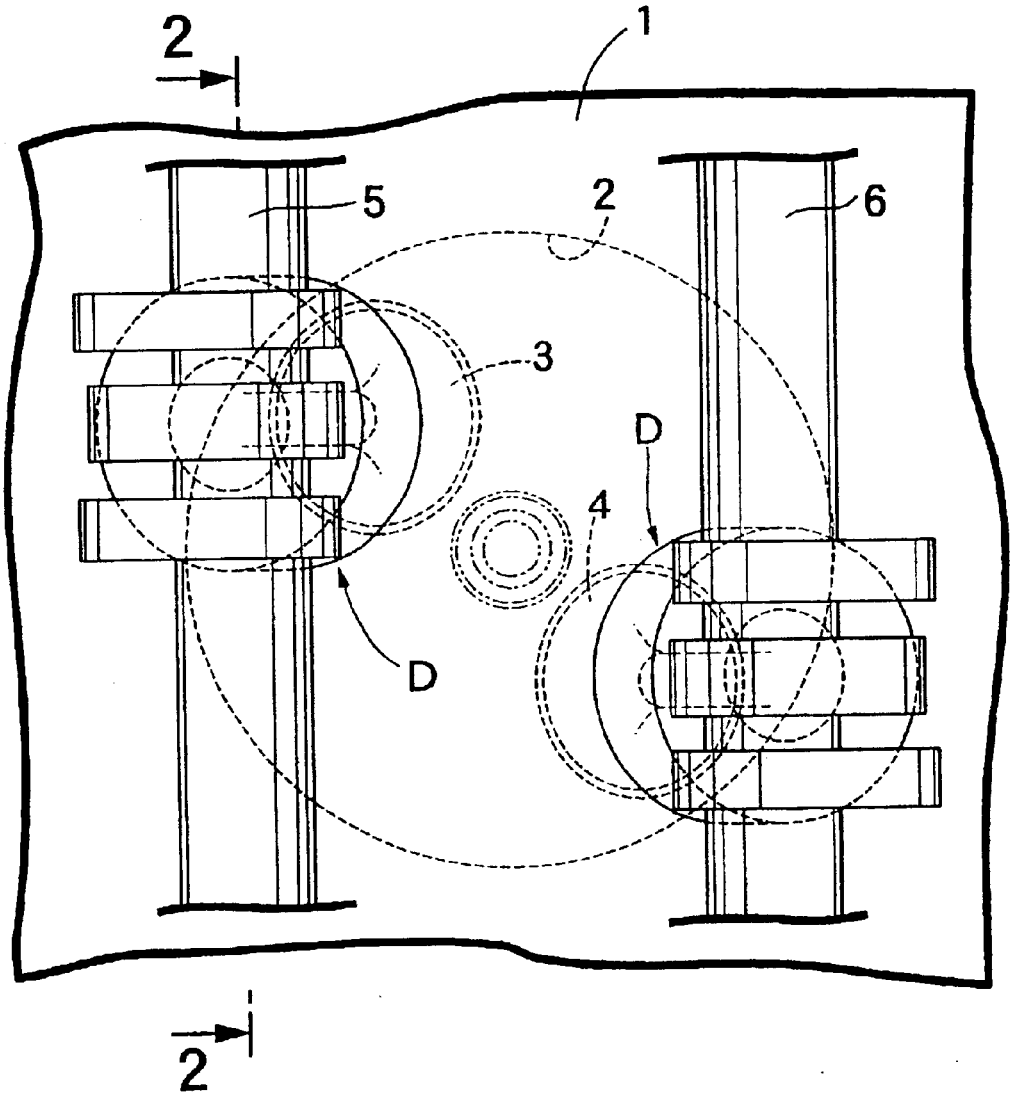
FIG. 1 is a plan view of a valve-operating system for a two-valve and twin-camshaft type internal combustion engine according to a first embodiment of the present invention.

Referring to FIG. 1, an internal combustion engine is constructed into a two-valve and twin-camshaft type. More specifically, a single intake valve 3 and a single exhaust valve 4 are mounted in correspondence to one cylinder bore 2 in a cylinder head 1 constituting a portion of the engine body, and an intake camshaft 5 and an exhaust camshaft 6 are disposed immediately above the intake valve 3 and the exhaust valve 4, respectively. The camshafts 5 and 6 are driven from a crankshaft (not shown) through a timing transmitting device (not shown), as conventionally normal.

A valve-operating device D of the present invention is provided between each of the camshafts 5 and 6 and each of the valves 3 and 4. The valve-operating devices D have the same construction and hence, the valve-operating device D for the intake valve 3 will be representatively described below.

Figure 2:
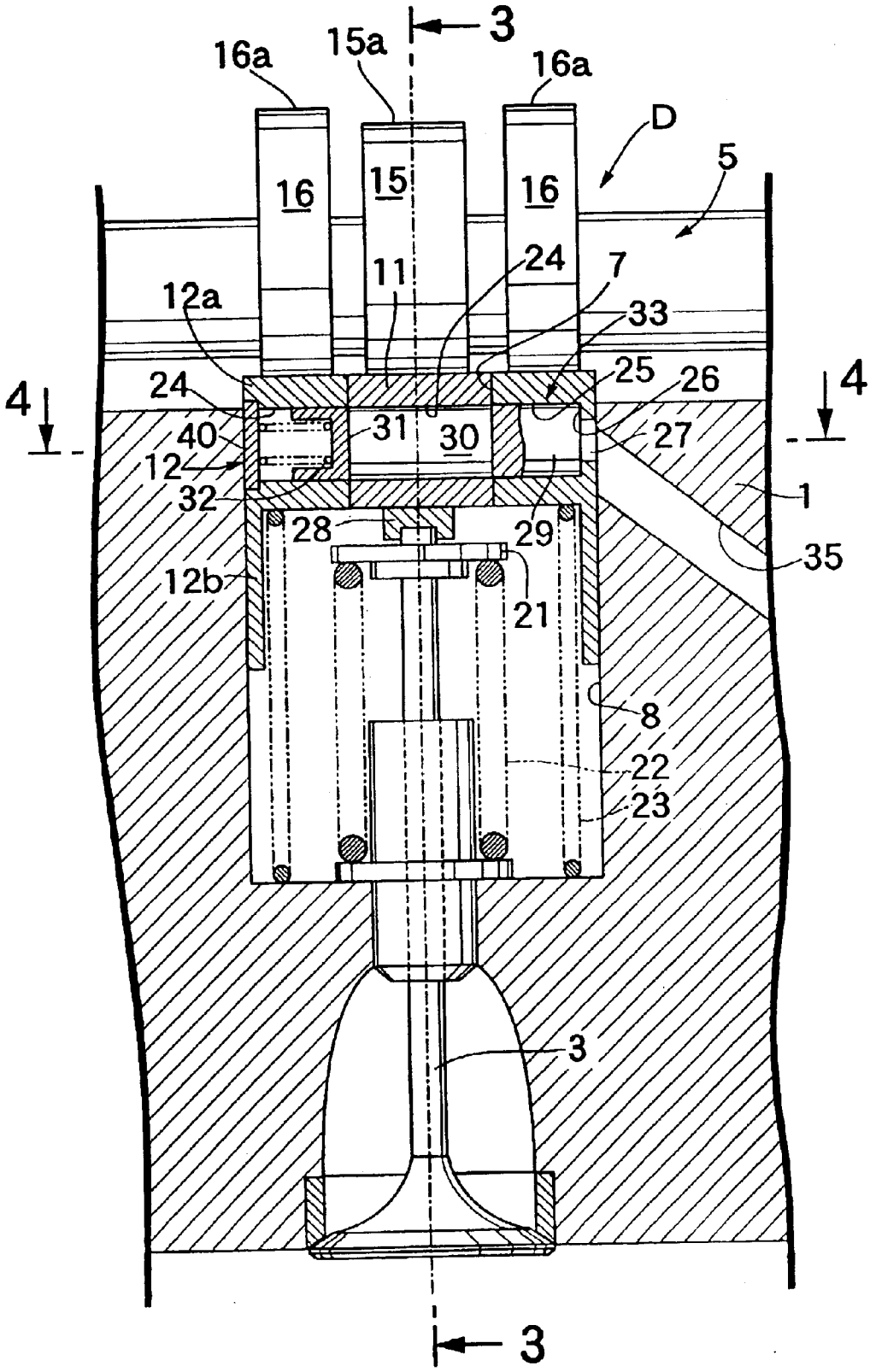
FIG. 2 is a sectional view taken a long a line 2—2 in FIG. 1.
Figure 3:
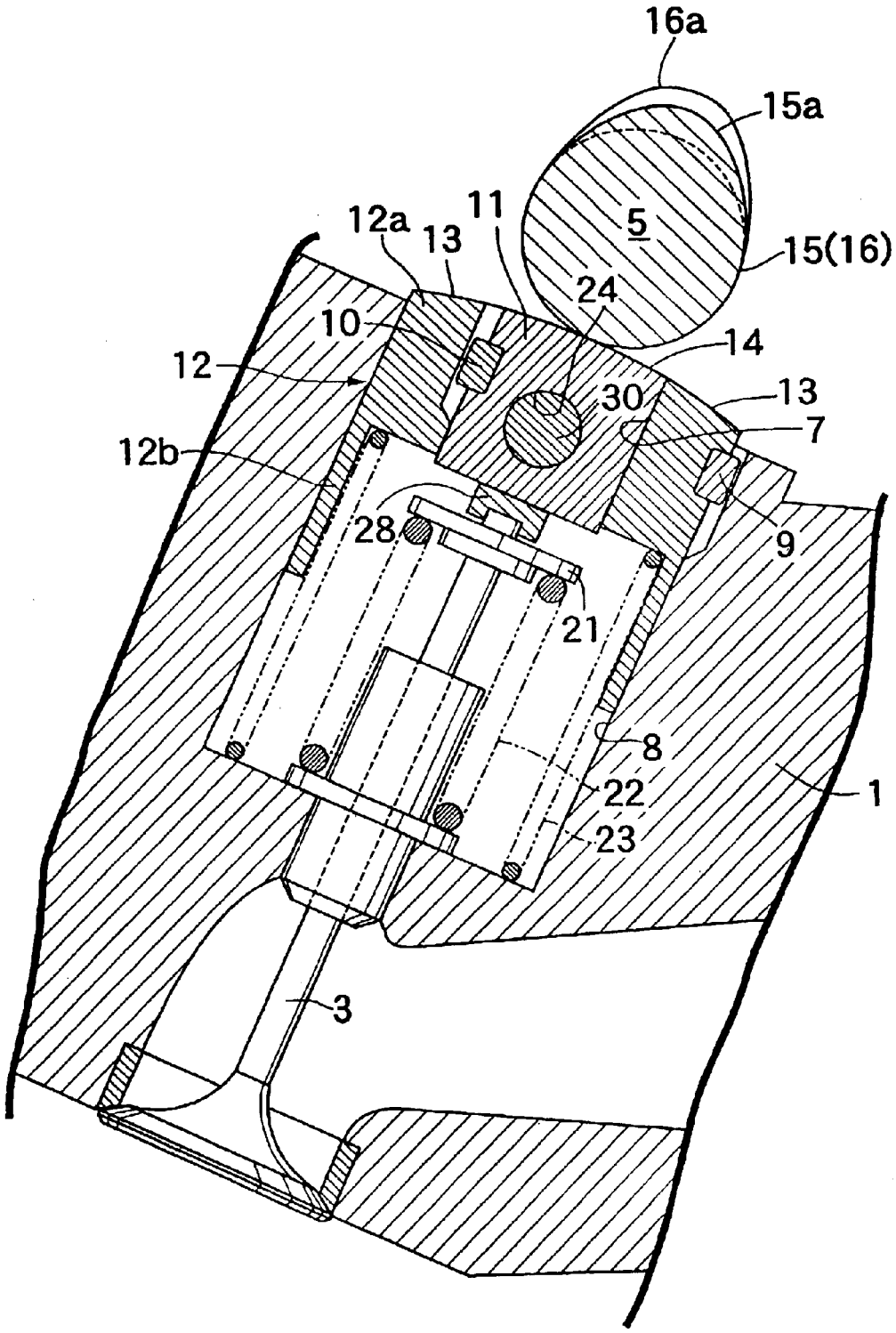
FIG. 3 is a sectional view taken a long a line 3—3 in FIG. 2.

As shown in FIGS. 2 and 3, a cylindrical subsidiary valve lifter 12 is slidably received in a circular lifter guide bore 8 provided in the cylinder head 1 above the valve 3. The subsidiary valve lifter 12 comprises a thicker head portion 11*a* having a circular lifter guide bore 7 in its central portion, and a thinner skirt portion 11*b* extending downwards from an outer periphery of the head portion 11*a*, and a main valve lifter 11 is relatively slidably received in the lifter guide bore 7 in the subsidiary valve lifter 12. In this case, a key 9 is interposed between the cylinder head 1 and the subsidiary valve lifter 12 to inhibit the rotation of the subsidiary valve lifter 12, and a key 10 is interposed between the main and subsidiary valve lifters 11 and 12 to inhibit the relative rotation of the main and subsidiary valve lifters 11 and 12. Upper surfaces of the valve lifters 11 and 12 are formed as crowning surface 13 and 14 having buses parallel to an axis of the camshaft 5.

On the other hand, a single main cam 15 and a pair of subsidiary cams 16, 16 are formed on the camshaft 5, so that the main cam 15 is in sliding contact with the upper surface of the main valve lifter 11, and the subsidiary cams 16, 16 are in sliding contact with opposite sides of the upper portion of the subsidiary valve lifter 12. There is no difference of height between base circle-portions of the main and subsidiary cams 15 and 16, but the lift portion 16*a* of the subsidiary cam 16 is formed higher in level than the lift portion 15*a* of the main cam 15. Therefore, the main cam 15 is used for a low speed, and the subsidiary cam 16 is used for a high speed.

The main valve lifter 11 is disposed, so that a stem head of the valve 3 abuts against a lower surface of the main valve lifter 11 through a shim 28, and a coiled valve spring 22 for biasing the valve 3 in a closing direction, i.e., toward the main cam 15 is mounted between a flange-shaped retainer 21 fixed to a stem of the valve 3 and the cylinder head 1. A lifter spring 23 for biasing the subsidiary valve lifter 12 toward the subsidiary cam 16 is mounted between the head portion 11*a* of the subsidiary valve lifter 12 and the cylinder head 1 in proximity to an inner surface of the skirt portion 11*b*.

Figure 4:
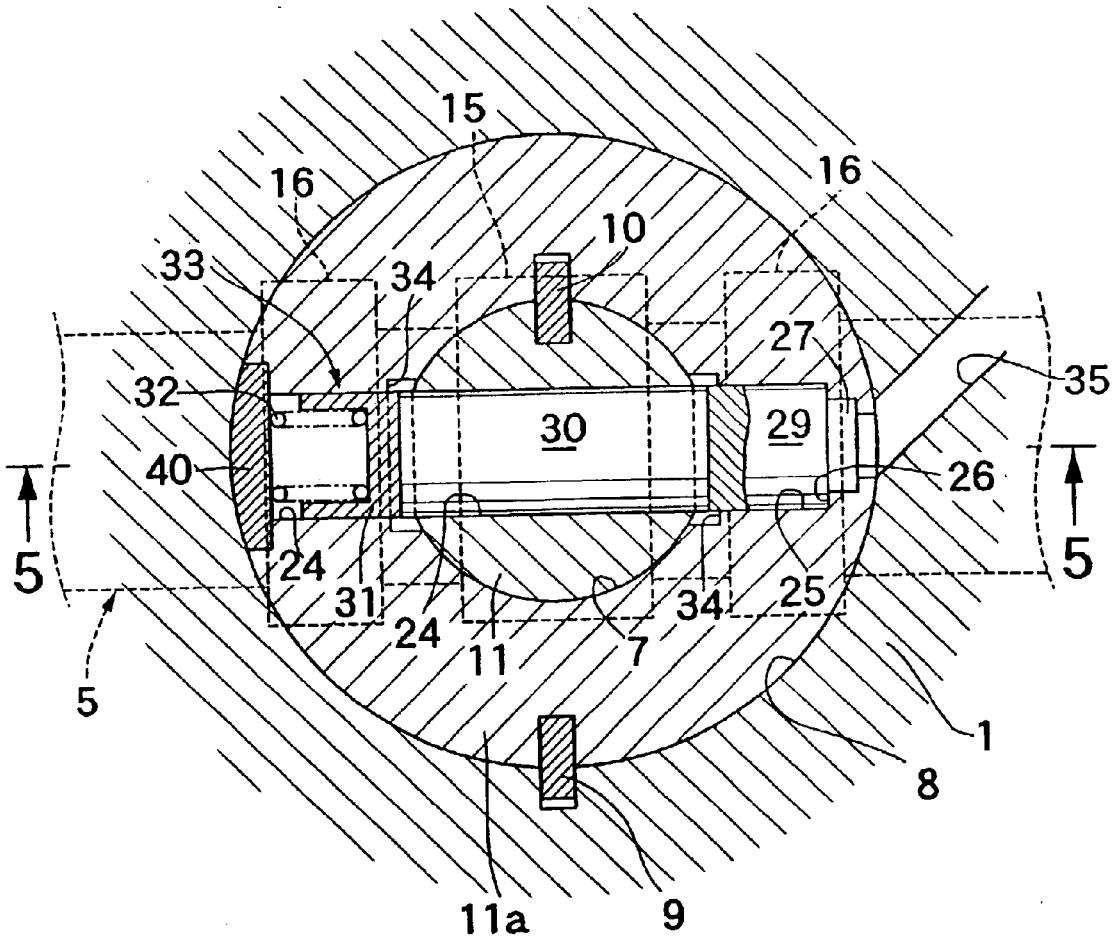
FIG. 4 is a sectional view taken a long a line 4—4 in FIG. 2.
Figure 5:
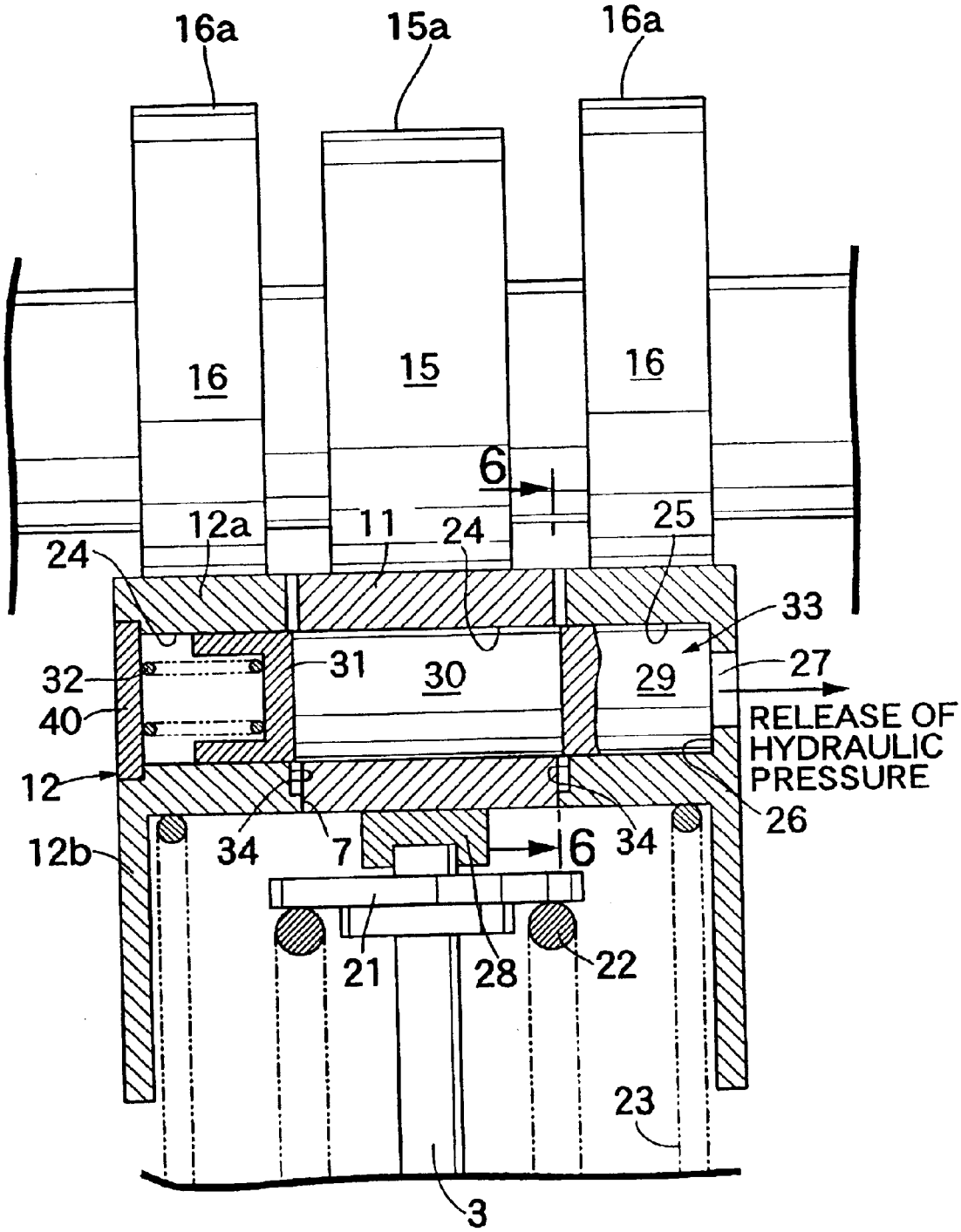
FIG. 5 is an enlarged sectional view taken a long a line 5—5 in FIG. 4 (shown in a low-speed mode)

As shown in FIGS. 2, 4 and 5, main and subsidiary guide bores 24 and 25 of the same diameter are respectively provided in the main valve lifter 11 and the head portions 12*a* of the subsidiary valve lifter 11 to extend along diametrical lines thereof, so that when the base circle-portions of the main and subsidiary cams 15 and 16 are put simultaneously into abutment against the upper surfaces of the main and subsidiary valve lifters 11 and 12, i.e., when the upper surfaces of the main and subsidiary valve lifters 11 and 12 are brought into the same level, the main guide bore 24 in the main valve lifter 11 and the subsidiary guide bore 25 in the subsidiary valve lifter 12 are brought in line with each other. A hydraulic pressure chamber 27 is connected to one of outer ends of the subsidiary guide bore 25 in the subsidiary valve lifter 12 through an annular step 26. The other outer end of the subsidiary guide bore 25 in the subsidiary valve lifter 12 is closed by a closing plug 40 fitted in the main valve lifter 11. A subsidiary connecting plunger 29 is slidably received in a portion of the subsidiary guide bore 25 in the subsidiary valve lifter 12 on the side of the hydraulic pressure chamber 27, and a subsidiary return piston 31 is slidably received in a portion of the subsidiary guide bore 25 on the side of the closing plug 40. A main connecting plunger 30 is slidably received in the main guide bore 24 in the main valve lifter 11. A return spring 32 for biasing the return piston 31 toward the hydraulic pressure chamber 27 is accommodated between the closing plug 40 and the return piston 31.

A connecting means 33 is formed by the main and subsidiary connecting plungers 30 and 29, the return piston 31, the hydraulic pressure chamber 27 and the return spring 32.

When the connecting plungers 29 and 30 and the return piston 31 are moved all at once toward the hydraulic pressure chamber 27, whereby the subsidiary connecting plunger 29 is put into abutment against the annular step 26, a non-connecting state of the connecting means 33 is established. At this time, the main and subsidiary connecting plungers 30 and 29 occupy positions where the relative sliding movement of the main and subsidiary valve lifters 11 and 12 is not obstructed. When the connecting plungers 30 and 29 and the return piston 31 are moved all at once toward the closing plug 40, whereby the return piston 31 is put into abutment against the closing plug 40, a connecting state of the connecting means 33 is established. At this time, the main and subsidiary connecting plungers 30 and 29 occupy positions where they traverse a border between the main and subsidiary valve lifters 11 and 12 to connect the main and subsidiary valve lifters 11 and 12 to each other.

Figure 6:
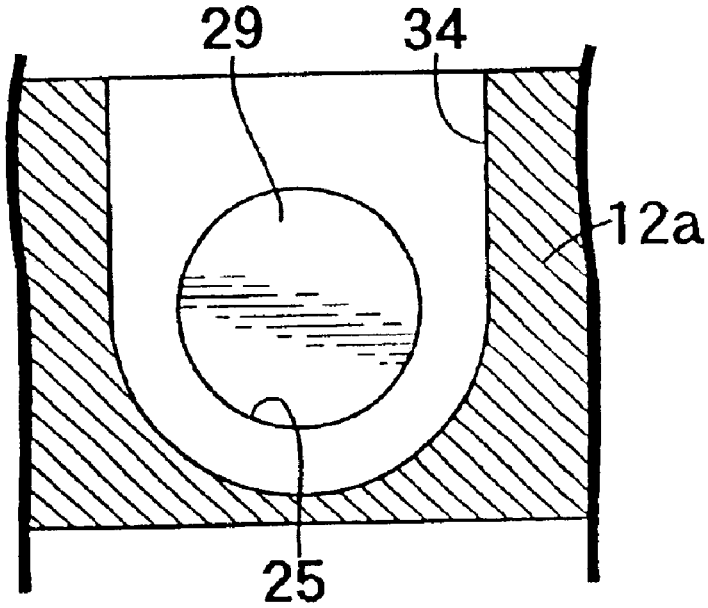
FIG. 6 is a sectional view taken a long a line 6—6 in FIG. 5.

Especially, as shown in FIGS. 4 and 5, the main connecting plunger 30 is formed slightly longer than the outside diameter of the main valve lifter 11 with a processing error in view. In order to avoid the interference of opposite ends of the main connecting plunger 30 with the subsidiary valve lifter 12 in the non-connecting state of the connecting means 33, a pair of relief recesses 34 are provided in an inner surface of the subsidiary valve lifter 12 to extend in an axial direction of the subsidiary valve lifter 12, so that the opposite ends of the main connecting plunger 30 are received therein. Each of the recesses 34 is of a U-shape in which it opens into the upper surface of the subsidiary valve lifter 12, as shown in FIG. 6, whereby the processing or working of the recess 34 is facilitated, and a lubricating oil can be retained therein.

An oil passage 35 is provided in the cylinder head 1 to communicate with the hydraulic pressure chamber 27, and a switchover valve (not shown) is mounted in the oil passage 35 for selectively connecting the oil passage 35 to a hydraulic pressure supply source such as a hydraulic pump and a low-pressure oil reservoir.

The operation of the first embodiment will be described below.

In low and medium speed operational ranges of the internal combustion engine, the hydraulic pressure chamber 27 is opened into the oil reservoir through the oil passage 35 to bring the connecting means 33 into a disconnecting state. If the disconnecting state is provided, as shown in FIG. 5, the subsidiary connecting piston 29 is retained by a biasing force of the return spring 32 in a position where it is in abutment against the annular step 26 of the subsidiary guide bore 25, and the opposite ends of the main connecting plunger 30 are allowed to face to the relief recesses 34, 34, whereby the connecting means 33 is brought into the non-connecting state in which the relative sliding movement of the valve lifters 11 and 12 is possible, and thus, the valve-operating device D is brought into a low-speed mode.

Therefore, when the camshaft 5 is rotated, the main cam 15 causes the opening and closing motion of the valve 3 through the main valve lifter 11 by cooperation with the valve spring 22, but the subsidiary cams 16 only reciprocally move the subsidiary valve lifter 12 uselessly with a stroke larger than that of the main valve lifter 11 by cooperation with the lifter spring 23 and do not participate in the opening and closing of the valve 3. Therefore, the opening and closing characteristic of the valve 3 in this case depends on a cam profile of the main cam 15 having the small-height lift portion 15*a*, and the low-speed and medium-speed performance of the engine can be enhanced.

What is to be remarked is that a stationary end of the lifter spring 23 for biasing the subsidiary valve lifter 12 toward the subsidiary cams is supported on the cylinder head 1, and a load received from the subsidiary cams 16 by the lifter spring 23 is received directly on the cylinder head 1, whereby the valve 3 is prevented from being influenced by such load. As a result, even if the subsidiary valve lifter 12 is reciprocally moved with a stroke larger than that of the main valve lifter 11 to flex the lifter spring 23 largely, resulting large inertia forces of the subsidiary valve lifter 12 and the lifter spring 23 cannot be applied to the valve 3. Therefore, it is possible to prevent the occurrence of the jumping of the valve 3 and to suppress a useless increase in surface pressure on sliding portions and abutment portions extending from the main cam 15 to the valve 3 to prevent wears of them as much as possible, and a load of the camshaft 5 cannot be increased uselessly.

Figure 7:
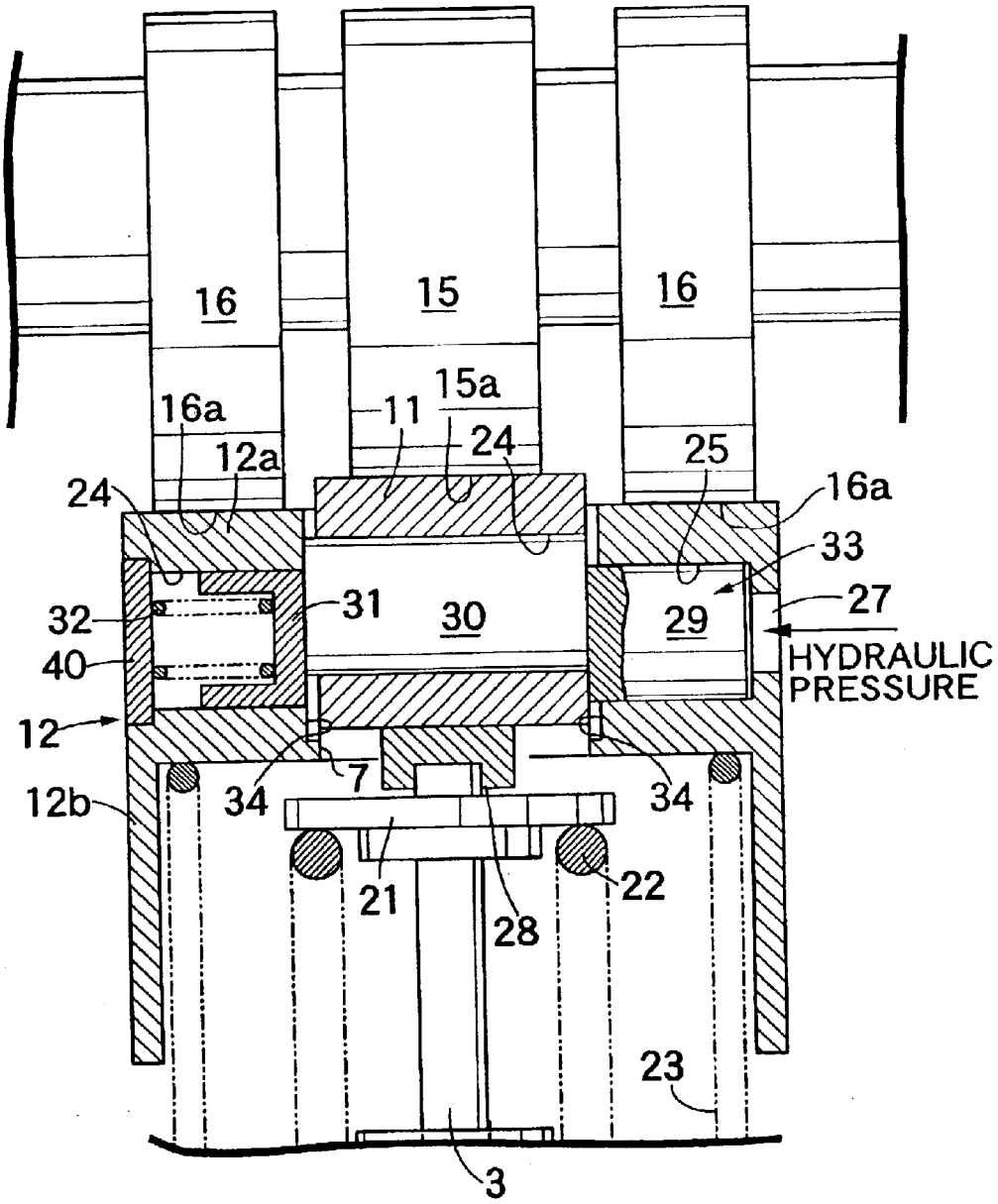
FIG. 7 is a view for explaining the operation and showing a state of preparatory to a high-speed mode.
Figure 8:
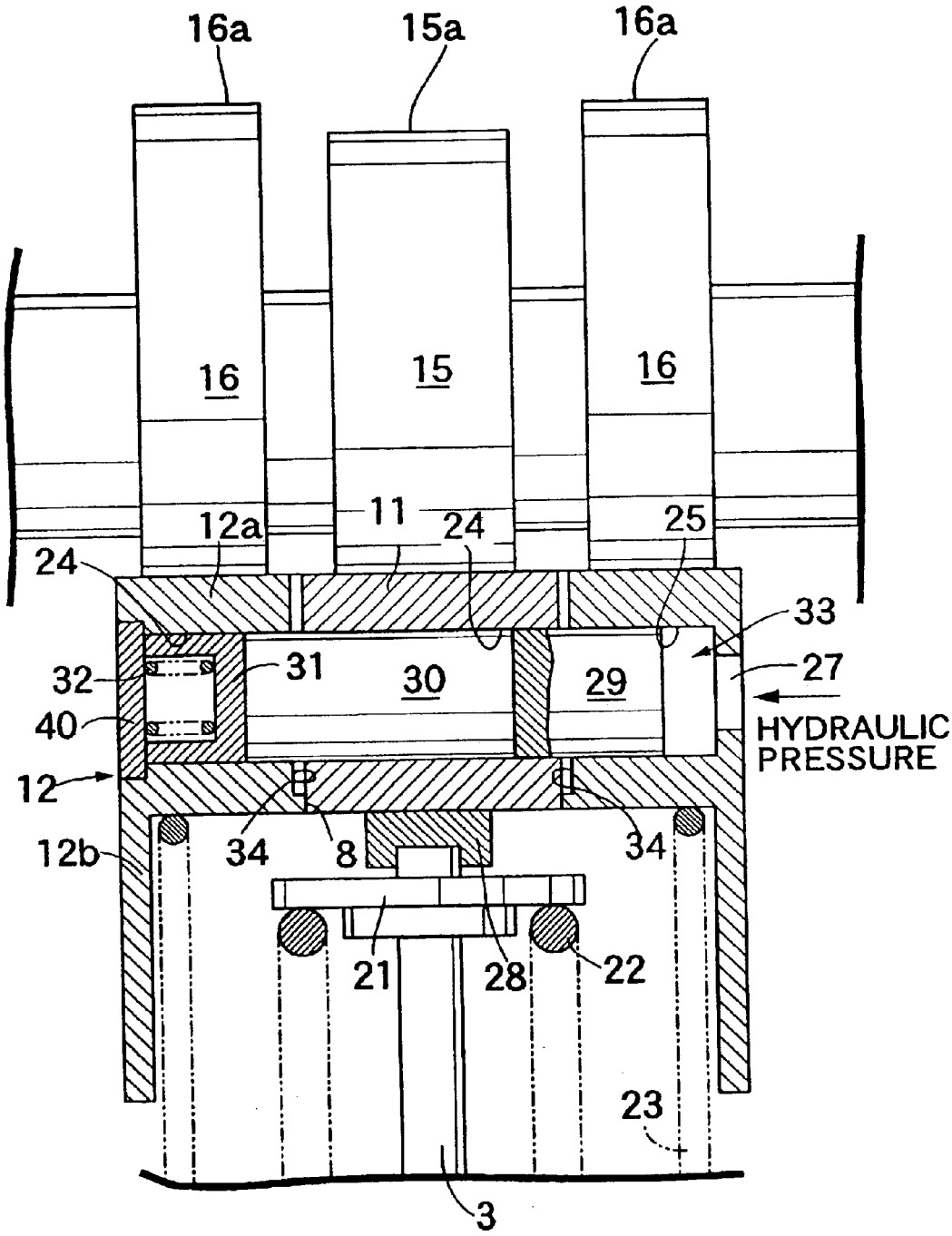
FIG. 8 is a view for explaining the operation and showing the high-speed mode.

When the engine reaches a high-speed operational range to permit a hydraulic pressure to be supplied from the oil passage 35 to the hydraulic pressure chamber 27, the subsidiary connecting plunger 29 pushes the main connecting plunger 30 and the return piston 31 by the action of the hydraulic pressure in the hydraulic pressure chamber 27 against the biasing force of the return spring 32. However, if the main and subsidiary cams 15 and 16 are in contact with the upper surfaces of the main and subsidiary valve lifters 11 and 12 at points other than the base circle-portions at that time, positions of the main guide bore 24 in the main valve lifter 11 and the subsidiary guide bore 25 in the subsidiary valve lifter 12 are staggered from each other. Therefore, the subsidiary connecting plunger 29 is once stopped in a position where it is in abutment against the outer peripheral surface of the main valve lifter 11, and the main connecting plunger 30 is once stopped in abutment against a bottom surface of the relief recess 34 on the side of the return piston 31, as shown in FIG. 7, thereby providing a switchover preparative state.

When the base circle-portions of the main and subsidiary cams 15 and 16 are brought simultaneously into contact with the upper surfaces of the main and subsidiary valve lifters 11 and 12 from that state, the main and subsidiary guide bores 24 and 25 in the main and subsidiary valve lifters 11 and 12 are brought in line with each other. The period of contact of the base circle-portions with the main and subsidiary valve lifters 11 and 12 is relatively long and hence, the subsidiary connecting plunger 29 urges the main connecting plunger 30 by the hydraulic pressure in the hydraulic pressure chamber 27, thereby causing the return spring 31 to be put into abutment against the closing plug 40 (see FIG. 8). The connecting means 33 is brought into the connecting state in which the relative sliding movement of the valve lifters 11 and 12 is impossible, and the valve-operating device D is brought into a high-speed mode.

Therefore, the subsidiary cams 16 having the large-height lift portions 16*a* open and close the valve 3 through the valve lifters 11 and 12 by cooperation with the valve spring 22, and the small-height lift portion 15*a* of the main cam 15 is raced relative to the main valve lifter 11. The opening/closing characteristic of the valve 3 in this case depends on the cam profile of each of the subsidiary cams 16 having the large-height lift portions 16*a*, and an enhancement in high-speed performance of the engine can be provided.

What is to be remarked is that the valve spring 22 and the lifter spring 23 exhibit repulsive forces alone for the valve lifters 11 and 12 connected to each other, and the sum total of the repulsive forces is applied to both of the valve lifters 11 and 12. Therefore, notwithstanding the valve lifters 11 and 12 have been integrated, resulting in an increased inertia mass, the inertia forces of the valve lifters 11 and 12 can be suppressed effectively, whereby the jumping of the valve 3 is prevented, and moreover, the return responsiveness of the valve lifters 11 and 12 and accordingly, the closing responsiveness of the valve 3 can be enhanced to contribute to a further enhancement in high-speed performance.

When the engine is returned again to the low-speed and medium-speed operational ranges, whereby the hydraulic pressure in the hydraulic pressure chamber 27 is released to the oil reservoir, the following is obvious: The return piston 31 pushes the main and subsidiary plungers 30 and 29 back to the original positions with the repulsive force of the return spring 32 and hence, the connecting means 33 is brought into the non-connecting state in which the relative sliding movement of the main and subsidiary valve lifters 11 and 12 is possible.

A second embodiment of the present invention shown in FIGS. 9 and 10 will be described below.

Flat abutment faces 60, 61; 60, 61 are formed on an inner peripheral surface of a subsidiary guide bore 25 in a subsidiary valve lifter 12 and opposite sides of an outer peripheral surface of a main valve lifter 11 received in the subsidiary guide bore 25, so that they are in abutment against each other for relative sliding movement. A main 24 and a subsidiary guide bore 25 are provided in the main and subsidiary valve lifters 11 and 12 to extend vertically through the abutment faces 60, 61; 60, 61.

With such arrangement, the following advantages are provided: Even if a relief recess 34 is not provided in the inner peripheral surface of the subsidiary valve lifter 12 as in the previously described embodiment, the interference of opposite ends of a connecting plunger 31 and a subsidiary valve lifter 12 can be avoided in a non-connecting state of a connecting means 33. In addition, even if a key 10 is not interposed between the main and subsidiary valve lifters 11 and 12 as in the previously described embodiment, the prevention of the rotation of the valve lifters 11 and 12 relative to each other can be achieved.

Upper surfaces of the main and subsidiary valve lifters 11 and 12, with which main and subsidiary cams 15 and 16 are in sliding contact, are formed as flat surfaces. An annular groove 39 is provided in an inner peripheral surface of a lifter guide bore 8 in the cylinder head 1, in which the subsidiary valve lifter 12 is received, and a hydraulic pressure chamber 27 and an oil passage 35 are in communication with each other through the annular groove 39.

With such arrangement, irrespective of the position of rotation of the subsidiary valve lifter 12, a state of the main and subsidiary cams 15 and 16 and the main and subsidiary valve lifters 11 and 12 where these cams and lifters are in sliding contact with each other, can be regulated, and a state of communication between the hydraulic pressure chamber 27 and the oil passage 35 can be ensured. Therefore, it is unnecessary to interpose a detent key 9 between the cylinder head 1 and the subsidiary valve lifter 12 as in the previously described embodiment.

Figure 9:
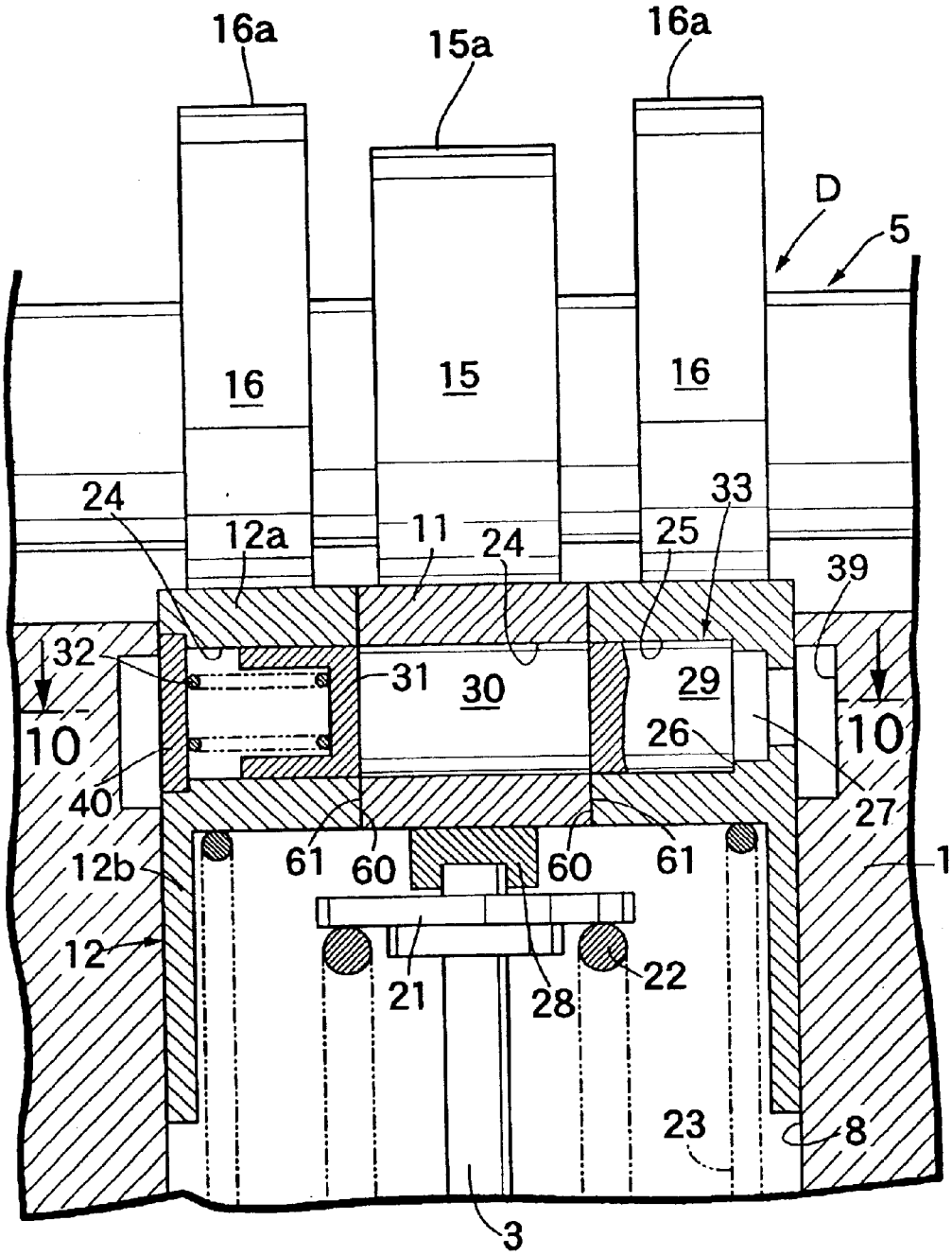
FIG. 9 is a sectional view similar to FIG. 2, but showing a second embodiment of the present invention.
Figure 10:
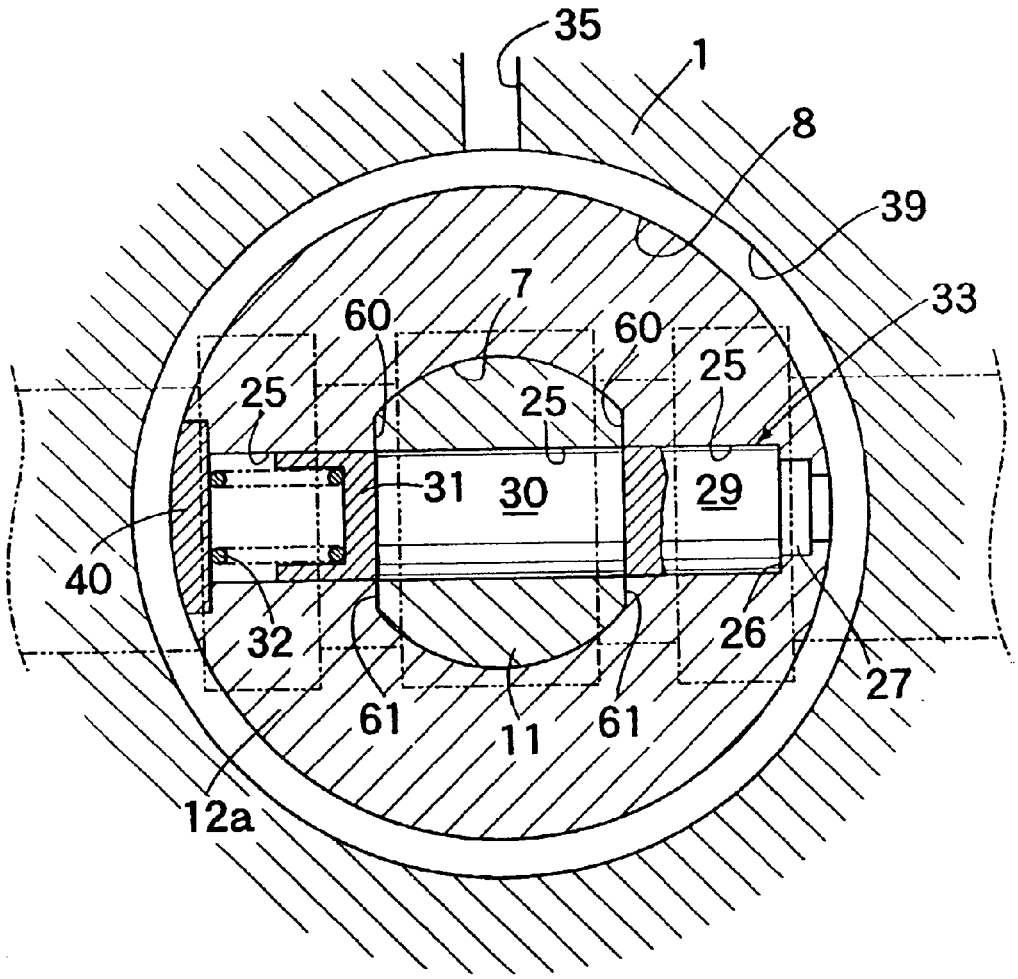
FIG. 10 is a sectional view taken along a line 10—10 in FIG. 9.

The other constructions are similar to those in the previously described embodiment and hence, portions or components corresponding to those in the previously described embodiment are designated by like reference characters in FIGS. 9 and 10, and the description of them is omitted.

A third embodiment of the present invention shown in FIGS. 11 to 17 will be described below.

The third embodiment of the present invention is also applied to an internal combustion engine of a two-valve and twin-camshaft type, and the constructions of valve-operating devices for a pair of intake valves and a pair of exhaust valves are the same as each other. Therefore, the valve-operating device D for the intake valves 3, 3 will be representatively described below.

A circular lifter guide bore 8 is provided in a cylinder head 1, and main and subsidiary valve lifters 11 and 12 are slidably received in the lifter guide bore 8. The main valve lifter 11 is formed into an arcuate shape and has an outer peripheral surface of a major arc shape corresponding to an inner peripheral surface of the lifter guide bore 8, and an axial flat face 11*c* which connects opposite end edges of the outer peripheral surface to each other. The subsidiary valve lifter 12 is likewise formed into an arcuate shape and has an outer peripheral surface of a minor arc shape corresponding to the inner peripheral surface of the lifter guide bore 8, and a flat face 12*c* which connects opposite end edges of the outer peripheral surface to each other. The valve lifters 11 and 12 are formed, so that they form a single cylindrical shape, when their flat faces 11*c* and 12*c* are mated to each other. The valve lifters 11 and 12 are slidably received in the common lifter guide bore 8 with their flat faces 11*c* and 12*c* mated to each other. In this case, the flat faces 11*c* and 12*c* of the valve lifters 11 and 12 are disposed in parallel to an axis of the lifter guide bore 8 to extend through between the valve lifters 11 and 12, so that they can be slid axially relative to each other, and the individual sliding movement of the valve lifters 11 and 12 in the lifter guide bore 8 is permitted.

A detent key 10 is interposed between at least one of the valve lifters 11 and 12 and the cylinder head 1.

Each of the main and subsidiary valve lifters 11 and 12 includes a thicker head portion 11*a*, 12*a*, and a thinner arcuate skirt portion 11*b*, 12*b* extending downwards from a lower surface of the head portion 11*a*, 12*a* and continuous to the arcuate outer peripheral surface.

On the other hand, the camshaft 5 is formed with a main cam 15 which is in sliding contact with the upper surface of the main valve lifter 11, and a subsidiary cam 16 which is in sliding contact with the upper surface of the subsidiary valve lifter 12. There is no difference of height between base circle-portions of the main and subsidiary cams 15 and 16, but a lift portion 16*a* of the subsidiary cam 16 is formed higher in level than a lift portion 15*a* of the main cam 15. Therefore, the main cam 15 is used for a lower speed, and the subsidiary cam 16 is used for a higher speed.

A stem head of a valve 3 disposed at the center of the lifter guide bore 8 abuts against a lower surface of the head portion 11*a* of the main valve lifter 11 through a shim 28. A coiled valve spring 22 is mounted between a flange-shaped retainer 21 fixed to a stem of the valve 3 and the cylinder head 1 for biasing the valve 3 in a closing direction, i.e., toward the main cam 15. A common coiled lifter spring 23 is mounted between the lower surfaces of the head portions 11*a* and 12*a* of the main and subsidiary valve lifters 11 and 12 and the cylinder head 1 in proximity to inner surfaces of the skirt portions 11*b* and 12*b* for biasing the valve lifters 11 and 12 toward the main and subsidiary cams 15 and 16.

The head portion 11*a* of the main valve lifter 11 is provided with a main guide bore 24 which opens into the flat face 11*c*, and a hydraulic pressure chamber 27 which leads to the main guide bore 24 through an annular step 26 and opens into an outer periphery. The head portion 12*a* of the subsidiary valve lifter 12 is provided with a bottomed subsidiary guide bore 25 which opens perpendicularly to the flat face 12*c*. The main guide bore 24 is formed longer than the subsidiary guide bore 25.

A connecting plunger 30 is slidably received in the main guide bore 24; a return piston 31 is slidably received in the subsidiary guide bore 25, and a return spring 32 is accommodated in the subsidiary guide bore 25 for biasing the return piston 31 toward the main valve lifter 11. The main and subsidiary guide bores 24 and 25 are formed at the same diameter, so that when the main and subsidiary cams 15 and 16 are brought simultaneously into contact with the upper surfaces of the main and subsidiary valve lifters 11 and 12, i.e., when the upper surfaces of the valve lifters 11 and 12 are brought into the same level, the connecting plunger 30 can be moved into and out of the subsidiary guide bore 25 in the subsidiary valve lifter 12. A connecting means 33 is formed by the connecting plunger 30, the return piston 31, the return spring 32 and the hydraulic pressure chamber 27.

When the return piston 31 and the connecting plunger 30 are moved all at once toward the hydraulic pressure chamber 27, whereby the return piston 31 is put into abutment against the annular step 26, a non-connecting state of the connecting means 33 is established. At this time, the connecting plunger 30 occupies a position where the relative sliding movement of the main and subsidiary valve lifters 11 and 12 is not obstructed. When the return piston 31 and the connecting plunger 30 are moved all at once toward the subsidiary guide bore 25, whereby the return piston 31 is put into abutment against an end wall of the subsidiary guide bore 25, a connecting state of the connecting means 33 is established. At this time, the connecting plunger 30 occupies a position where it traverses a border between the main and subsidiary valve lifters 11 and 12 to restrict the relative sliding movement of the main and subsidiary valve lifters 11 and 12.

Figure 13:
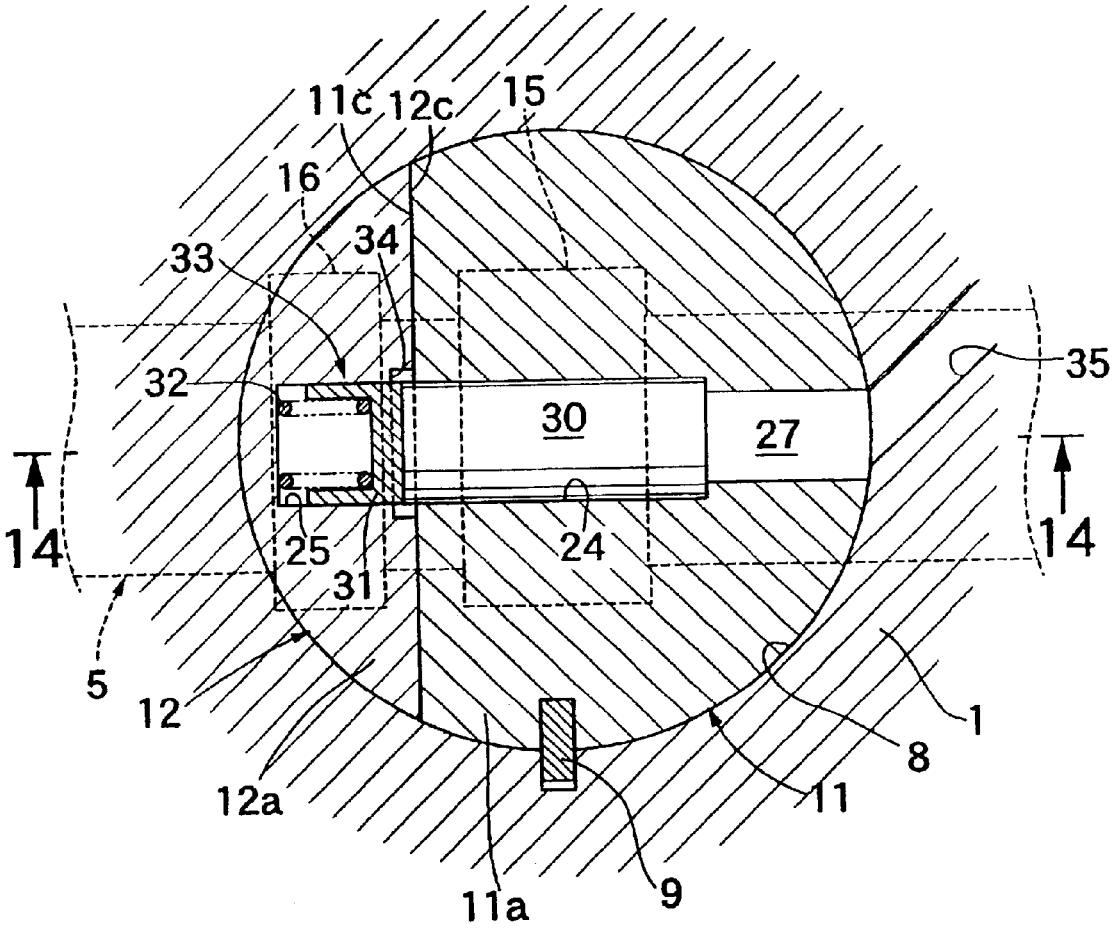
FIG. 13 is a sectional view taken along a line 13—13 in FIG. 12.
Figure 14:
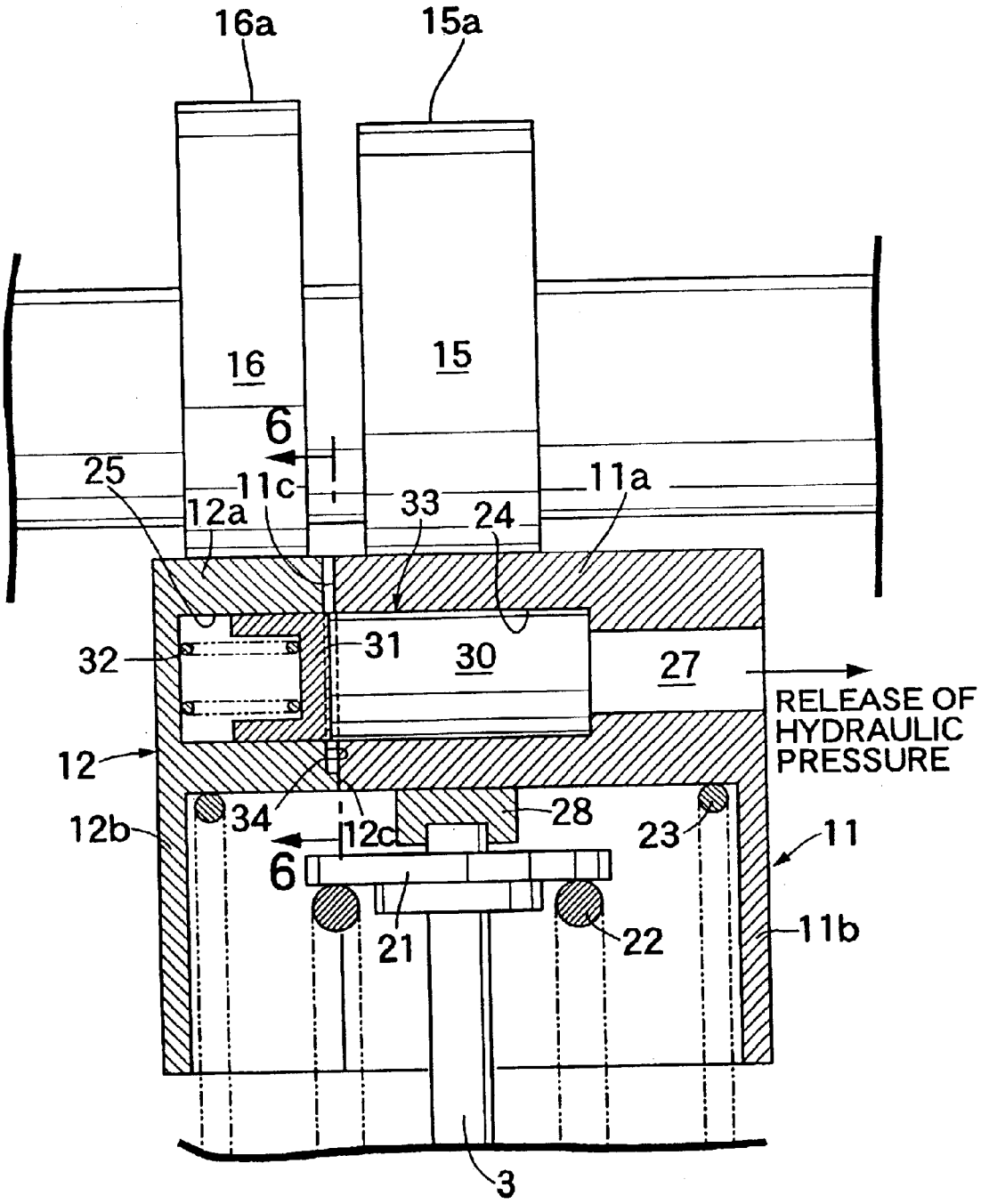
FIG. 14 is an enlarged sectional view taken along a line 14—14 in FIG. 13 (showing a low-speed mode)
Figure 15:
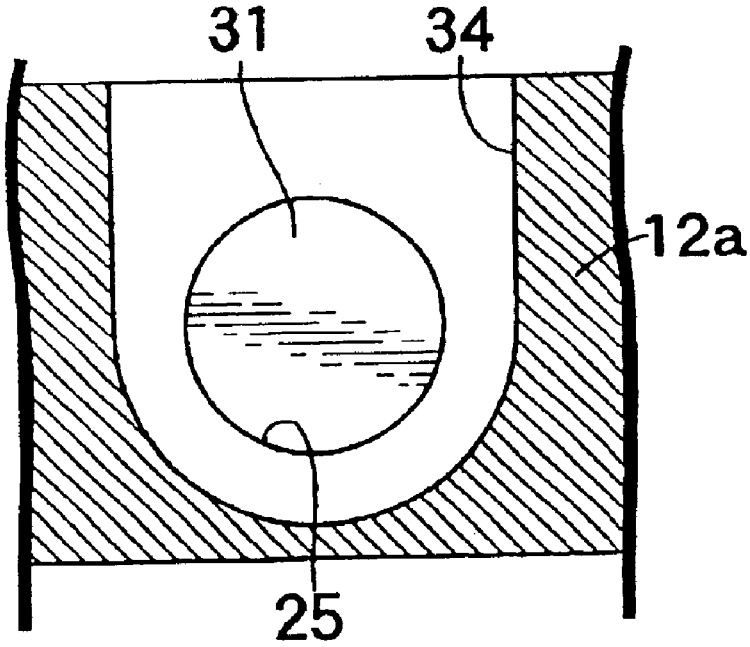
FIG. 15 is a sectional view taken along a line 15—15 in FIG. 14.

Referring to FIGS. 13 and 14, in order to avoid the interference of a tip end of the connecting plunger 30 and the subsidiary valve lifter 12 with each other or the interference of a tip end of the return piston 31 and the main valve lifter 11 due to a manufacture error in the non-connecting state of the connecting means 33, a relief recess 34 is provided in at least one of the opposed flat faces 11*c* and 12*c* of the main and subsidiary valve lifters 11 and 12, e.g., in the flat face 12*c* of the subsidiary valve lifter 12 in the illustrated embodiment to extend axially, so that abutting end faces of the connecting plunger 30 and the return piston 31 are received in the relief recess 34. The relief recess 34 is of a U-shape in which it opens into the upper surface of the subsidiary valve lifter 12, as shown in FIG. 15, whereby the processing or working of the relief recess 34 is facilitated, and a lubricating oil can be retained therein.

An oil passage 35 is provided in the cylinder head 1 to communicate with the hydraulic pressure chamber 27, and a switchover valve (not shown) is mounted in the oil passage 35 for selectively connecting the oil passage 35 to a hydraulic pressure supply source such as a hydraulic pump and a low-pressure oil reservoir.

The operation of the third embodiment will be described below.

In low and medium speed operational ranges of the internal combustion engine, the hydraulic pressure chamber 27 is opened into the oil reservoir through the oil passage 35 to bring the connecting means 33 into a disconnecting state.

If the disconnecting state is provided, the return piston 31 retains the connecting plunger 30 by a biasing force of the return spring 32 in a position where it is in abutment against the annular step 26 of the main guide bore 24, as shown in FIG. 14. At this time, the tip end of the connecting plunger 30 is allowed to face to the relief recess 34, and the connecting means 33 is brought into the non-connecting state in which the relative sliding movement of the valve lifters 11 and 12 is possible, and thus, the valve-operating device D is brought into a low-speed mode.

Therefore, when the camshaft 5 is rotated, the main cam 15 causes the opening and closing motion of the valve 3 through the main valve lifter 11 by cooperation with the valve spring 22, but the subsidiary cam 16 only reciprocally moves the subsidiary valve lifter 12 uselessly with a stroke larger than that of the main valve lifter 11 by cooperation with the lifter spring 23 and does not participate in the opening and closing of the valve 3. Therefore, the opening and closing characteristic of the valve 3 in this case depends on a cam profile of the main cam 15 having the small-height lift portion 15*a*, and the low-speed and medium-speed performance of the engine can be enhanced.

The upper end of the lifter spring 23 is in abutment against lower surfaces of the head portions 11*a* and 12*a* of the main and subsidiary valve lifters 11 and 12 and hence, is inclined with the relative sliding movement of the valve lifters 11 and 12 due to a difference between lifts of the main and subsidiary cams 15 and 16. However, the difference between the lifts is relatively small and hence, the inclination is also slight and hence, the lifter spring 23 bears no burden.

The lifter spring 23 for biasing the main valve lifter 11 toward the subsidiary cam is supported at its stationary end, i.e., at its lower end on the cylinder head 1 and hence, a load received from the subsidiary cam 16 by the lifter spring 23 is received directly on the cylinder head 1 and does not influence on the valve 3 at all. Therefore, even if the subsidiary valve lifter 12 is reciprocally moved at a stroke larger than that of the main valve lifter 11 to flex the lifter spring 23 largely, resulting large inertia forces of the subsidiary valve lifter 12 and the lifter spring 23 cannot be applied to the valve 3. Thus, it is possible to prevent the occurrence of the jumping of the valve 3 and to suppress a useless increase in surface pressure on sliding portions and abutment portions extending from the main cam 15 to the valve 3 to prevent wears of them as much as possible, and a load of the camshaft 5 cannot be increased uselessly.

Figure 16:
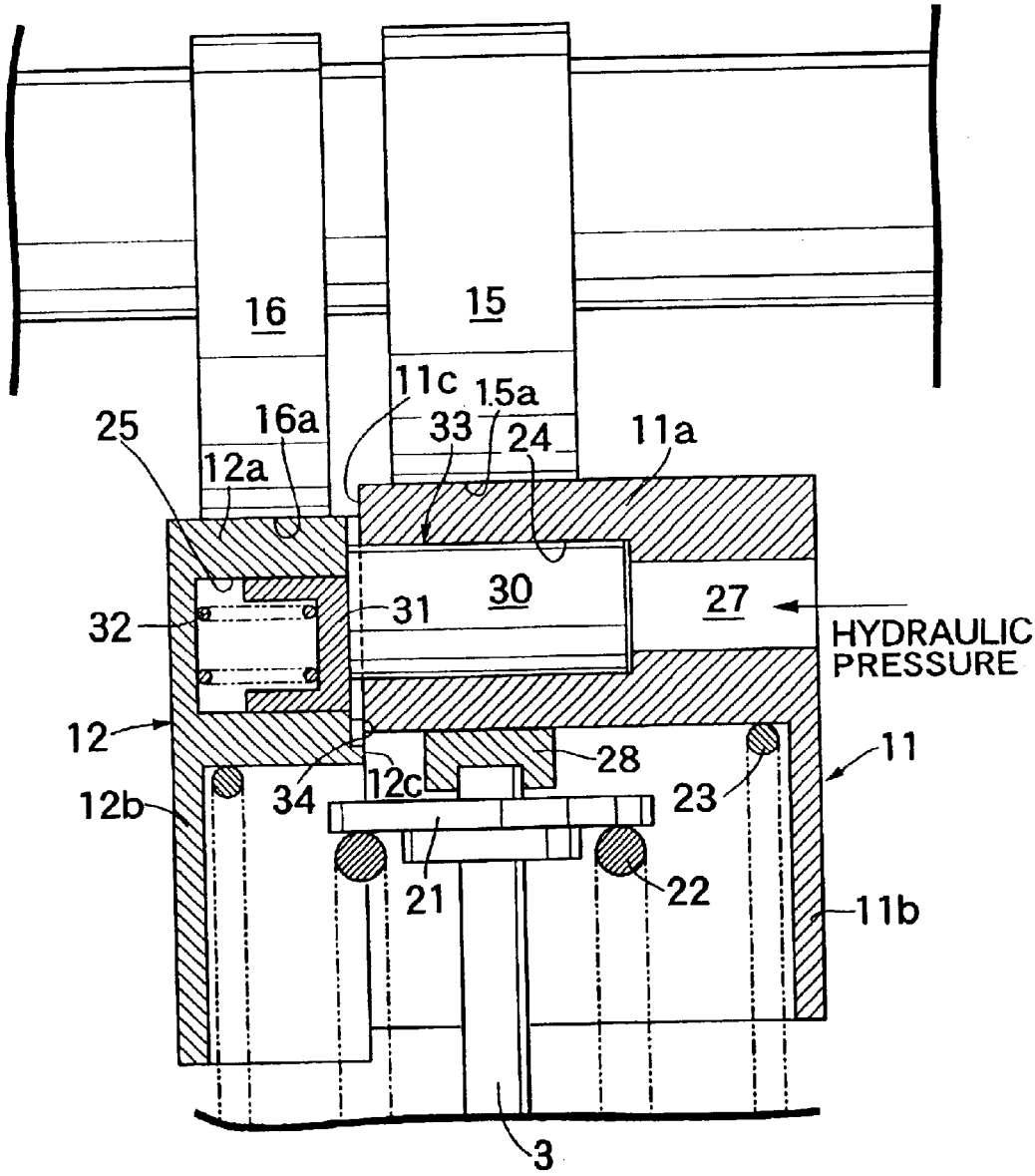
FIG. 16 is a view for explaining the operation, similar to FIG. 14, but showing a state of preparatory to the high-speed mode.
Figure 17:
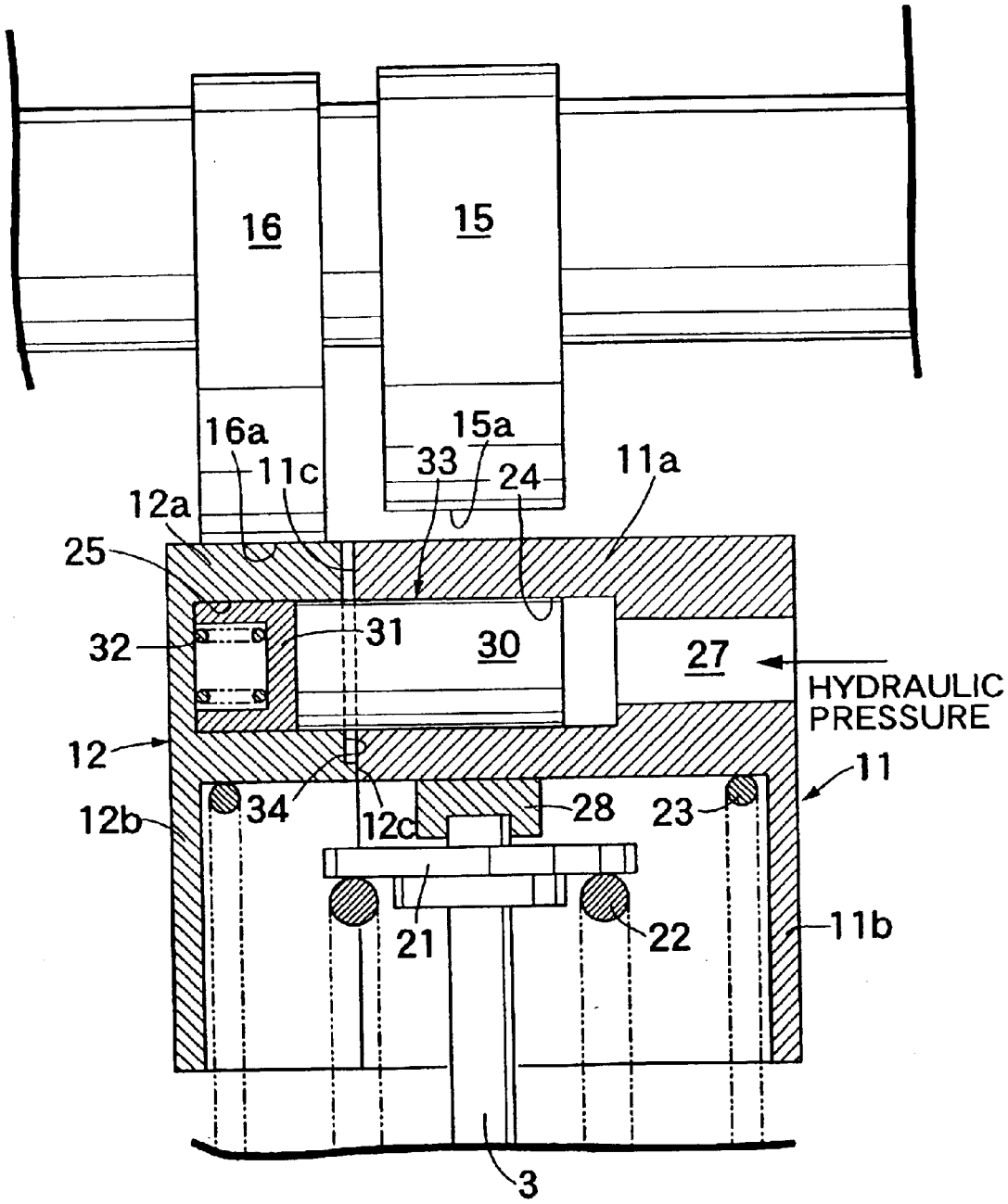
FIG. 17 is a view for explaining the operation, similar to FIG. 14, but showing the high-speed mode.

When the engine then reaches a high-speed operational range to permit a hydraulic pressure to be supplied from the oil passage 35 to the hydraulic pressure chamber 27, the connecting plunger 30 pushes the return piston 31 by the action of the hydraulic pressure in the hydraulic pressure chamber 27 against the biasing force of the return spring 32. However, if the main and subsidiary cams 15 and 16 are in contact with the upper surfaces of the main and subsidiary valve lifters 11 and 12 at points other than the base circle-portions at that time, positions of the main guide bore 24 and the subsidiary guide bore 25 are staggered from each other. Therefore, the connecting plunger 30 is once stopped in a position where it is in abutment against a side face of the subsidiary valve lifter 12, i.e., a bottom surface of the relief recess 34, as shown in FIG. 16, thereby providing a switchover preparative state.

When the base circle-portions of the main and subsidiary cams 15 and 16 are brought simultaneously into contact with the upper surfaces of the main and subsidiary valve lifters 11 and 12 from that state, the main and subsidiary guide bores 24 and 25 are brought in line with each other. The period of contact of the base circle-portions with the main and subsidiary valve lifters 11 and 12 is relatively long and hence, the connecting plunger 30 urges the return piston 31 by the hydraulic pressure in the hydraulic pressure chamber 27 against the biasing force of the return spring 32, thereby putting the return spring 31 into abutment against the end wall of the main guide bore 24 (see FIG. 17). Thus, the connecting means 33 is brought into the connecting state in which the relative sliding movement of the valve lifters 11 and 12 is impossible, and the valve-operating device D is brought into a high-speed mode.

Therefore, the subsidiary cam 16 having the large-height lift portions 16*a* opens and closes the valve 3 through the valve lifters 11 and 12 by cooperation with the valve spring 22, and the small-height lift portion 15*a* of the main cam 15 is raced relative to the main valve lifter 11. The opening/closing characteristic of the valve 3 in this case depends on the cam profile of the subsidiary cam 16 having the large-height lift portion 16*a*, and an enhancement in high-speed performance of the engine can be provided.

In this case, the valve spring 22 and the lifter spring 23 in a parallel relation to each other exhibit repulsive forces to the valve lifters 11 and 12 in their connected states and hence, a sum total of the repulsive forces is applied to both of the valve lifters 11 and 12. Therefore, notwithstanding the valve lifters 11 and 12 have been integrated, resulting in an increased inertia mass, the inertia forces of the valve lifters 11 and 12 can be suppressed effectively, whereby the jumping of the valve 3 is prevented, and moreover, the return responsiveness of the valve lifters 11 and 12 and accordingly, the closing responsiveness of the valve 3 can be enhanced to contribute to a further enhancement in high-speed performance.

When the engine is returned again to the low-speed and medium-speed operational ranges, whereby the hydraulic pressure in the hydraulic pressure chamber 27 is released to the oil reservoir, the following is obvious: The return piston 31 pushes the connecting plungers 30 back to the original positions with the repulsive force of the return spring 32 and hence, the connecting means 33 is brought into the non-connecting state in which the relative sliding movement of the main and subsidiary valve lifters 11 and 12 is possible.

The main and subsidiary valve lifters 11 and 12 are formed into arcuate shapes, so that when their flat faces 11*c* and 12*c* are mated to each other, a single cylindrical shape is formed. The main guide bore 24 is provided in the main valve lifter 11 to open into the flat face 11*c*, so that the connecting plunger 30 is received in the main guide bore 24, and the subsidiary guide bore 25 is provided in the subsidiary valve lifter 12 to open into the flat faces 12*c*, so that the return piston 31 is received in the subsidiary guide bore 25. Therefore, it is possible to perform the prevention of the relative rotation of the main and subsidiary valve lifters 11 and 12 without chattering by the abutment of the wide flat faces 11*c* and 12*c* against each other and hence, even if a special positioning means is not provided, the main and subsidiary guide bores 24 and 25 can be brought easily and properly in line with each other. Moreover, the two members: the connecting plunger 30 and the return piston 31 suffice as sliding members used in the connecting means 33 and hence, it is possible to provide a remarkable reduction in number of parts.

In addition, the main valve lifter 11 is formed into a major arc shape, and the connecting plunger 30 is supported in the relatively long main guide bore 24 provided in the main valve lifter 11. Therefore, a long support span of the connecting plunger 30 can be ensured and hence, in the connecting state of the connecting means 33, the falling of the connecting plunger 30 can be suppressed to the minimum, and hence, a good state in which the valve lifters 11 and 12 have been connected to each other can be provided.

A fourth embodiment of the present invention shown in FIGS. 18 and 19 will be described below.

The forth embodiment of the present invention is applied to an four-valve type internal combustion engine including a pair of parallel intake valves 3, 3 and a pair of parallel exhaust valves (not shown). An intake camshaft 5 and an exhaust camshaft (not shown) are disposed immediately above the pair of intake valves 3, 3 and the pair of exhaust valves to extend in a direction of arrangement of the intake valves 3, 3 and in a direction of arrangement of the exhaust valves, respectively. Two sets of main and subsidiary valve lifters 11, 12; 11, 12 are mounted in correspondence to the pair of valves 3, 3. In this case, flat faces 46, 46 are formed on one-sides of outer peripheral surfaces of the main valve lifter 11, 11 of each pair, and the two sets of main and subsidiary valve lifters 11, 12; 11, 12 are disposed adjacent each other in such a manner that the flat faces 46, 46 are in abutment against each other. A pair of lifter guide bores 8, 8 are provided in the cylinder head 1 to receive the two sets of main and subsidiary valve lifters 11, 12; 11, 12 therein for sliding movement, and disposed in a partially overlapped relation. The flat faces 46, 46 are disposed at a border between the lifter guide bores 8, 8.

With such arrangement, the disposition of the two sets of main and subsidiary valve lifters 11, 12; 11, 12 in proximity to each other, in other words, the disposition of the pair of valves 3, 3 in proximity to each other is possible to achieve the compactness of the engine. Moreover, the adjoining main valve lifters 11, 11 restrict the rotation relative to each other by the abutment of the flat faces 46, 46 against each other and hence, it is unnecessary to insert a detent key into between the main and subsidiary valve lifters 11 and 12 in each pair and the lifter guide bore 8, which can contribute to the simplification of the arrangement.

An oil passage 35 connected to hydraulic pressure chambers 27, 27 in the adjoining main valve lifters 11, 11 is provided as common one. This enables the oil passage 35 in the entire valve-operating device D to be simplified.

Figure 18:
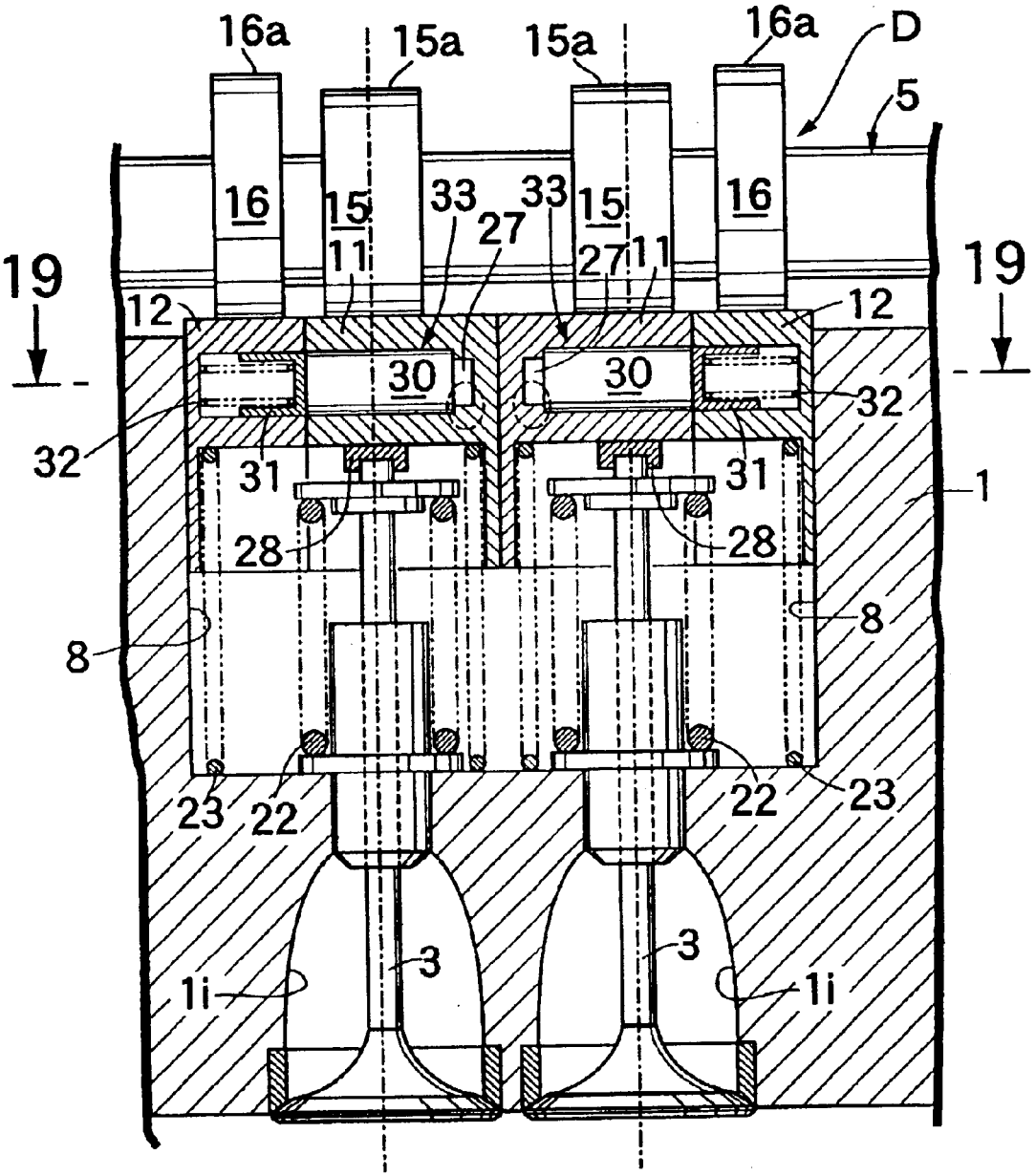
FIG. 18 is a vertical sectional view of a valve-operating system for a four-valve and twin-camshaft type internal combustion engine according to a fourth embodiment of the present invention.
Figure 19:
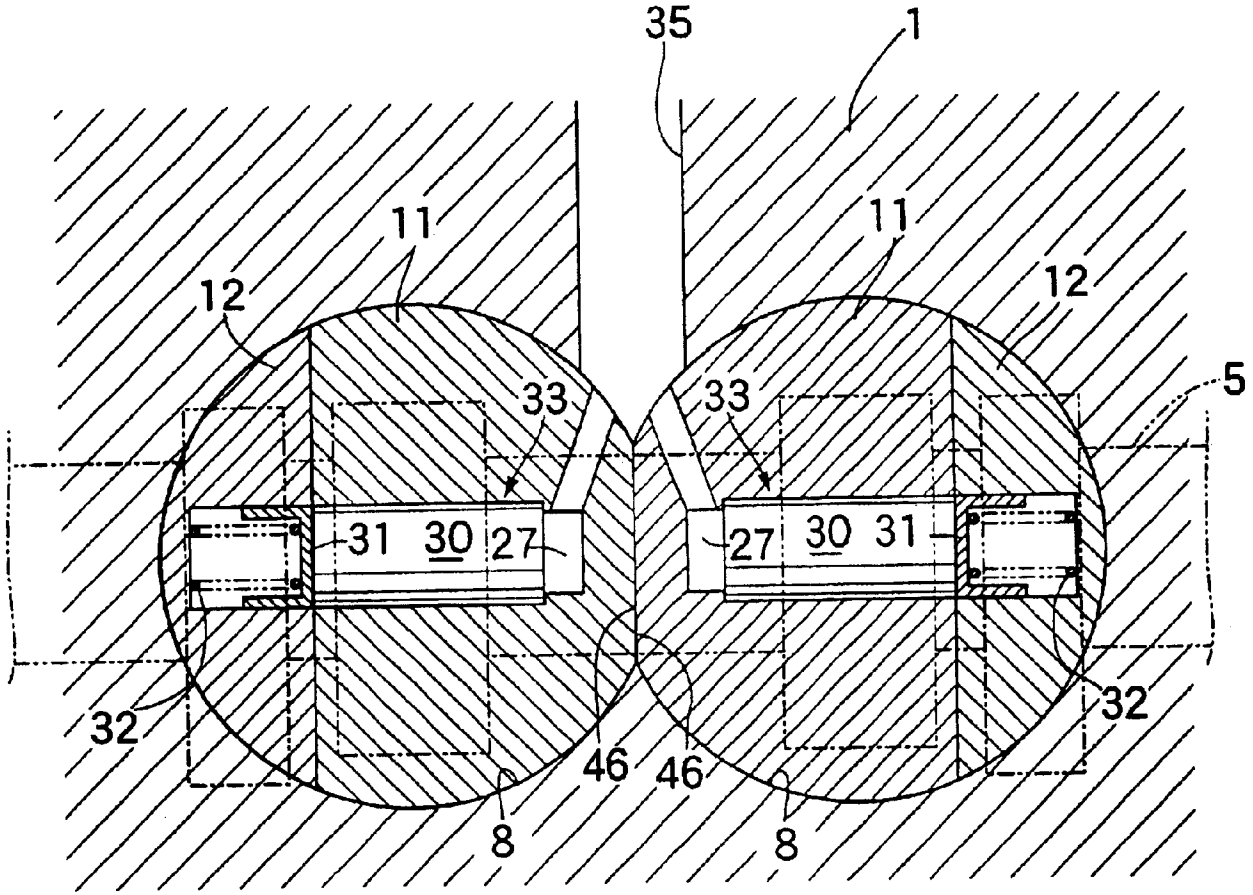
FIG. 19 is a sectional view taken along a line 19—19 in FIG. 10.

The other constructions are the same as in the first embodiment and hence, portions or components corresponding to those in the third embodiment are designated by like reference characters in FIGS. 18 and 19, and the description of them is omitted.

Figure 11:
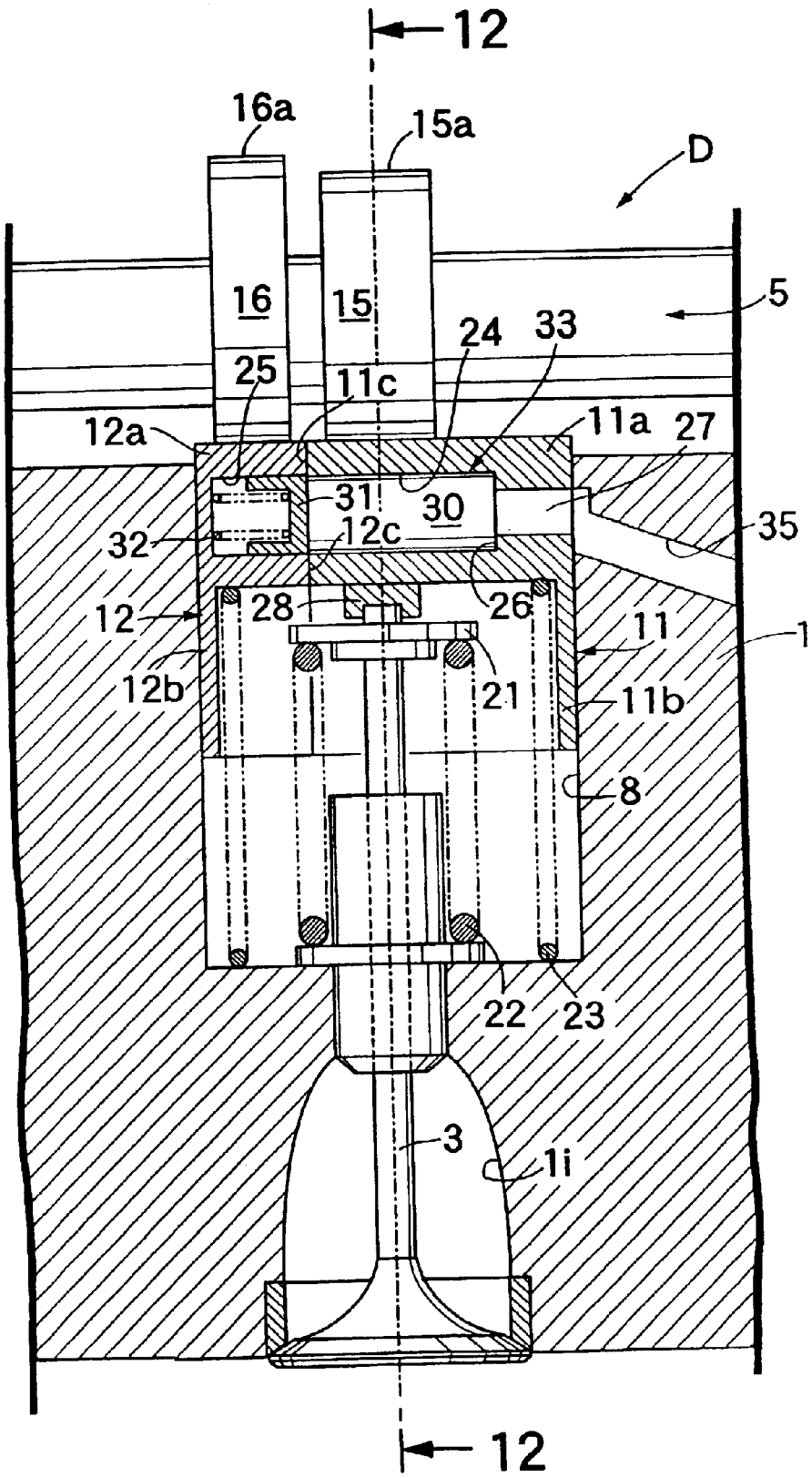
FIG. 11 is a vertical sectional view of a valve-operating system for a two-valve and twin-camshaft type internal combustion engine according to a third embodiment of the present invention.
Figure 12:
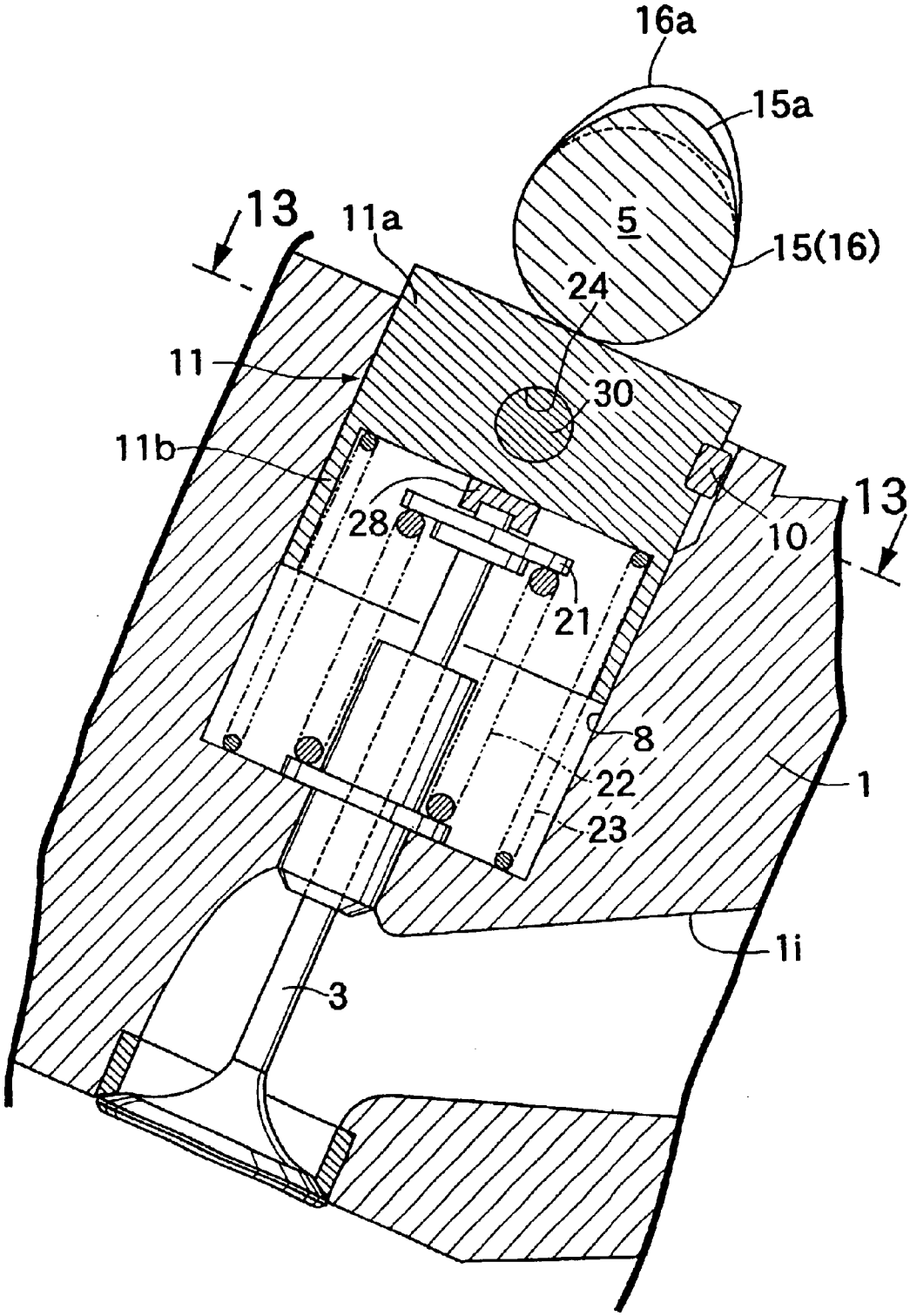
FIG. 12 is a sectional view taken along a line 12—12 in FIG. 11.

A fifth embodiment of the present invention shown in FIGS. 11 and 12 will be described below.

In the fifth embodiment, left one 3' of a pair of left and right intake valves 3' and 3 is stopped in a low-speed operational range of the engine. In order to ensure that the left intake valve 3' can be stopped, a left main cam 15' has substantially no lift portion. However, in order to avoid the residence of a fuel in a corresponding intake port 1*i*' during stoppage of the intake valve 3', an extremely small-height lift portion may be formed on the main cam 15', so that the intake valve 3' can be opened at a very small opening degree in an intake stroke of the engine. A hydraulic pressure is supplied individually to left and right hydraulic pressure chambers 27' and 27 through a pair of oil passages 35' and 35, respectively.

Figure 20:
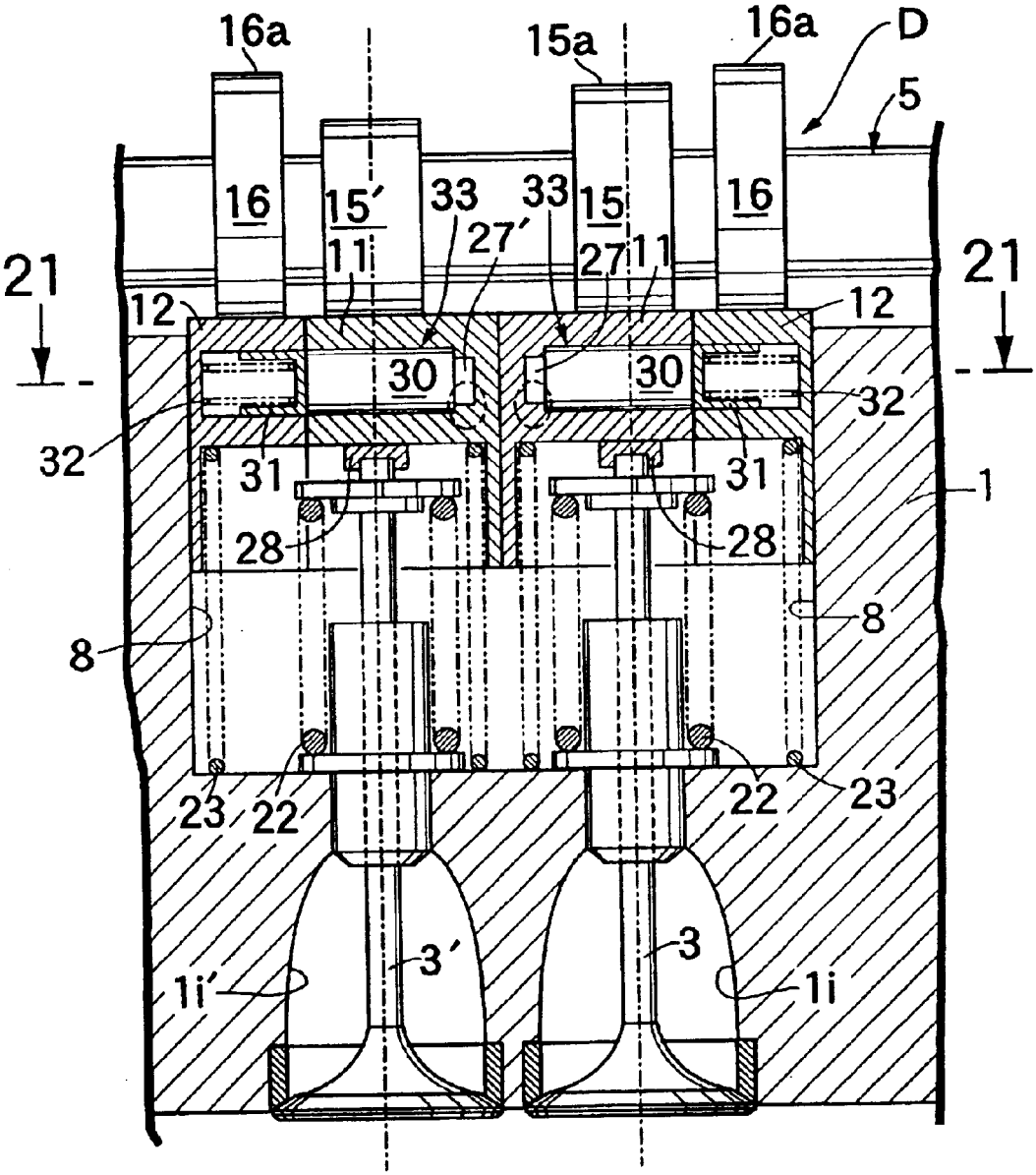
FIG. 20 is a sectional view similar to FIG. 18, but showing a fifth embodiment of the present invention.
Figure 21:
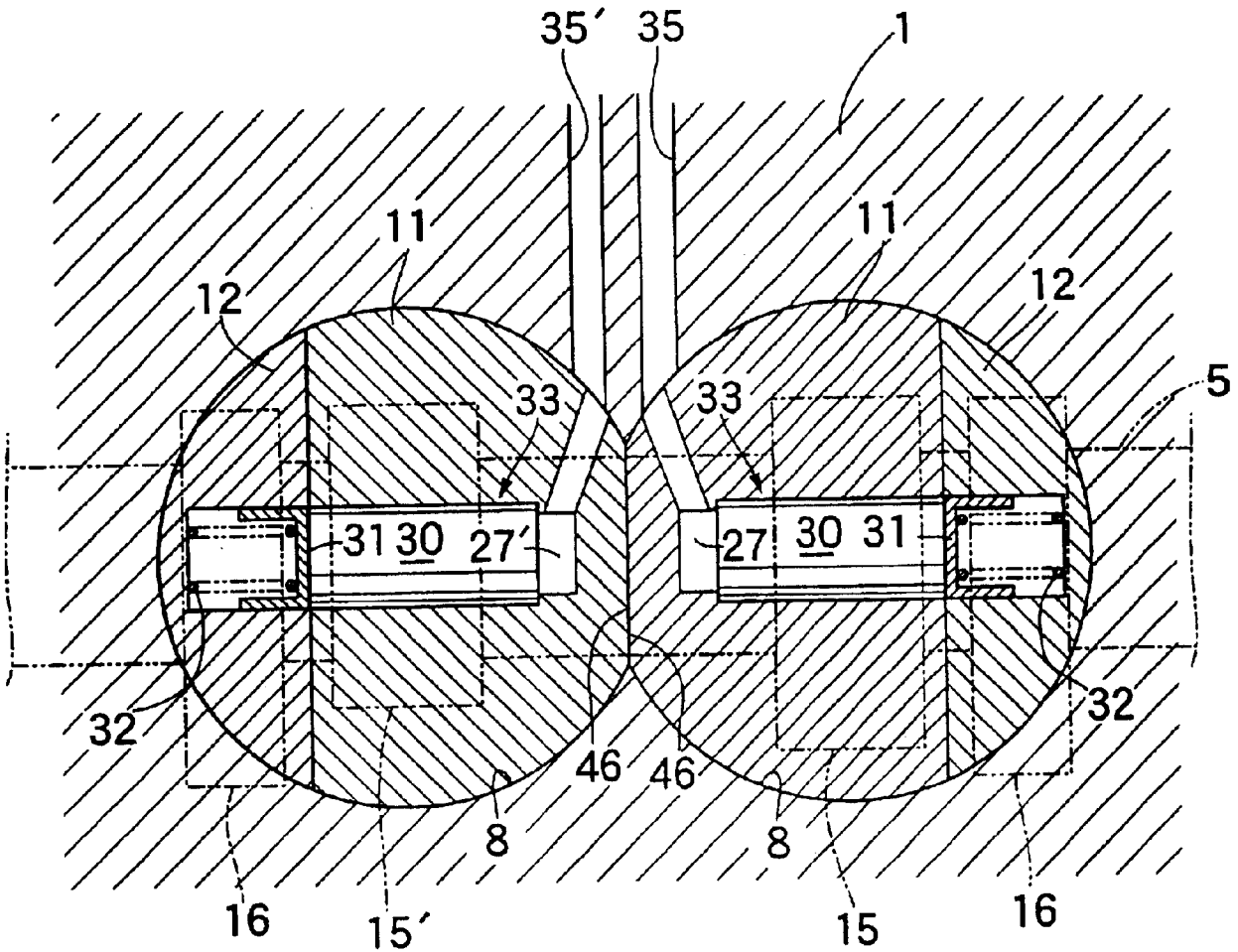
FIG. 21 is a sectional view taken along a line 21—21 in FIG. 20.

The other constructions are the same as in the fourth embodiment and hence, portions or components corresponding to those in the fourth embodiment are designated by like reference characters in FIGS. 20 and 21, and the description of them is omitted.

Thus, in a low-speed range of the engine, the left and right hydraulic pressure chambers 27' and 27 are opened into oil reservoirs through the oil passages 35' and 35, respectively, thereby bringing left and right connecting means 33, 33 into their disconnecting states. Therefore, main and subsidiary valve lifters 11 and 12 individually corresponding to the left and right intake valves 3' and 3 are operable individually. Therefore, the main valve lifter 11 in sliding contact with a main cam 15' having no lift portion is substantially not operated and thus, the intake valve 3' is retained in a stopped state in which it has been closed by a corresponding valve spring 22. On the other hand, a right main cam 15 having a lift portion 15*a* opens the intake valve 3 through the corresponding main valve lifter 11 in an intake stroke of the engine, as in each of the previously described embodiments. Therefore, both of air and a fuel are drawn through only the right intake port 1*i* into the cylinder bore, where a swirl is produced to improve the mixing of the air and the fuel, thereby enabling the burning of a lean air-fuel mixture to contribute to a reduction in fuel consumption.

When the engine is brought into a medium-speed operational range, a hydraulic pressure is supplied only to the right hydraulic pressure chamber 27 through the oil passage 35, whereby only the right connecting means 33 is brought into its connecting state. Therefore, the right intake valve 3 is opened largely in the intake stroke of the engine through the right main and subsidiary valve lifters 11 and 12 by the large-height lift portion 16*a* of the right subsidiary cam 16 and hence, the amount of air-fuel mixture drawn can be increased, leading to an enhancement in medium-speed output performance of the engine.

When the engine reaches a high-speed operational range, the hydraulic pressure is supplied from the oil passages 35' and 35 to both of the left and right hydraulic pressure chambers 27' and 27 to bring both of the connecting means 33, 33 into their connecting states, thereby connecting the main and subsidiary valve lifters 11 and 12 in each pair to each other. Therefore, both of the intake valves 3' and 3 are opened largely in the intake stroke of the engine by the large-height lift portions 16*a*, 16*a* of the left and right subsidiary cams 16, 16 through the corresponding valve lifters 11, 12; 11, 12 and hence, a large amount of the air-fuel mixture can be drawn, leading to an enhancement in high-speed output performance of the engine.

A sixth embodiment of the present invention shown in FIG. 22 will be described below.

The sixth embodiment is applied to a four-valve type internal combustion engine designed so that a pair of intake valves 3, 3 and a pair of exhaust valves 4, 4 are opened and closed by a single common camshaft 50. More specifically, a plurality of sets of main and subsidiary cams 15 and 16 are formed in the camshaft 50 in correspondence to the pair of intake valves 3, 3 and the pair of exhaust valves 4, 4. The corresponding main cam 15 and main valve lifter 11 are operatively connected to each other, and the corresponding subsidiary cam 16 and the subsidiary valve lifter 12 are operatively connected to each other, in both cases through main and subsidiary rocker arms 51 and 52 swingably carried in the cylinder head 1. Reference character 53 is a rocker shaft on which the rocker arms 51, 52 are carried.

Figure 22:
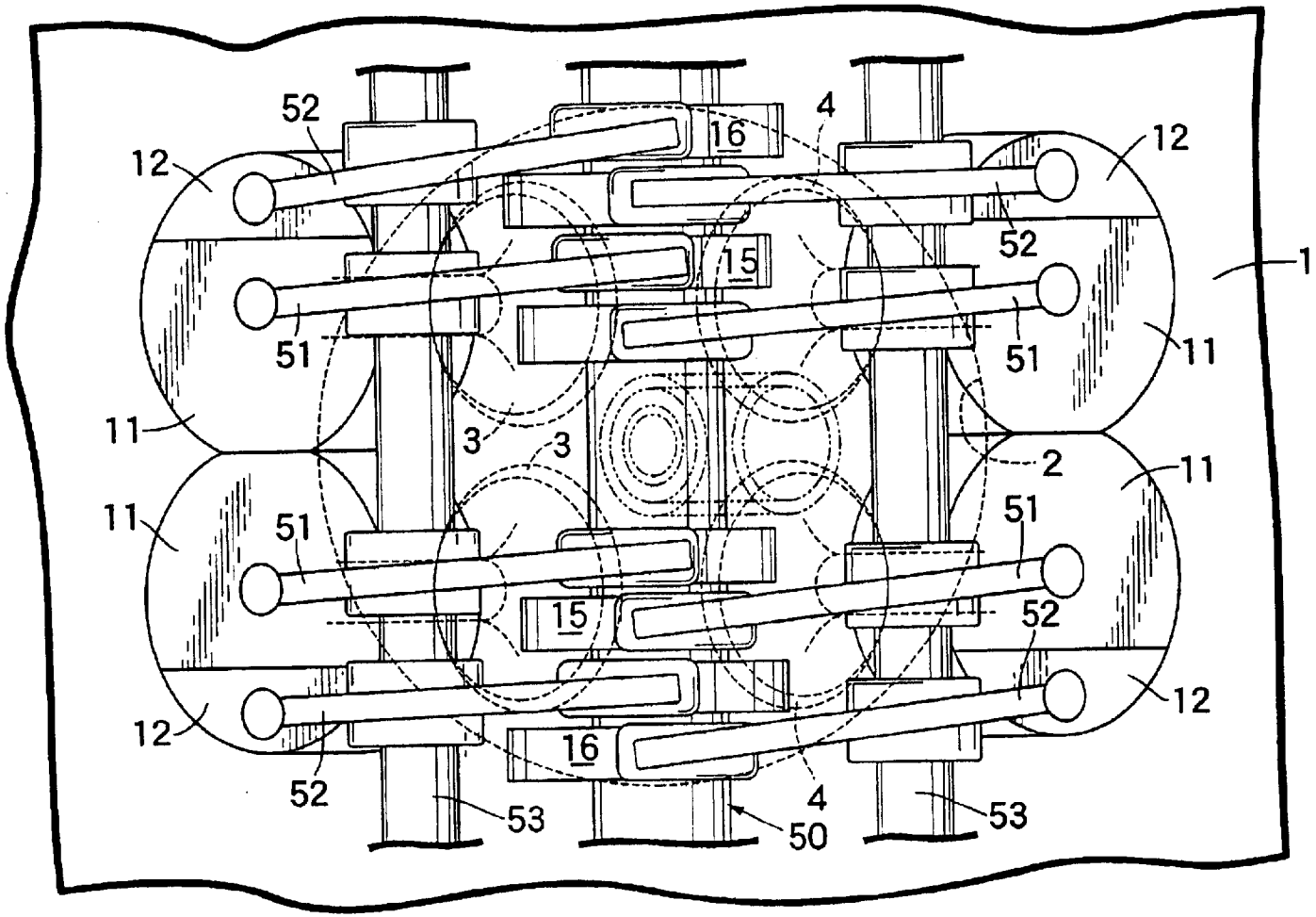
FIG. 22 is a plan view of a valve-operating system for a four-valve and single-camshaft type internal combustion engine according to a sixth embodiment of the present invention.

The other constructions are the same as those in the fourth embodiment and hence, portions or components corresponding to those in the fourth embodiment are designated by like reference characters in FIG. 22, and the description of them is omitted.

A seventh embodiment of the present invention shown in FIGS. 23 to 29 will be described below.

The seventh embodiment of the present invention is applied to a valve-operating system in an internal combustion engine of a two-valve and twin-camshaft type. Only the valve-operating device D on the side of an intake valve 3 will be described below.

Figure 23:
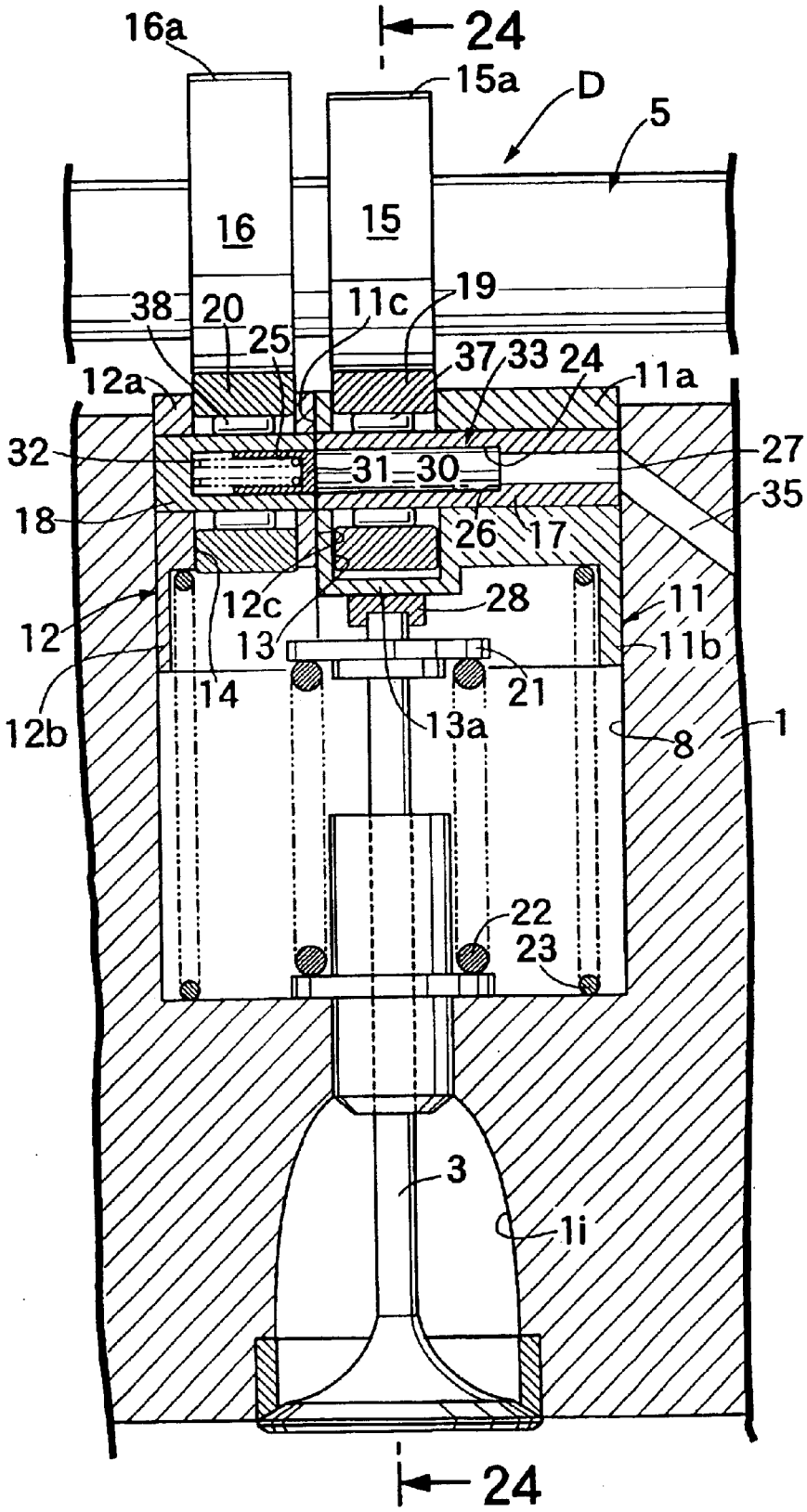
FIG. 23 is a vertical sectional view of a valve-operating system for a two-valve and twin-camshaft type internal combustion engine according to a seventh embodiment of the present invention.
Figure 24:
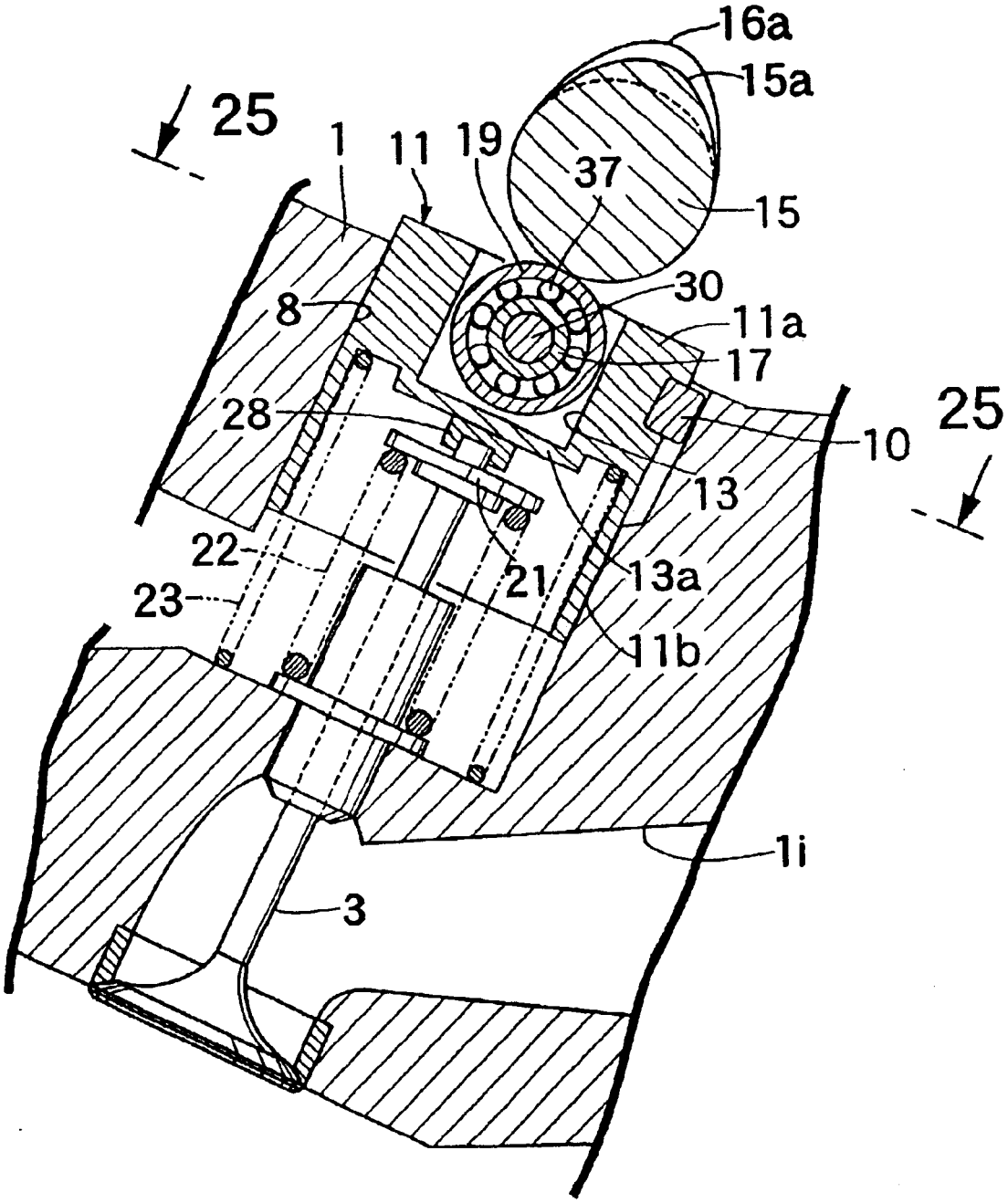
FIG. 24 is a sectional view taken along a line 24—24 in FIG. 23.

As shown in FIGS. 23 and 24, a circular lifter guide bore 8 is provided in a cylinder head 1 above an intake valve 3, and main and subsidiary valve lifters 11 and 12 are slidably received in the lifter guide bore 8. The main valve lifter 11 is formed into an arcuate shape and has an outer peripheral surface of a major arc shape corresponding to an inner peripheral surface of the lifter guide bore 8, and an axial flat face 11*c* which connects opposite end edges of the outer peripheral surface to each other. The subsidiary valve lifter 12 is likewise formed into an arcuate shape and has an outer peripheral surface of a minor arc shape corresponding to an inner peripheral surface of the lifter guide bore 8, and a flat face 12*c* which connects opposite end edges of the outer peripheral surface to each other. The valve lifters 11 and 12 are formed so that when their flat faces 11*c* and 12*c* are mated to each other, a single cylindrical shape is formed. The valve lifters 11 and 12 are slidably received in the common lifter guide bore 8 with their flat faces 11*c* and 12*c* mated to each other. In this case, the flat faces 11*c* and 12*c* of the valve lifters 11 and 12 are disposed in parallel to an axis of the lifter guide bore 8 to traverse through between valve lifters 11 and 12, so that they can be axially slid relative to each other, and the individual sliding movement of the valve lifters 11 and 12 in the lifter guide bore 8 is permitted.

A detent key 10 is interposed between at least one of the valve lifters 11 and 12 and the cylinder head 1, thereby the main and subsidiary valve lifters 11 and 12 are positioned, so that their flat faces 11*c* and 12*c* are perpendicular to the axis of a camshaft 5.

Each of the main and subsidiary valve lifters 11 and 12 includes a thicker head portion 11*a*, 12*a*, and a thinner arcuate skirt portion 11*b*, 12*b* extending downwards from a lower surface of the head portion 11*a*, 12*a* and continuous to the arcuate outer peripheral surface. The head portions 11*a* and 12*a* of the main and subsidiary valve lifters 11 and 12 are provided with main and subsidiary roller housings 13 and 14, in which main and subsidiary rollers 19 and 20 are accommodated. The main and subsidiary rollers 19 and 20 are rotatably carried on main and subsidiary roller support shafts 17 and 18 press-fitted into the main and subsidiary valve lifters 11 and 12 with needle bearings 37 and 38 interposed therebetween, respectively. In this case, the main and subsidiary roller support shafts 17 and 18 are disposed to cross the main and subsidiary valve lifters 11 and 12 from their flat faces 11*c* and 12*c* to their outer peripheral surfaces on the opposite side in parallel to the axis of the camshaft 5, respectively.

On the other hand, the camshaft 5 is formed with a main cam 15 which is in contact with an upper surface of the main roller 19, and a subsidiary cam 16 which is in contact with an upper surface of the subsidiary roller 20. There is no difference of height between base circle-portions of the main and subsidiary cams 15 and 16, but a lift portion 16*a* of the subsidiary cam 16 is formed higher in level than a lift portion 15*a* of the main cam 15. Therefore, the main cam 15 is used for a low speed, and the subsidiary cam 16 is used for a high speed. In order to avoid the interference of the main and subsidiary cams 15 and 16 and upper end faces of the main and subsidiary valve lifters 11 and 12 with each other, the main and subsidiary rollers 19 and 20 are disposed, so that their upper surfaces protrude at a predetermined height from the upper end faces of the main and subsidiary valve lifters 11 and 12.

The subsidiary roller housing 14 has a bottom surface opened, so that a lower surface of the subsidiary roller 20 is also exposed, in order to reduce the weight of the head portion 11*a* of the main valve lifter 11 to the utmost, but the main roller housing 13 is provided with a bottom wall 13*a* which covers a lower surface of the main roller 19, and a stem end of the valve 3 disposed at the center of the lifter guide bore 8 is in abutment against a lower surface of the bottom wall 13*a* through a shim 28. A coiled valve spring 22 is mounted between a flange-shaped retainer 21 fixed to a stem of the valve 3 and the cylinder head 1 for biasing the valve 3 in a closing direction, i.e., toward the main cam 15. A common coiled lifter spring 23 for biasing the valve lifters 11 and 12 toward the main and subsidiary cams 15 and 16 is mounted between lower surfaces of the head portions 11*a* and 12*a* of the main and subsidiary valve lifters 11 and 12 and the cylinder head 1 in proximity to inner surfaces of the skirt portions 11*b* and 12*b*.

The main roller support shaft 17 is provided with a main guide bore 24 which opens perpendicularly to the flat face 11*c*, and a hydraulic pressure chamber 27 which leads to the main guide bore 24 through an annular step 26 and opens into the arcuate outer peripheral surface. The subsidiary roller support shaft 18 is provided with a bottomed subsidiary guide bore 25 which opens perpendicularly to the flat face 12*c*. The main guide bore 24 is formed longer than the subsidiary guide bore 25.

A connecting plunger 30 is slidably received in the main guide bore 24. A return piston 31 is slidably received in the subsidiary guide bore 25, and a return spring 32 is accommodated in the subsidiary guide bore 25 for biasing the return piston 31 toward the main valve lifter 11. The main and subsidiary guide bores 24 and 25 are formed at the same diameter, so that when the main and subsidiary cams 15 and 16 are brought simultaneously into contact with upper surface of the main and subsidiary valve lifters 11 and 12, i.e., when the upper surface of the main and subsidiary valve lifters 11 and 12 are brought into the same level, the connecting plunger 30 can be moved into and out of the subsidiary guide bore 25 in the subsidiary valve lifter 42. A connecting means 33 is formed by the connecting plunger 30, the return piston 31, the return spring 32 and the hydraulic pressure chamber 27.

Thus, when the return piston 31 and the connecting plunger 30 are moved all at once toward the hydraulic pressure chamber 27, whereby the return piston 31 is put into abutment against the annular step 26, a non-connecting state of the connecting means 33 is established. At this time, the connecting plunger 30 occupies a position in which the relative sliding movement of the main and subsidiary valve lifters 11 and 12 is not obstructed. When the return piston 31 and the connecting plunger 30 are moved all at once toward the subsidiary guide bore 25, whereby the return piston 31 is put into abutment against an end wall of the subsidiary guide bore 25, a connecting state of the connecting means 33 is established. At this time, the connecting plunger 30 occupies a position in which it crosses a border between the valve lifters 11 and 12 to restrict the relative sliding movement of the valve lifters 11 and 12.

Figure 25:
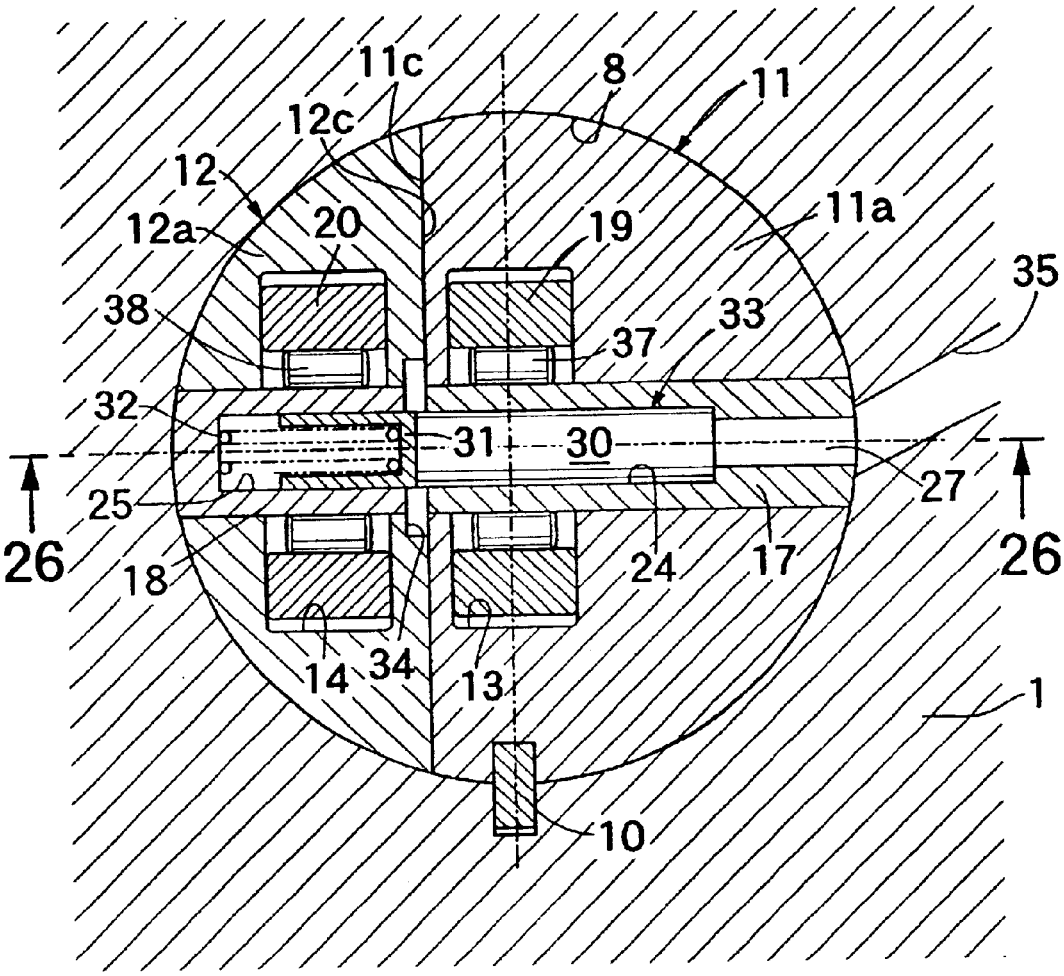
FIG. 25 is a sectional view taken along a line 25—25 in FIG. 24.
Figure 26:
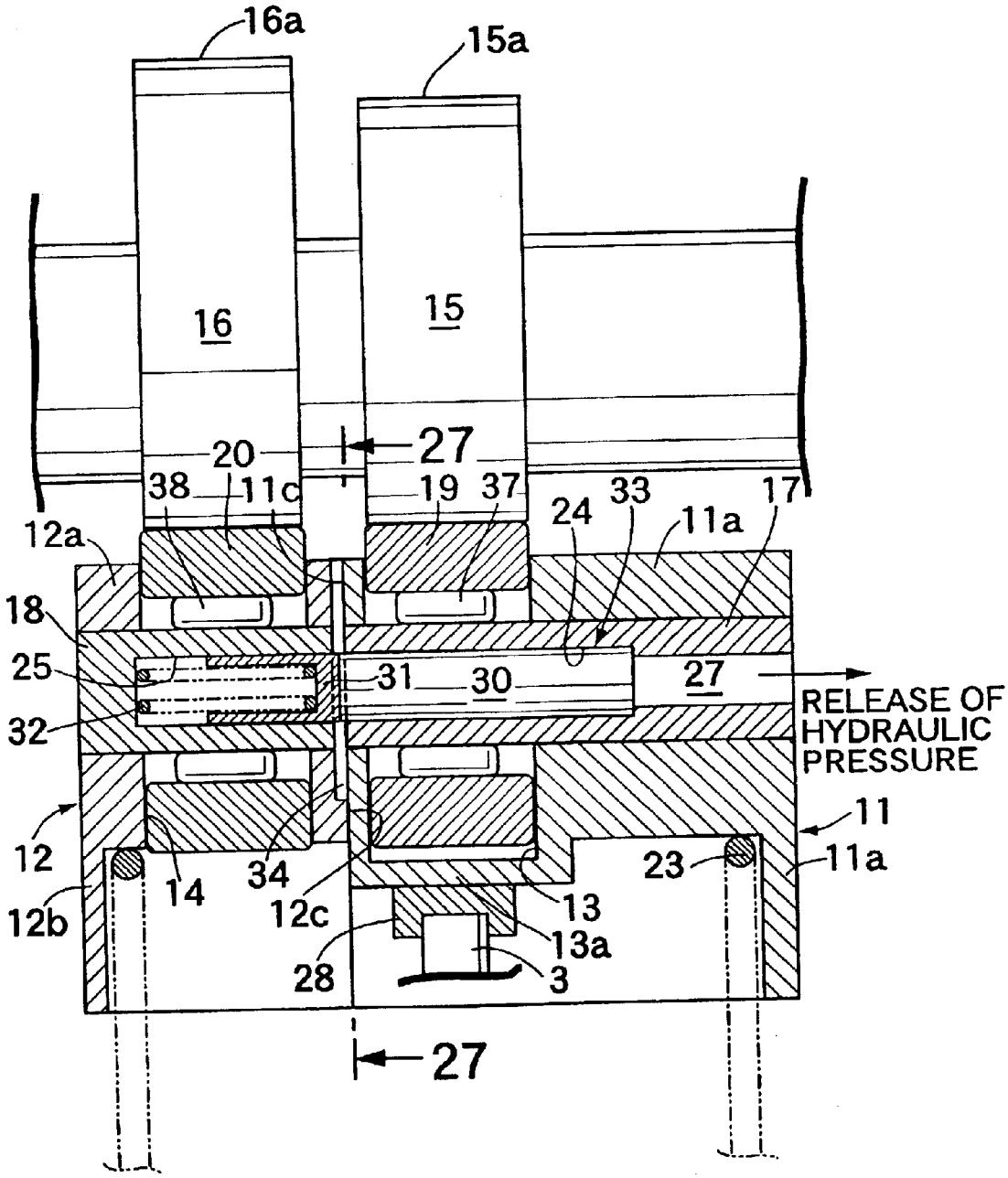
FIG. 26 is an enlarged sectional view taken along a line 26—26 in FIG. 25 (showing a low-speed mode)
Figure 27:
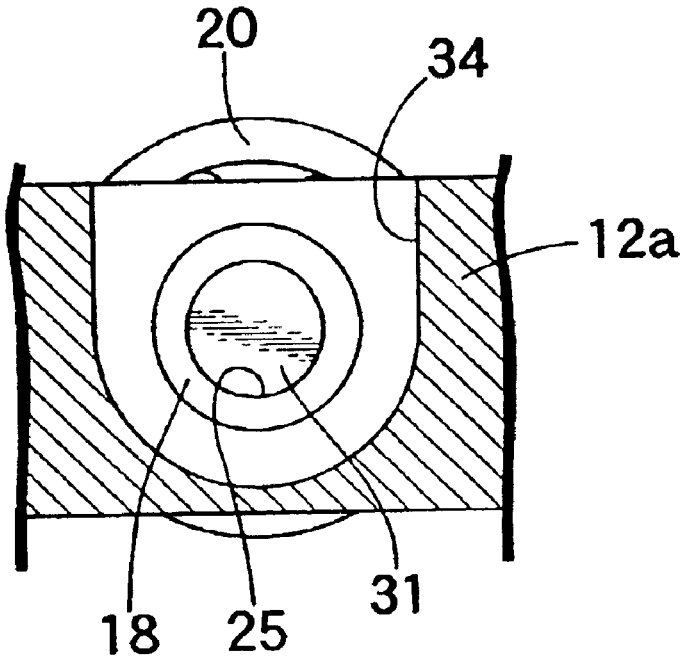
FIG. 27 is a sectional view taken along a line 27—27 in FIG. 26.

Referring to FIGS. 25 and 26, in order to avoid the interference of a tip end of the connecting plunger 30 and an opening of the guide bore 25 in the corresponding subsidiary valve lifter 12 with each other or the interference of a tip end of the return piston 31 and an opening of the guide bore 24 in the corresponding main valve lifter 11 due to a manufacture error in the non-connecting state of the connecting means 33, a relief recess 34 is provided in at least one of the opposed flat faces 11*c* and 12*c* of the main and subsidiary valve lifters 11 and 12, e.g., in the flat face 12*c* of the subsidiary valve lifter 12 in the illustrated embodiment to extend axially, so that abutting end faces of the connecting plunger 30 and the return piston 31 are received in the relief recess 34. The relief recess 34 is of a U-shape in which it opens into the upper surface of the subsidiary valve lifter 12, as shown in FIG. 27, whereby the processing or working of the relief recess 34 is facilitated, and a lubricating oil can be retained therein.

An oil passage 35 is provided in the cylinder head 1 to communicate with the hydraulic pressure chamber 27. A switchover valve (not shown) is mounted in the oil passage 35, so that it can selectively connect the oil passage 35 to a hydraulic pressure supply source such as a hydraulic pump and a lower-pressure oil reservoir.

The operation of the seventh embodiment will be described below.

In a low-speed and medium-speed operational ranges of the internal combustion engine, the hydraulic pressure chamber 27 is opened into the oil reservoir through the oil passage 35 to bring the connecting means 33 into its disconnecting state. If the disconnecting state is provided, as shown in FIG. 26, the return spring 31 retains the connecting plunger 30 with the biasing force of the return spring 32 in a position where it is in abutment against the annular step 26 of the main guide bore 24. At this time, the tip end of the connecting plunger 30 faces to the relief recess 34, and the connecting means 33 is brought into its non-connecting state in which the relative sliding movement of the valve lifters 11 and 12 is possible and thus, the valve-operating device D is brought into a low-speed mode. When the camshaft 5 is rotated in the low-speed mode, the main and subsidiary cams 15 and 16 are rotated, while being always in contact with the corresponding main and subsidiary rollers 19 and 20. Therefore, the movement corresponding to profiles of the main and subsidiary cams 15 and 16 can be provided smoothly to the main and subsidiary valve lifters 11 and 12 by the rotation of the main and subsidiary rollers 19 and 20 about the main and subsidiary roller support shafts 17 and 18. Moreover, each of upper end faces of the main and subsidiary valve lifters 11 and 12, which are not in sliding contact with the main and subsidiary cams 16, only needs to have an extent enough to ensure that the main and subsidiary roller housings 13 and 14 are opened and hence, it is possible to achieve reductions in diameters of the main and subsidiary valve lifters 11 and 12 and accordingly, a reduction in size of the valve-operating device D.

The main cam 15 provides the opening and closing motions to the valve 3 through the main valve lifter 11 by cooperation with the valve spring 22, but the subsidiary cam 16 only reciprocally moves the subsidiary valve lifter 12 uselessly with a stroke larger than that of the main valve lifter 11 by cooperation with the lifter spring 23 and does not participate in the opening and closing of the valve 3. Therefore, the opening and closing characteristic of the valve 3 in this case depends on a cam profile of the main cam 15 having the small-height lift portion 15*a*, and the low-speed and medium-speed performance of the engine can be enhanced.

The upper end of the lifter spring 23 is in abutment against lower ends of the head portions 11*a* and 12*a* of the main an subsidiary valve lifters 11 and 12 and hence, are inclined with the relative sliding movement of the valve lifters 11 and 12 due to a difference between lifts of the main and subsidiary cams 15 and 16. However, the difference between the lifts is relatively small and hence, the inclination is also slight and hence, the lifter spring 23 bears no burden.

The lifter spring 23 for biasing the main valve lifter 11 toward the subsidiary cam is supported at its stationary end, i.e., at its lower end on the cylinder head 1 and hence, a load received from the subsidiary cam 16 by the lifter spring 23 is received directly on the cylinder head 1 and does not influence on the valve 3 at all. Therefore, even if the subsidiary valve lifter 12 is reciprocally moved at a stroke larger than that of the main valve lifter 11 to flex the lifter spring 23 largely, resulting large inertia forces of the subsidiary valve lifter 12 and the lifter spring 23 cannot be applied to the valve 3. Thus, it is possible to prevent the occurrence of the jumping of the valve 3 and to suppress a useless increase in surface pressure on sliding portions and abutment portions extending from the main cam 15 to the valve 3 to prevent wears of them as much as possible, and a load of the camshaft 5 cannot be increased uselessly.

Figure 28:
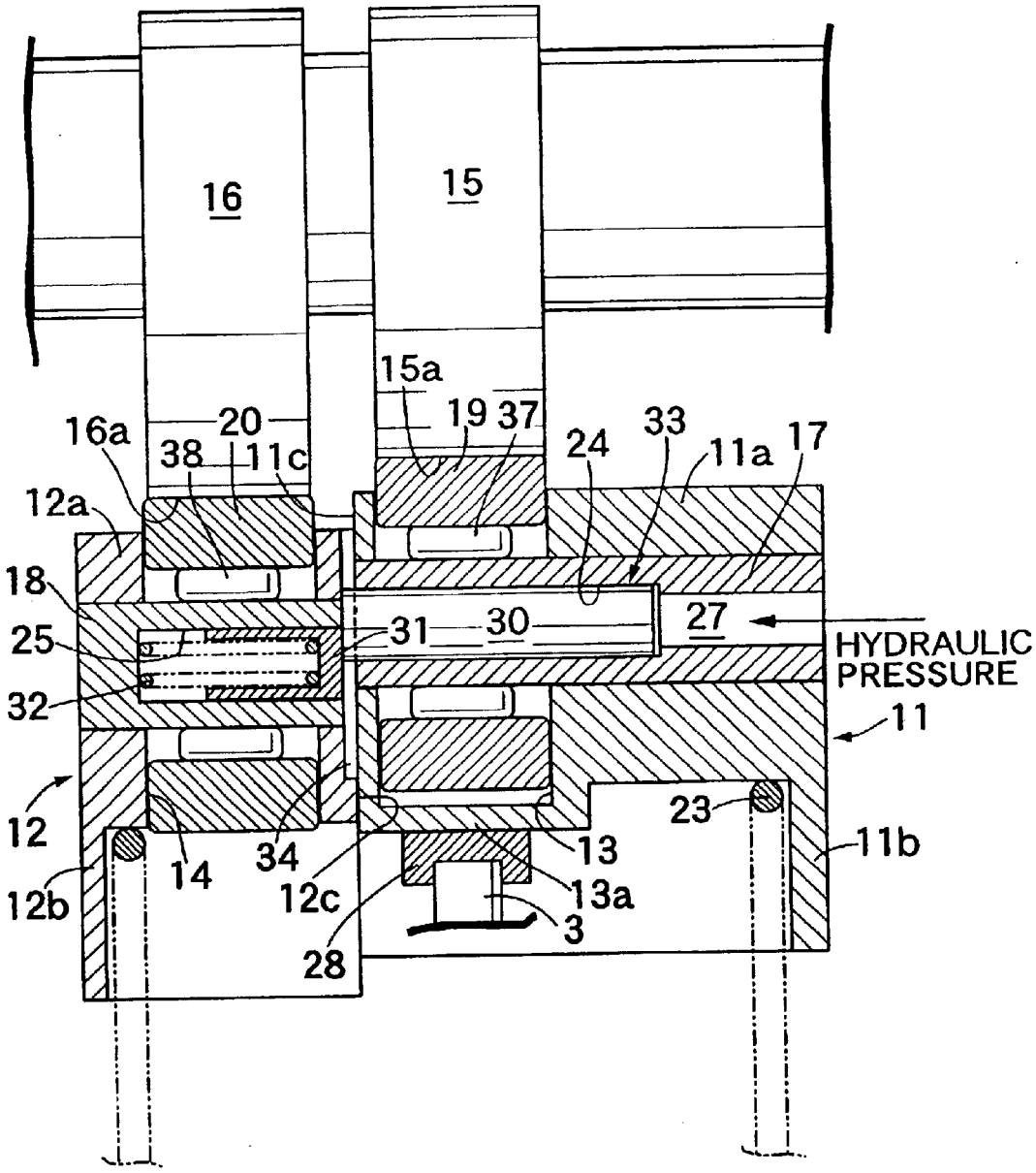
FIG. 28 is a view for explaining the operation and showing a state of preparatory to a high-speed mode.
Figure 29:
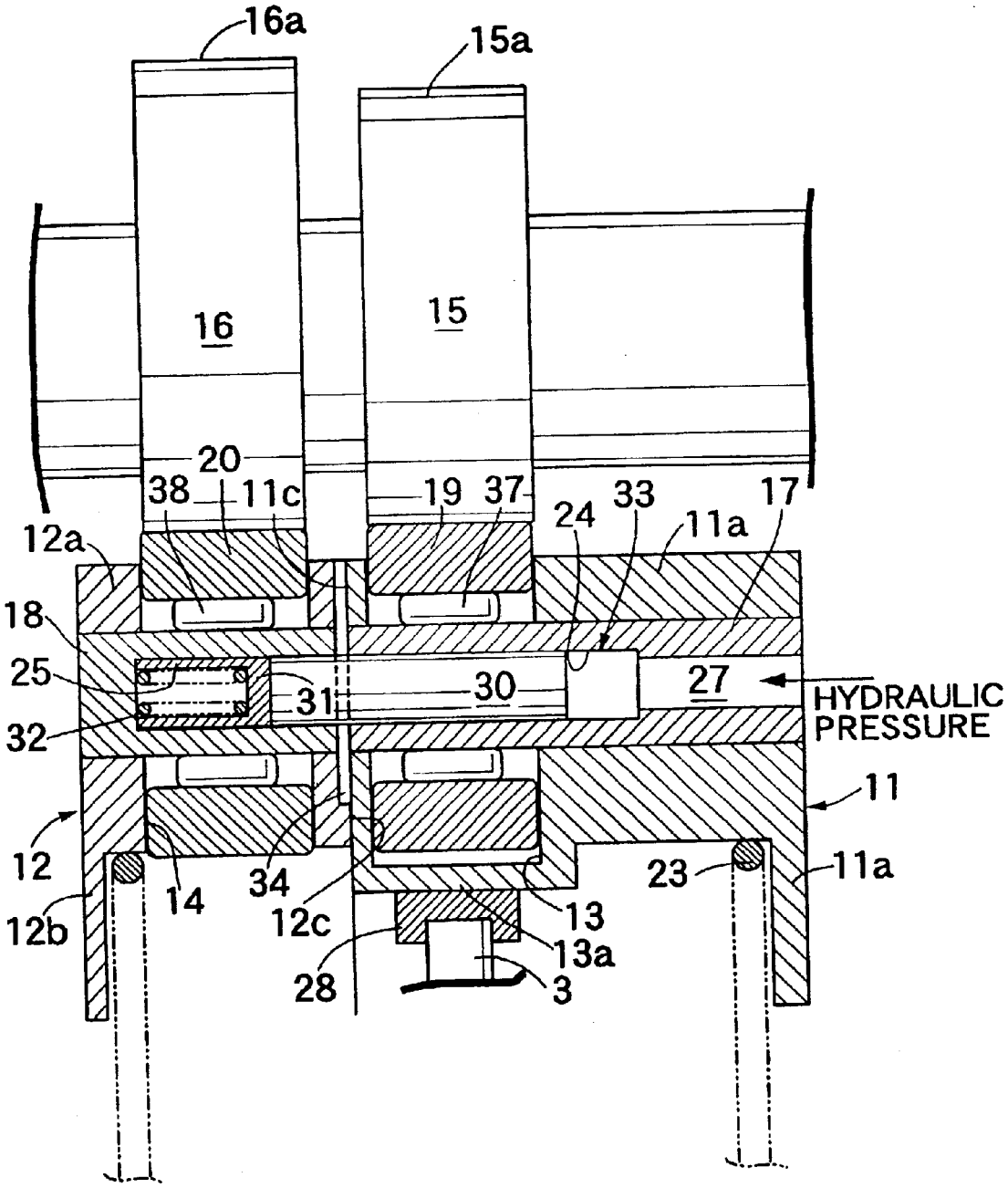
FIG. 29 is a view for explaining the operation and showing the high-speed mode.

When the engine then reaches a high-speed operational range to permit a hydraulic pressure to be supplied from the oil passage 35 to the hydraulic pressure chamber 27, the connecting plunger 30 pushes the return piston 31 by the action of the hydraulic pressure in the hydraulic pressure chamber 27 against the biasing force of the return spring 32. However, if the main and subsidiary cams 15 and 16 are in contact with the main and subsidiary rollers 19 and 20 at points other than the base circle-portions at that time, positions of the main guide bore 24 and the subsidiary guide bore 25 are staggered from each other. Therefore, the connecting plunger 30 is once stopped in a position where it is in abutment against a side face of the subsidiary valve lifter 12, i.e., a bottom surface of the relief recess 34, as shown in FIG. 28, thereby providing a switchover preparative state.

When the base circle-portions of the main and subsidiary cams 15 and 16 are brought simultaneously into contact with the main and subsidiary rollers 19 and 20 from that state, the main and subsidiary guide bores 24 and 25 are brought in line with each other. The period of contact of the base circle-portions with the main and subsidiary rollers 19 and 20 is relatively long and hence, the connecting plunger 30 urges the return piston 31 by the hydraulic pressure in the hydraulic pressure chamber 27 against the biasing force of the return spring 32, thereby putting the return spring 31 into abutment against the end wall of the main guide bore 24 (see FIG. 29). Thus, the connecting means 33 is brought into the connecting state in which the relative sliding movement of the valve lifters 11 and 12 is impossible, and the valve-operating device D is brought into a high-speed mode.

Therefore, the subsidiary cam 16 having the large-height lift portions 16*a* opens and closes the valve 3 through the valve lifters 11 and 12 by cooperation with the valve spring 22, and the smaller-height lift portion 15*a* of the main cam 15 is raced relative to the main roller 19. The opening/closing characteristic of the valve 3 in this case depends on the profile of the subsidiary cam 16 having the larger-height lift portion 16*a*, and an enhancement in high-speed performance of the engine can be provided.

In this case, the valve spring 22 and the lifter spring 23 in a parallel relation to each other exhibit repulsive forces to the valve lifters 11 and 12 in their connected states and hence, a sum total of the repulsive forces is applied to both of the valve lifters 11 and 12. Therefore, notwithstanding the valve lifters 11 and 12 have been integrated, resulting in an increased inertia mass, the inertia forces of the valve lifters 11 and 12 can be suppressed effectively, whereby the jumping of the valve 3 is prevented, and moreover, the return responsiveness of the valve lifters 11 and 12 and accordingly, the closing responsiveness of the valve 3 can be enhanced to contribute to a further enhancement in high-speed performance.

When the engine is returned again to the low-speed and medium-speed operational ranges, whereby the hydraulic pressure in the hydraulic pressure chamber 27 is released to the oil reservoir, the following is obvious: The return piston 31 pushes the connecting plunger 30 back to the original position with the repulsive force of the return spring 32 and hence, the connecting means 33 is brought into the non-connecting state in which the relative sliding movement of the main and subsidiary valve lifters 11 and 12 is possible.

The main and subsidiary valve lifters 11 and 12 are formed into arcuate shapes, so that when their flat faces 11*c* and 12*c* are mated to each other, a single cylindrical shape is formed. The main guide bore 24 is provided in the main valve lifter 11 to open into the flat face 11*c*, so that the connecting plunger 30 is received in the main guide bore 24, and the subsidiary guide bore 25 is provided in the subsidiary valve lifter 12 to open into the flat faces 12*c*, so that the return piston 31 is received in the subsidiary guide bore 25. Therefore, it is possible to perform the prevention of the relative rotation of the main and subsidiary valve lifters 11 and 12 without chattering by the abutment of the wide flat faces 11*c* and 12*c* against each other and hence, even if a special positioning means is not provided, the main and subsidiary guide bores 24 and 25 can be brought easily and properly in line with each other. Moreover, the two members: the connecting plunger 30 and the return piston 31 suffice as sliding members used in the connecting means 33 and hence, it is possible to provide a remarkable reduction in number of parts.

In addition, the main valve lifter 11 is formed into a major arc shape, and the relatively long main guide bore 24 supporting the connecting plunger 30 therein is provided in the relatively long main roller support shaft 17 secured to the main valve lifter 11. Therefore, a long support span of the connecting plunger 30 can be ensured and hence, in the connecting state of the connecting means 33, the falling of the connecting plunger 30 can be suppressed to the minimum and hence, a good state in which the valve lifter 11 and 12 have been connected to each other can be provided. Moreover, the compactness of the main and subsidiary valve lifter 11 and 12 can be achieved by the concentric disposition of the main roller support shaft 17 and the connecting plunger 30 as well as the concentric disposition of the main roller support shaft 17 and the return piston 31.

An eighth embodiment of the present invention shown in FIGS. 30 and 31 will be described below.

The eighth embodiment of the present invention is applied to a four-valve and twin-camshaft type internal combustion engine. Only a valve-operating device D on the side of intake valves 3, 3 will be described below.

Two sets of main and subsidiary valve lifters 11, 12; 11, 12 are mounted in correspondence to a pair of intake valves 3, 3. In this case, each of flat faces 36, 36 is formed on one-side of an outer peripheral surface of each of the main valve lifters 11, 11 in each set, and the two sets of main and subsidiary valve lifters 11, 12; 11, 12 are mounted adjacent to each other in such a manner that the flat faces 36, 36 are in abutment against each other. A pair of lifter guide bores 8, 8 are provided in the cylinder head 1 to receive the two sets of main and subsidiary valve lifters 11, 12; 11, 12 therein for sliding movement, and disposed in a partially overlapped relation. The flat faces 36, 36 are disposed at a border between the lifter guide bores 8, 8.

With such arrangement, the disposition of the two sets of main and subsidiary valve lifters 11, 12; 11, 12 in proximity to each other, in other words, the disposition of the pair of valves 3, 3 in proximity to each other is possible to achieve the compactness of the engine. Moreover, the adjoining main valve lifters 11, 11 restrict the rotation relative to each other by the abutment of the flat faces 36, 36 against each other and hence, it is unnecessary to insert a detent key into between the main and subsidiary valve lifters 11 and 12 in each pair and the lifter guide bore 8, which can contribute to the simplification of the arrangement.

An oil passage 35 connected to hydraulic pressure chambers 27, 27 in the adjoining main valve lifters 11, 11 is provided as common one. This enables the oil passage 35 in the entire valve-operating device D to be simplified.

Figure 30:
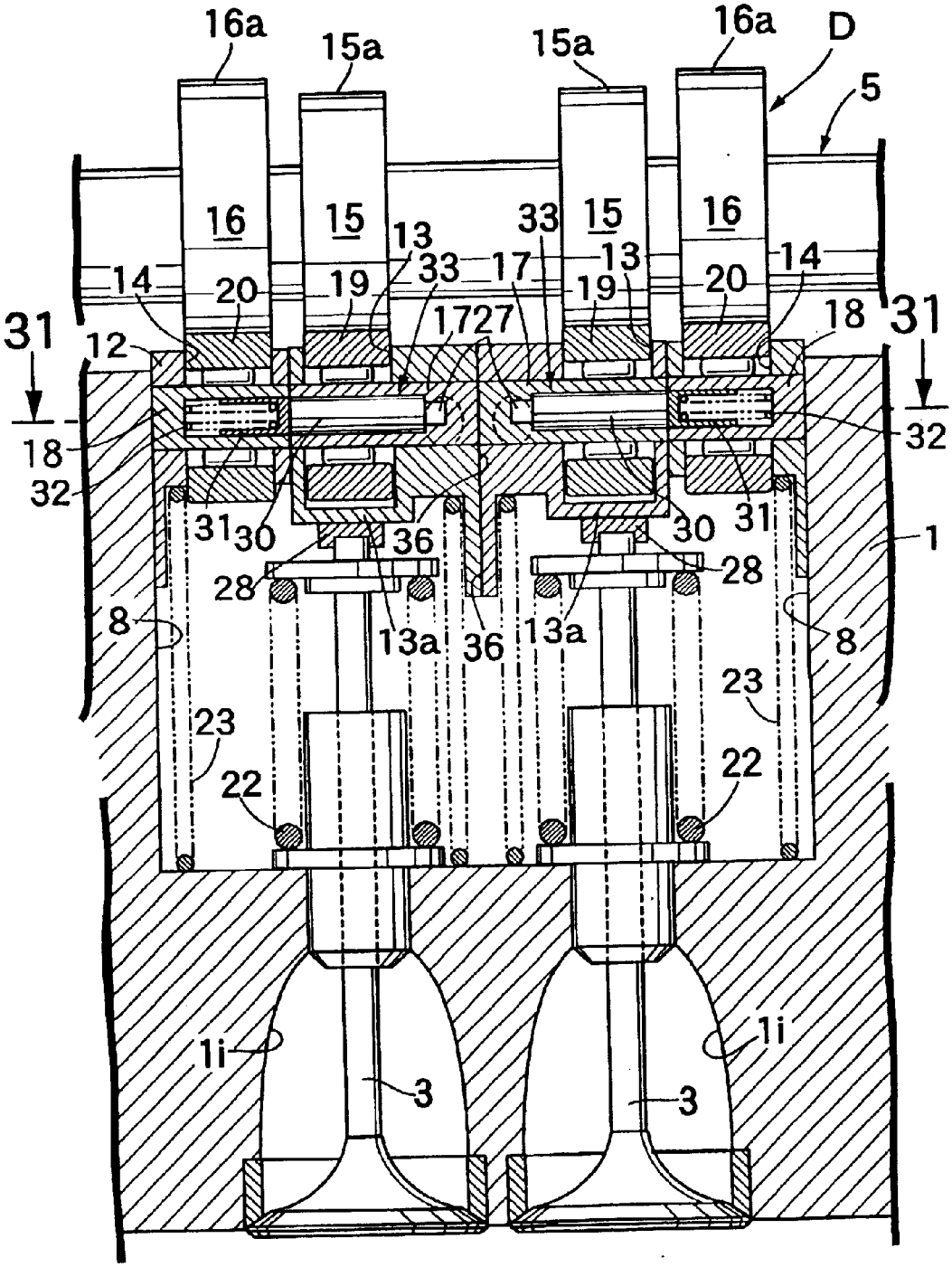
FIG. 30 is a vertical sectional view of a valve-operating system for a four-valve and twin-camshaft type internal combustion engine according to an eighth embodiment of the present invention.
Figure 31:
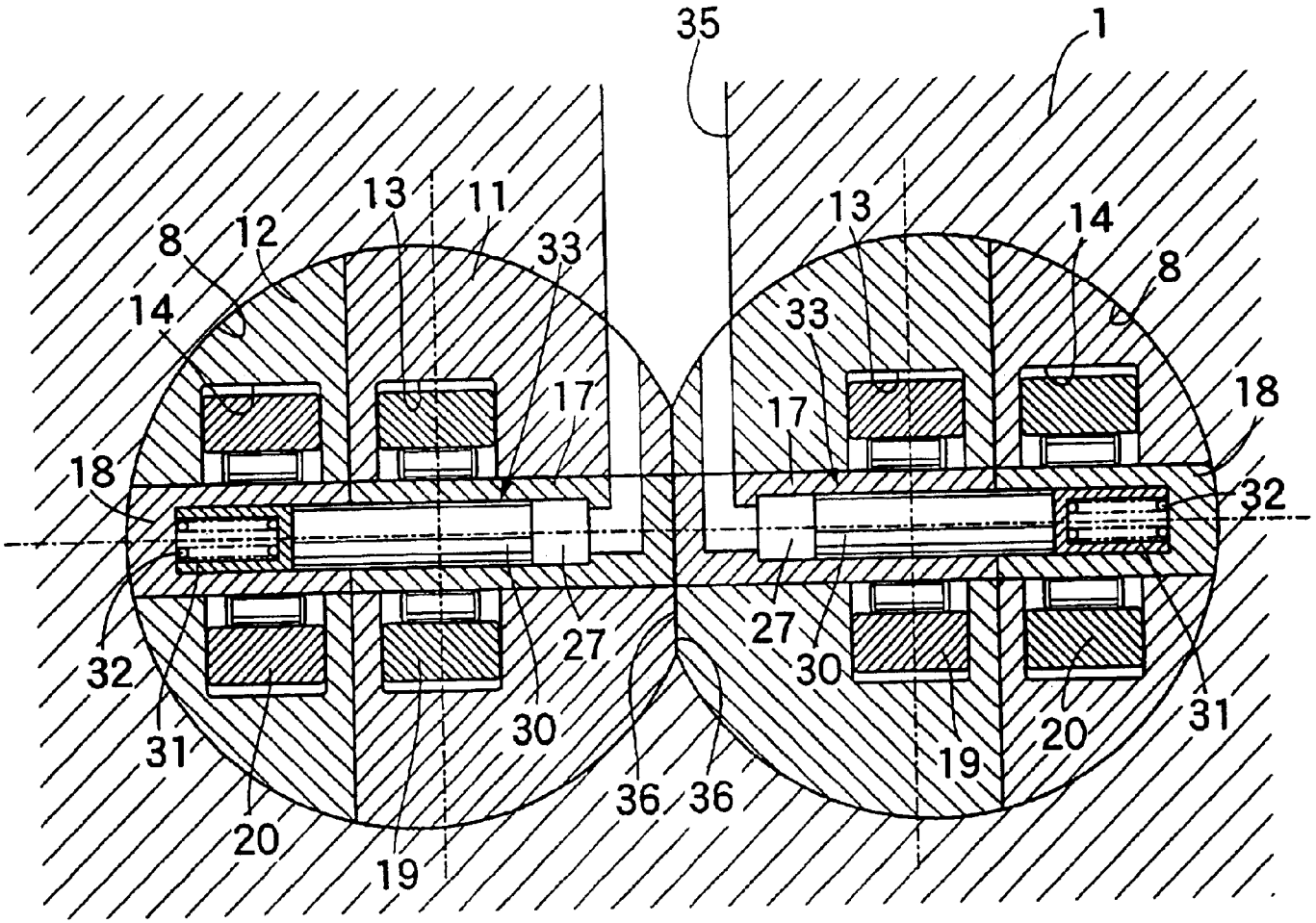
FIG. 31 is a sectional view taken along a line 31—31 in FIG. 30.

The other constructions are the same as in the first embodiment and hence, portions or components corresponding to those in the seventh embodiment are designated by like reference characters in FIGS. 30 and 31, and the description of them is omitted.

A ninth embodiment of the present invention shown in FIGS. 32 and 33 will be described below.

In the ninth embodiment of the present invention, left one 3' of a pair of left and right intake valves 3' and 3 is stopped in a low-speed operational range of the engine. In order to ensure that the left intake valve 3' can be stopped, a left main cam 15' has substantially no lift portion. However, in order to avoid the residence of a fuel in the corresponding intake port 1*i*' during stoppage of the intake valve 3', a extremely small-height lift portion may be formed on the main cam 15' during the intake stroke of the engine, so that the intake valve 3' can be opened at a very small opening degree. A hydraulic pressure is supplied individually to left and right hydraulic pressure chambers 27' and 27 through a pair of oil passages 35' and 35, respectively.

Figure 32:
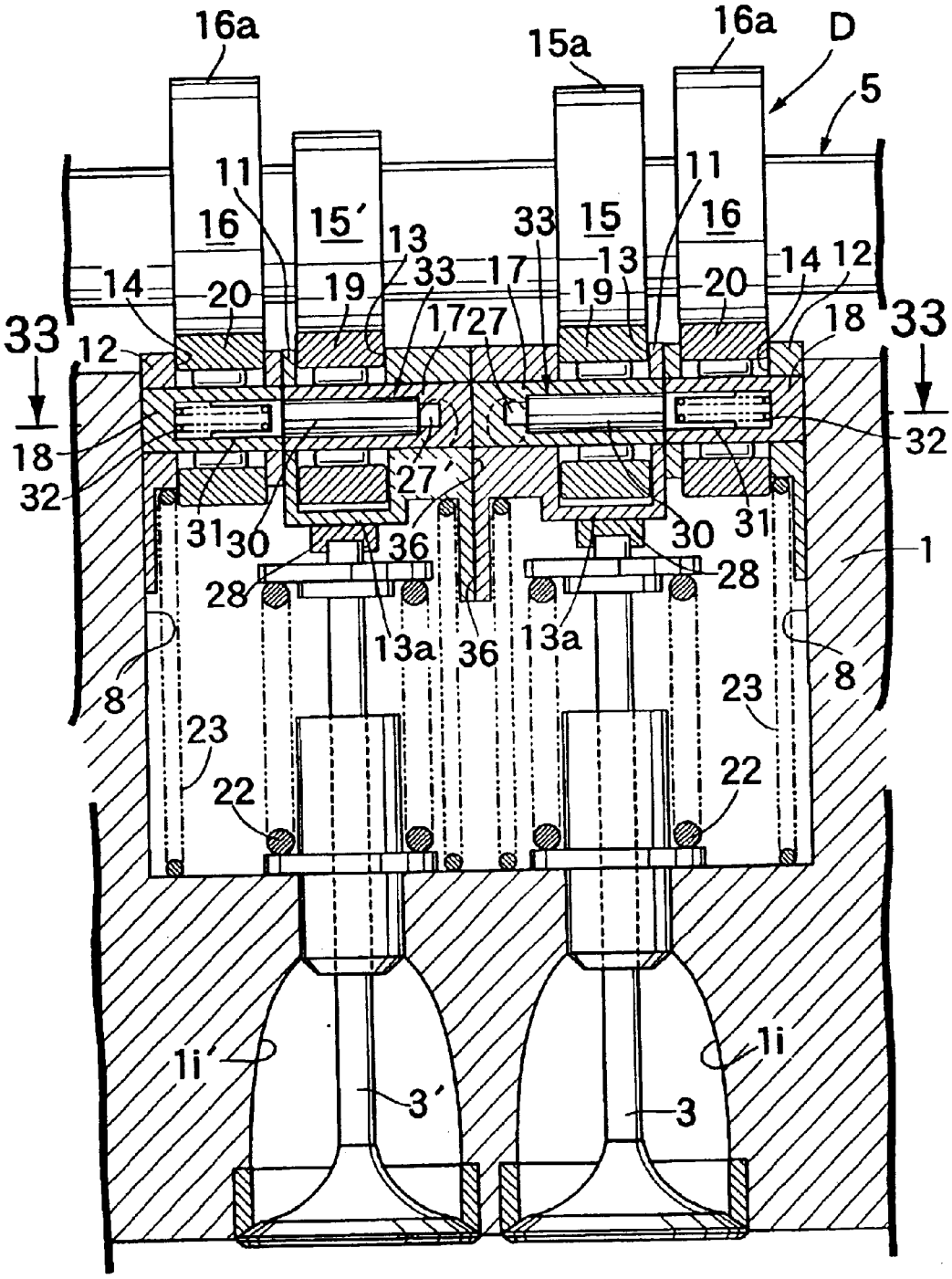
FIG. 32 is a sectional view similar to FIG. 30, but showing a ninth embodiment of the present invention.
Figure 33:
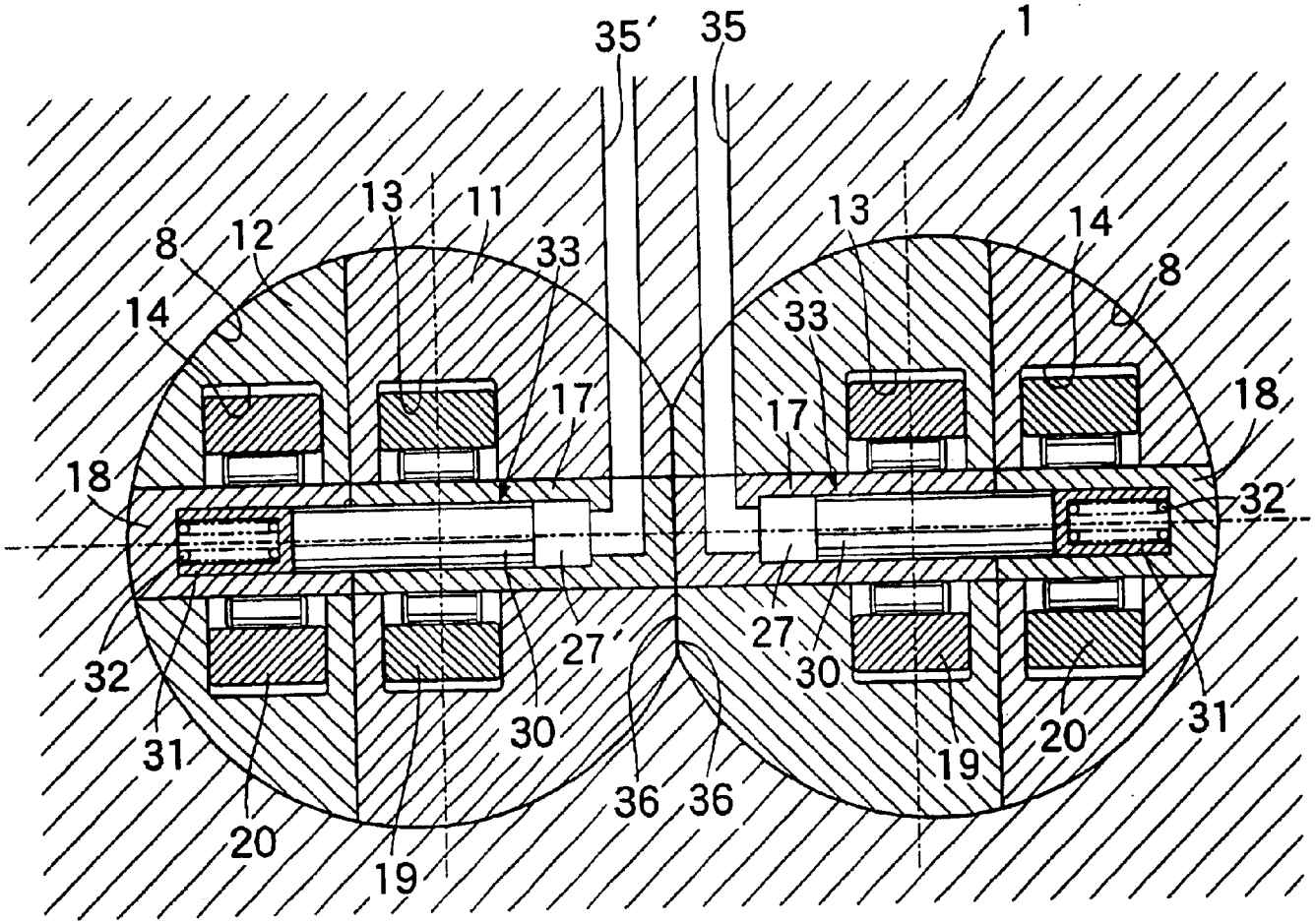
FIG. 33 is a sectional view taken along a line 33—33 in FIG. 32.

The other constructions are the same as in the eighth embodiment and hence, portions or components corresponding to those in the second embodiment are designated by like reference characters in FIGS. 32 and 33, and the description of them is omitted.

Thus, in a low-speed operational range of the engine, the left and right hydraulic pressure chambers 27' and 27 are opened into oil reservoirs through the pair of oil passages 35' and 35, respectively, thereby bringing left and right connecting means 33, 33 into their disconnecting states. Therefore, the main and subsidiary valve lifters 11 and 12 corresponding to the left and right intake valves 3' and 3 are operable individually and hence, the main valve lifter 11 in sliding contact with the main cam 15' having no lift portion is not substantially operated, and the intake valve 3' is retained in its stopped state in which it has been closed by the corresponding valve spring 22. On the other hand, the right main cam 15 having the lift portion 15*a* opens the intake valve 3 through the corresponding main valve lifter 11 in an intake stroke of the engine, as in each of the previously described embodiments. Therefore, air is drawn into the cylinder bore along with the fuel through only the right intake port 1*i*, where a swirl is produced to improve the mixing of the air and the fuel, thereby enabling the burning of a lean air-fuel mixture to contribute to a reduction in fuel consumption.

When the engine is brought into a medium-speed operational range, a hydraulic pressure is supplied only to the right hydraulic pressure chamber 27 through the oil passage 35, whereby only the right connecting means 33 is brought into its connecting state. Therefore, the right intake valve 3 is opened largely in the intake stroke of the engine through the right main and subsidiary valve lifters 11 and 12 by the large-height lift portion 16*a* of the right subsidiary cam 16 and hence, the amount of air-fuel mixture drawn can be increased, leading to an enhancement in medium-speed output performance of the engine.

When the engine reaches a high-speed operational range, the hydraulic pressure is supplied from the oil passages 35' and 35 to both of the left and right hydraulic pressure chambers 27' and 27 to bring both of the connecting means 33, 33 into their connecting states, thereby connecting the main and subsidiary valve lifters 11 and 12 in each pair to each other. Therefore, both of the intake valves 3' and 3 are opened largely in the intake stroke of the engine by the large-height lift portions 16*a*, 16*a* of the left and right subsidiary cams 16, 16 through the corresponding valve lifters 11, 12; 11, 12 and hence, a large amount of the air-fuel mixture can be drawn, leading to an enhancement in high-speed output performance of the engine.

A tenth embodiment of the present invention shown in FIGS. 34 and 35 will be described below.

In the tenth embodiment, a roller 20 is mounted on a subsidiary valve lifter 12 of a minor arc shape having a narrow upper end face through a roller support shaft 18, but a slipper face 11*s* is formed on a wide upper end face of a main valve lifter 11 of a major arc shape, so that a main cam 15 is in direct sliding contact with the slipper face 11*s*. Therefore, it is not required that the main valve lifter 11 should have a roller support shaft and hence, a main guide bore 24 with a connecting plunger 30 received therein is formed directly in the main valve lifter 11.

In the main and subsidiary valve lifters 11 and 12, their flat faces 11*c* and 12*c* abutting against each other for sliding movement are disposed to extend perpendicularly to an axis of a camshaft 5. Therefore, the slipper face 11*s* of the main valve lifter 12 can be formed long in a direction of rotation of the main cam 15, utilizing its maximum diameter effectively. Moreover, the lift portion 15*a* of the corresponding main cam 15 is relatively low in height and hence, the entire peripheral surface of the main cam 15 is reliably brought into sliding contact with the slipper face 11*s*, whereby the movement corresponding to a cam profile can be provided to the main valve lifter 11, i.e., to the intake valve 3. A band-shaped region A where the main cam 15 is brought into sliding contact with the slipper face 11*s* by the rotation thereof is shown by oblique lines in FIG. 35.

Thus, it is possible to provide a reduction in number of parts and a reduction in cost to an extent corresponding to that a main roller 19 as described in the first embodiment is not mounted on the main valve lifter 11. On the other hand, the subsidiary valve lifter 12 can smoothly receives the movement corresponding to a profile of a subsidiary cam 16 by mounting of the roller 20 thereon, even if the length of an upper end face of the subsidiary valve lifter 12 in a direction of rotation of the subsidiary cam 16 is short.

Figure 34:
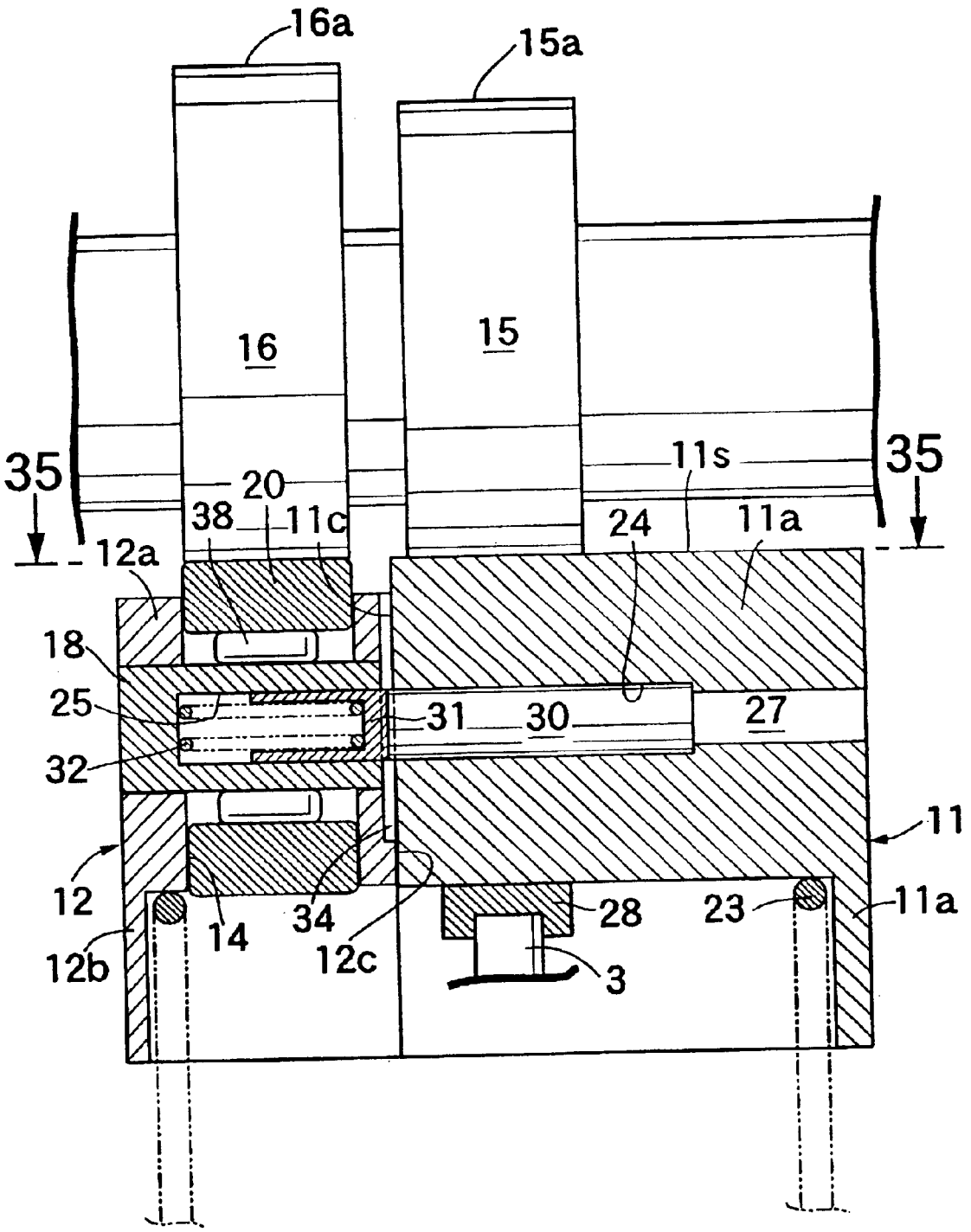
FIG. 34 is a sectional view similar to FIG. 26, but showing a tenth embodiment of the present invention.
Figure 35:
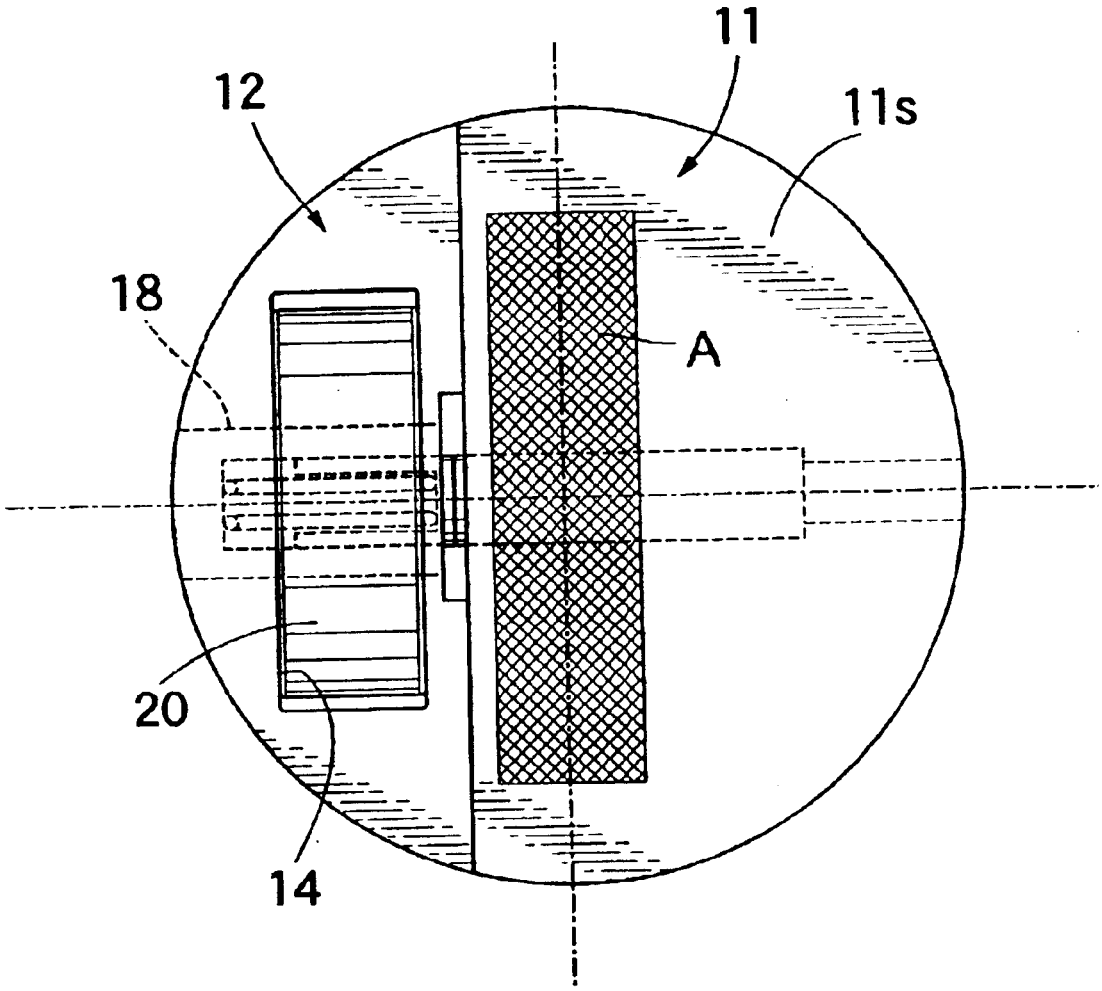
FIG. 35 is a view taken along a line 35—35 in FIG. 34.

The other constructions are the same as each of the previous embodiments and hence, portions or components corresponding to those in the seventh embodiment are designated by like reference characters in FIGS. 34 and 35, and the description of them is omitted.

An eleventh embodiment of the present invention shown in FIGS. 36 to 42 will be described below.

Figure 36:
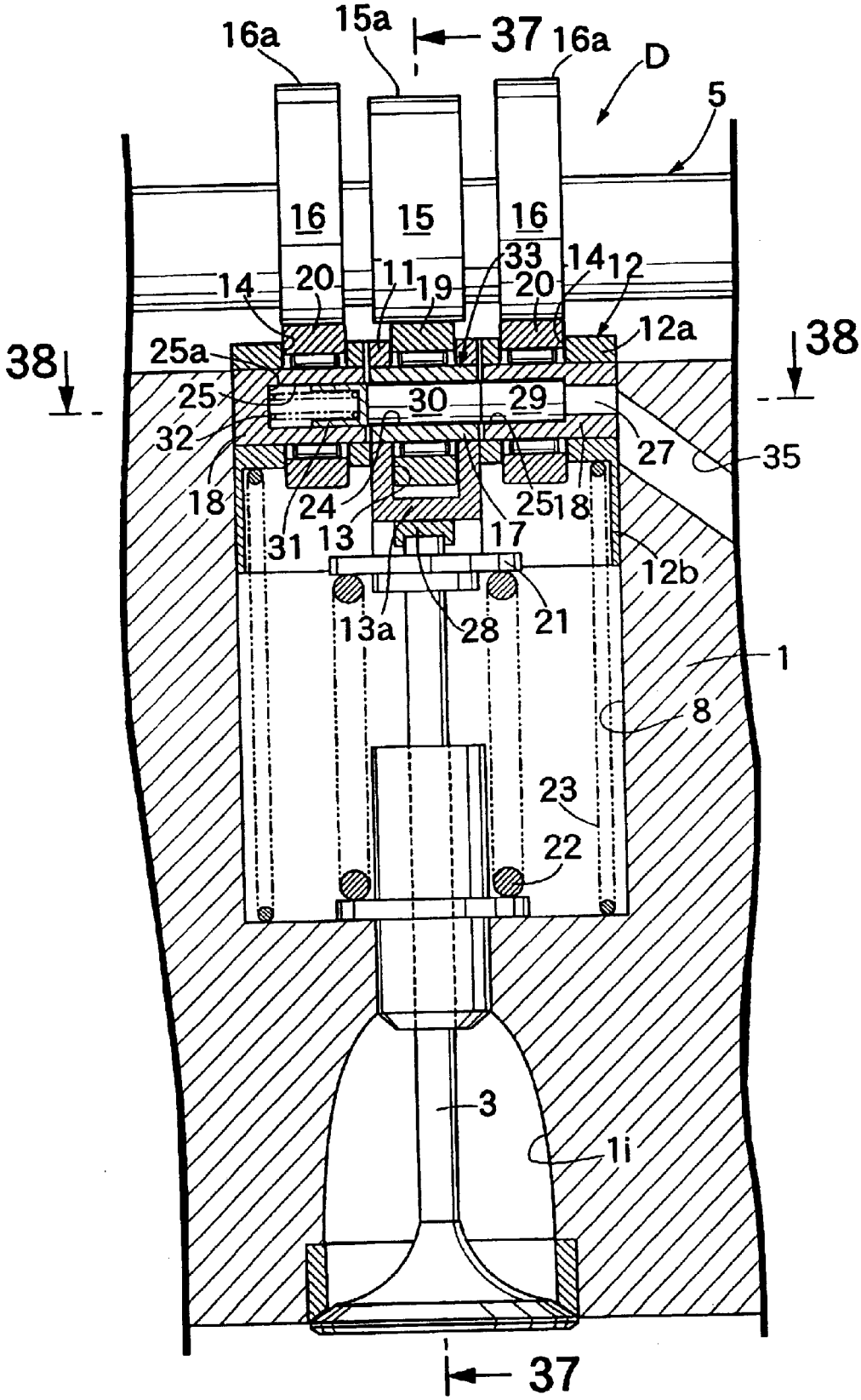
FIG. 36 is a vertical sectional view similar to FIG. 23, but showing an eleventh embodiment of the present invention.
Figure 37:
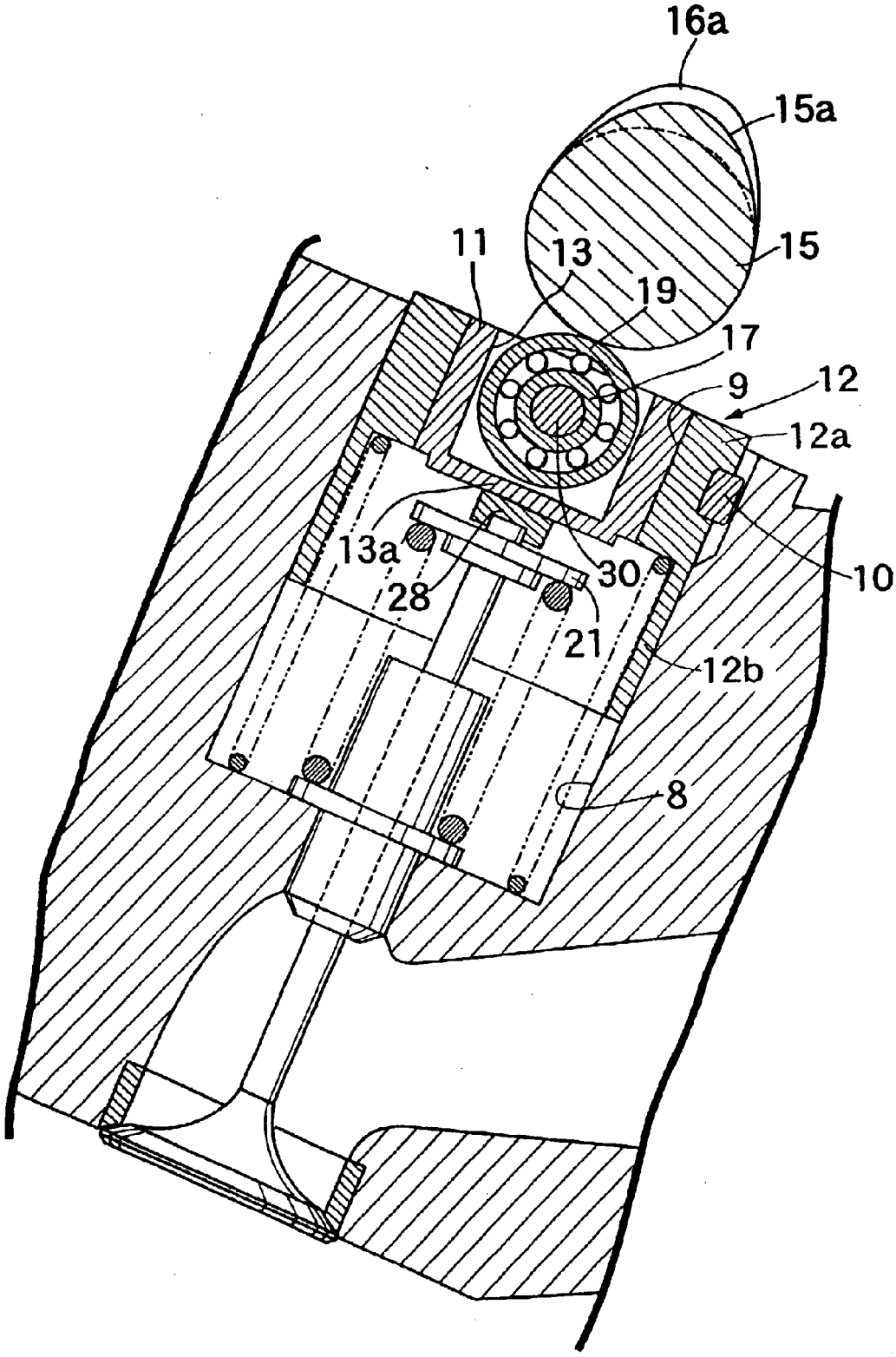
FIG. 37 is a sectional view taken along a line 37—37 in FIG. 36.
Figure 38:
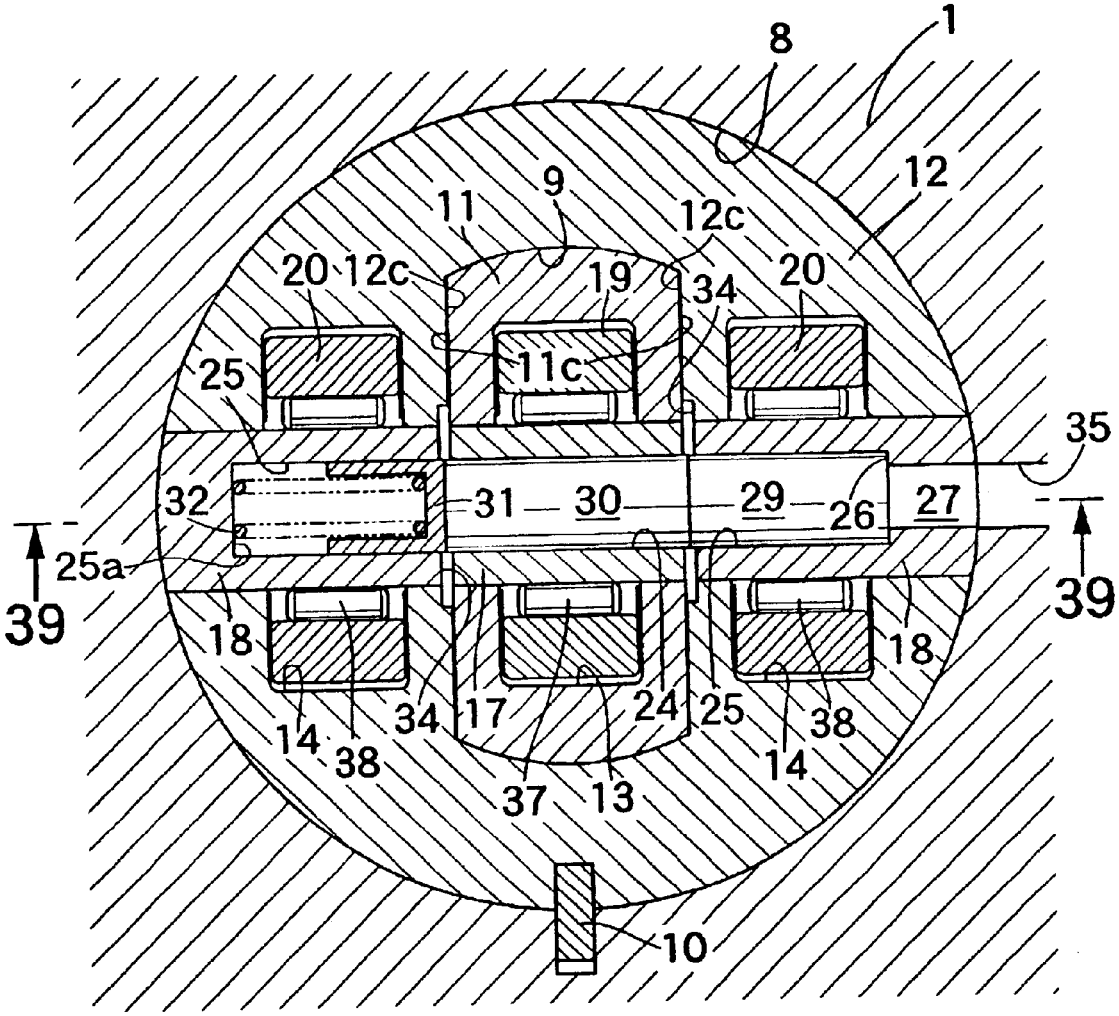
FIG. 38 is an enlarged sectional view taken along a line 38—38 in FIG. 37.

Referring to FIGS. 36 to 38, a valve-operating device D includes an oval-shaped main valve lifter 11 having a pair of opposed flat faces 11*c*, 11*c*, and a hollow cylindrical subsidiary valve lifter 12 surrounding the main valve lifter 11. The subsidiary valve lifter 12 is slidably received in a circular lifter guide bore 8 provided in a cylinder head 1.

The subsidiary valve lifter 12 comprises a thicker head portion 12*a*, and a thinner cylindrical skirt portion 12*b* extending downwards from an outer periphery of the head portion 12*a*. The main valve lifter 11 is slidably received in an oval-shaped hollow 9 provided at the center of the head portion 12*a*. Therefore, the hollow 9 has a pair of flat faces 12*c*, 12*c* which are put slidably into abutment against the flat faces 11*c*, 11*c* of the main valve lifter 11. The subsidiary valve lifter 12 is positioned by the key 10, so that the flat faces 12*c*, 12*c* are substantially perpendicular to an axis of a camshaft 5.

The main valve lifter 11 is provided with a main roller housing 13, and the head portion 12*a* of the subsidiary valve lifter 12 is provided with a pair of subsidiary roller housings 14, 14 arranged with the main valve lifter 11 sandwiched therebetween. A main roller 19 is accommodated in the main roller housing 13, and subsidiary rollers 20, 20 are accommodated in the subsidiary roller housings 14, 14, respectively. The main roller 19 is rotatably carried on a main roller support shaft 17 press-fitted in the main valve lifter 11 with a needle bearing 37 interposed therebetween, and the subsidiary rollers 20, 20 are carried on a pair of subsidiary roller support shafts 18, 18 press-fitted in the subsidiary valve lifter 12 with a pair of needle bearings 38, 38 interposed therebetween. In this case, the main and subsidiary roller support shafts 17, 18, 18 are disposed in parallel to the axis of the camshaft 5.

On the other hand, the camshaft 5 is formed with a main cam 15 which is in contact with an upper surface of the main roller 19, and a pair of subsidiary cams 16, 16 of the same shape, which are in contact with upper surfaces of the subsidiary rollers 20, 20, respectively. There is no difference of height between base circle-portions of the main and subsidiary cams 15, 16, 16, but a lift portion 16*a* of each of the subsidiary cams 16 is formed higher in level than a lift portion 15*a* of the main cam 15. In order to avoid the interference of the main and subsidiary cams 15, 16, 16 and upper end faces of the main and subsidiary valve lifters 11 and 12, the main and subsidiary rollers 19 and 20 are disposed so that their upper surfaces protrude at a predetermined height from the upper end faces the main and subsidiary valve lifters 11 and 12. Each of the subsidiary roller housings 14 has a bottom surface opened so that a lower surface of each of the subsidiary rollers 20 is exposed, in order to reduce the weight of the head portion 12*a* of the subsidiary valve lifter 12 to the utmost, but the main roller housing 13 is provided with a bottom wall 13*a* which covers a lower surface of the main roller 19, and a stem head of the intake valve 3 disposed at the center of the lifter guide bore 8 is in abutment against a lower surface of the bottom wall 13*a* through a shim 28. A coiled valve spring 22 is mounted between a flange-shaped retainer 21 fixed to a stem of the intake valve 3 and the cylinder head 1 for biasing the intake valve 3 in a closing direction, i.e., toward the main cam 15. A lifter spring 23 for biasing the valve lifter 12 toward the subsidiary cams 16 is mounted between the head portion 12*a* of the subsidiary valve lifter 12 and the cylinder head 1 in proximity to an inner surface of the skirt portion 12*b*.

As shown in FIGS. 37 and 38, the main and subsidiary roller support shafts 17, 18, 18 are provided with main and subsidiary guide bores 24, 25, 25 having the same diameter and extending along a diametrical line perpendicularly to the flat faces 11*c*, 12*c*. The main and subsidiary guide bores 24, 25, 25 are defined so that they are brought in line with one another, when the base circle-portions of the main and subsidiary cams 15, 16, 16 are brought simultaneously into contact with the main and subsidiary rollers 19, 20, 20. A hydraulic pressure chamber 27 is connected to an outer end of one of the subsidiary guide bore 25 through an annular step 26, and an outer end of the other subsidiary guide bore 25 is closed by an end wall 25*a*.

A connecting plunger 30 is slidably received in the main guide bore 24. An urging piston 29 is slidably received in the subsidiary guide bore 25 on the side of the hydraulic pressure chamber 27, and a return piston 31 is slidably received in the subsidiary guide bore 25 on the opposite side. A return spring 32 for biasing the return piston 31 toward the hydraulic pressure chamber 27 is accommodated between the end wall 25*a* and the return piston 31. When both of the pistons 29 and 31 and the plunger 30 are moved all at once toward the hydraulic pressure chamber 27, whereby the urging piston 29 is put into abutment against the annular step 26, both of the pistons 29 and 31 and the plunger 30 occupy non-connecting positions where the relative sliding movement of the main and subsidiary valve lifters 11 and 12 is not obstructed. When both of the pistons 29 and 31 and the plunger 30 are moved all at once toward the end wall 25*a*, whereby the return piston 31 is put into abutment against the end wall 25*a* of the corresponding subsidiary guide bore 25, the connecting plunger 30 and the urging piston 29 occupy connecting positions where they cross a border between the main and subsidiary valve lifters 11 and 12 to connect the main and subsidiary valve lifters 11 and 12 to each other.

Figure 39:
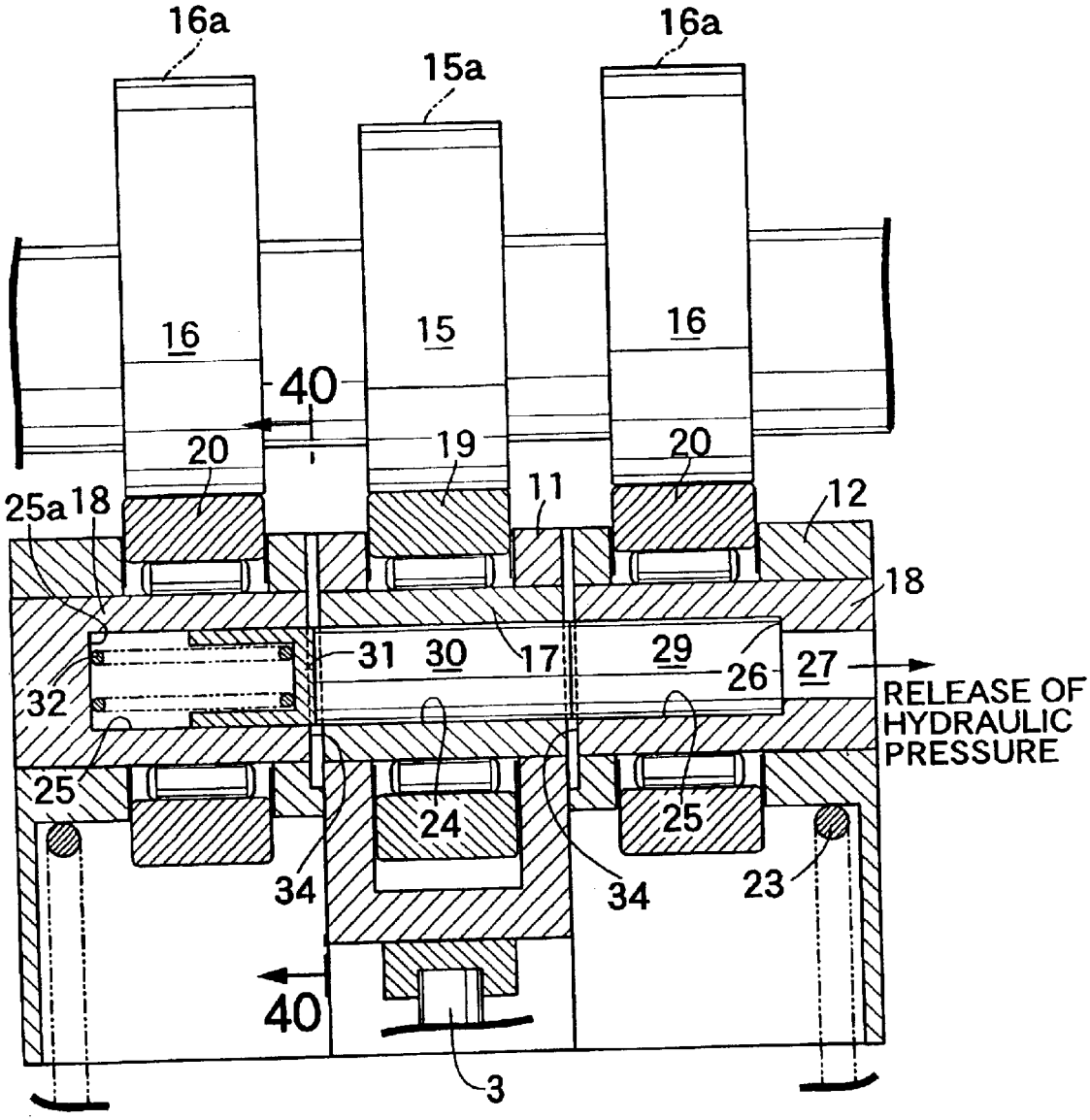
FIG. 39 is a sectional view taken along a line 38—38 in FIG. 38 (showing a low-speed mode)
Figure 40:
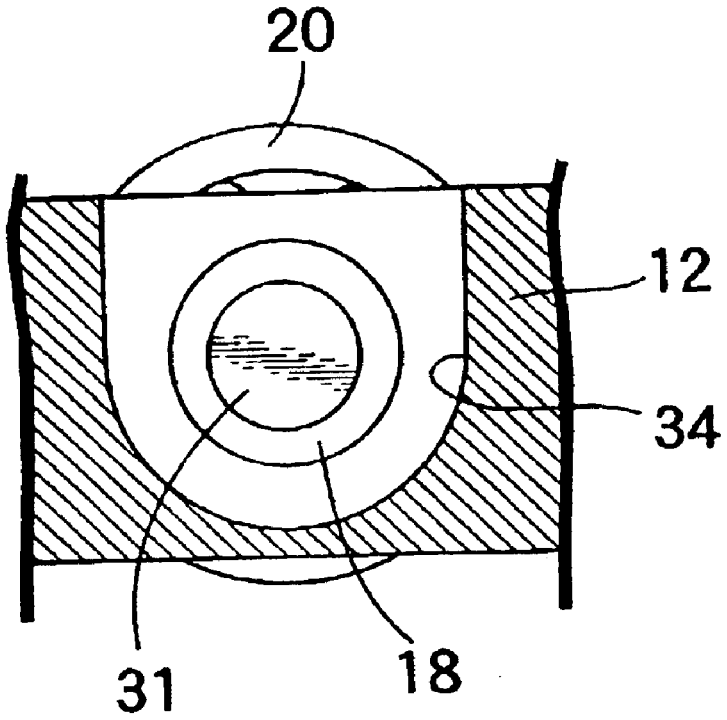
FIG. 40 is a sectional view taken along a line 40—40 in FIG. 39.

As shown in FIGS. 38 and 39, the connecting plunger 30 is formed slightly longer than the width of the main valve lifter 11 in an axial direction of the plunger 30 with a processing error in view. In order to avoid the interference of opposite ends of the connecting plunger 30 and the subsidiary valve lifter 12 in the non-connecting position of the connecting plunger 30, the flat faces 12*c*, 12 of the subsidiary valve lifter 12 are provided with a pair of relief recesses 34 (see FIG. 40) which receive the opposite ends of the connecting plunger 30.

From the forgoing, the connecting plunger 30, the urging piston 29, the return piston 31 and the return spring 32 form a connecting means 33 by cooperation with one another.

The other constructions are the same as those in the seventh embodiment and hence, portions or components corresponding to those in the seventh embodiment are designated by like reference characters, and the description of them is omitted.

Thus, when the hydraulic pressure chamber 27 is opened into an oil reservoir through the oil passage 35 in low-speed and medium-speed operational ranges of the internal combustion engine, the urging piston 29 is retained by the urging force of the return spring 32 at a location of abutment against the annular step 26 of the subsidiary guide bore 25 on the side of the hydraulic pressure chamber 27, and the connecting plunger 30 has their opposite ends facing to the relief recesses 34, 34, as shown in FIG. 39, whereby the connecting means 33 is brought into a non-connecting state in which the relative sliding movement of the valve lifters 11 and 12 is possible, and the valve-operating device D is brought into a low-speed mode.

Therefore, when the camshaft 5 is rotated, the main cam 15 causes the opening and closing motions of the intake valve 3 through the main valve lifter 11 by cooperation with the valve spring 22, but the subsidiary cam 16 only reciprocally moves the subsidiary valve lifter 12 uselessly with a stroke larger than that of the main valve lifter by cooperation with the lifter spring 23 and does not participate in the opening and closing of the intake valve 3.

Figure 41:
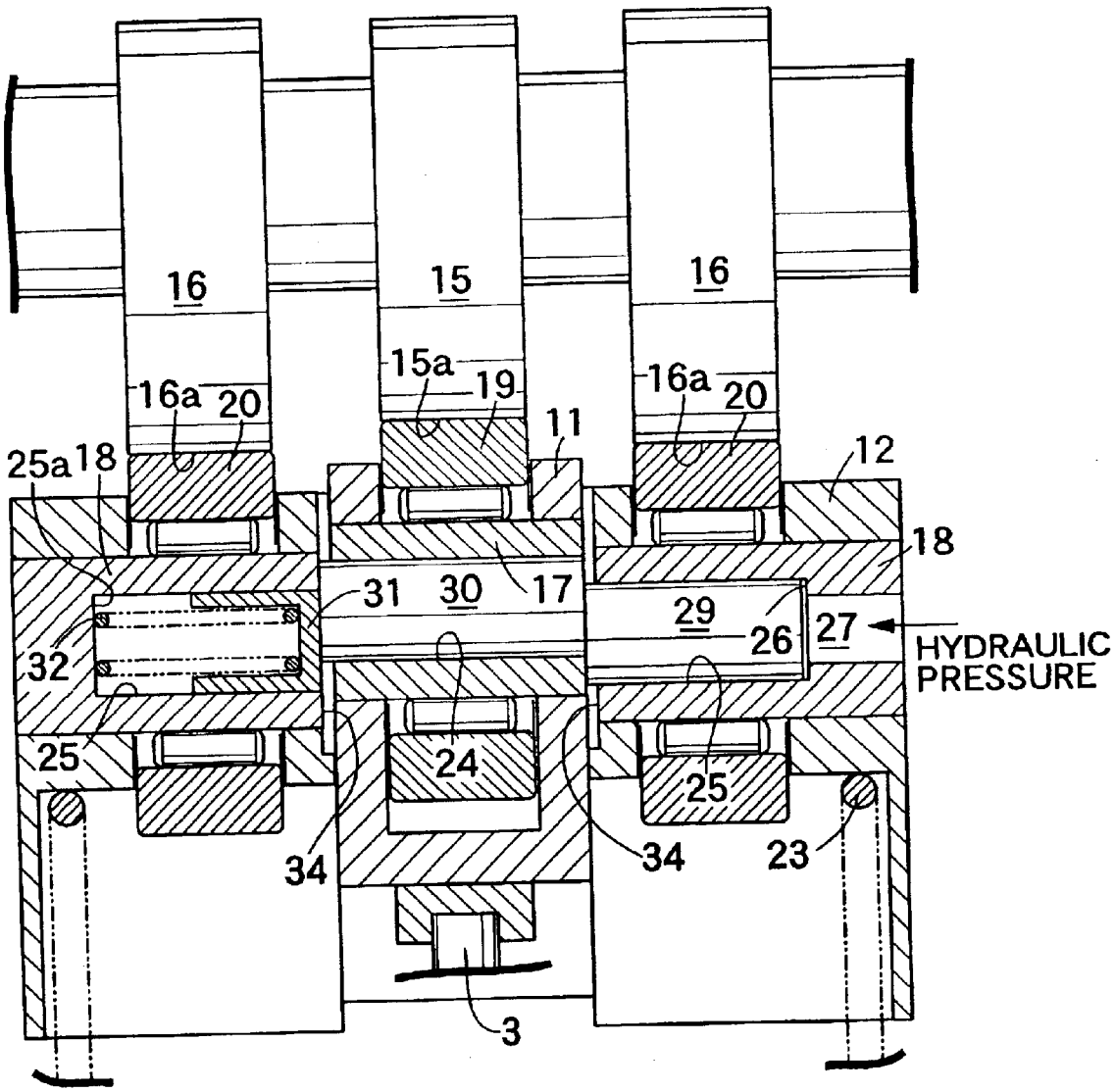
FIG. 41 is a view for explaining the operation and showing a state of preparatory to a higher-speed mode.
Figure 42:
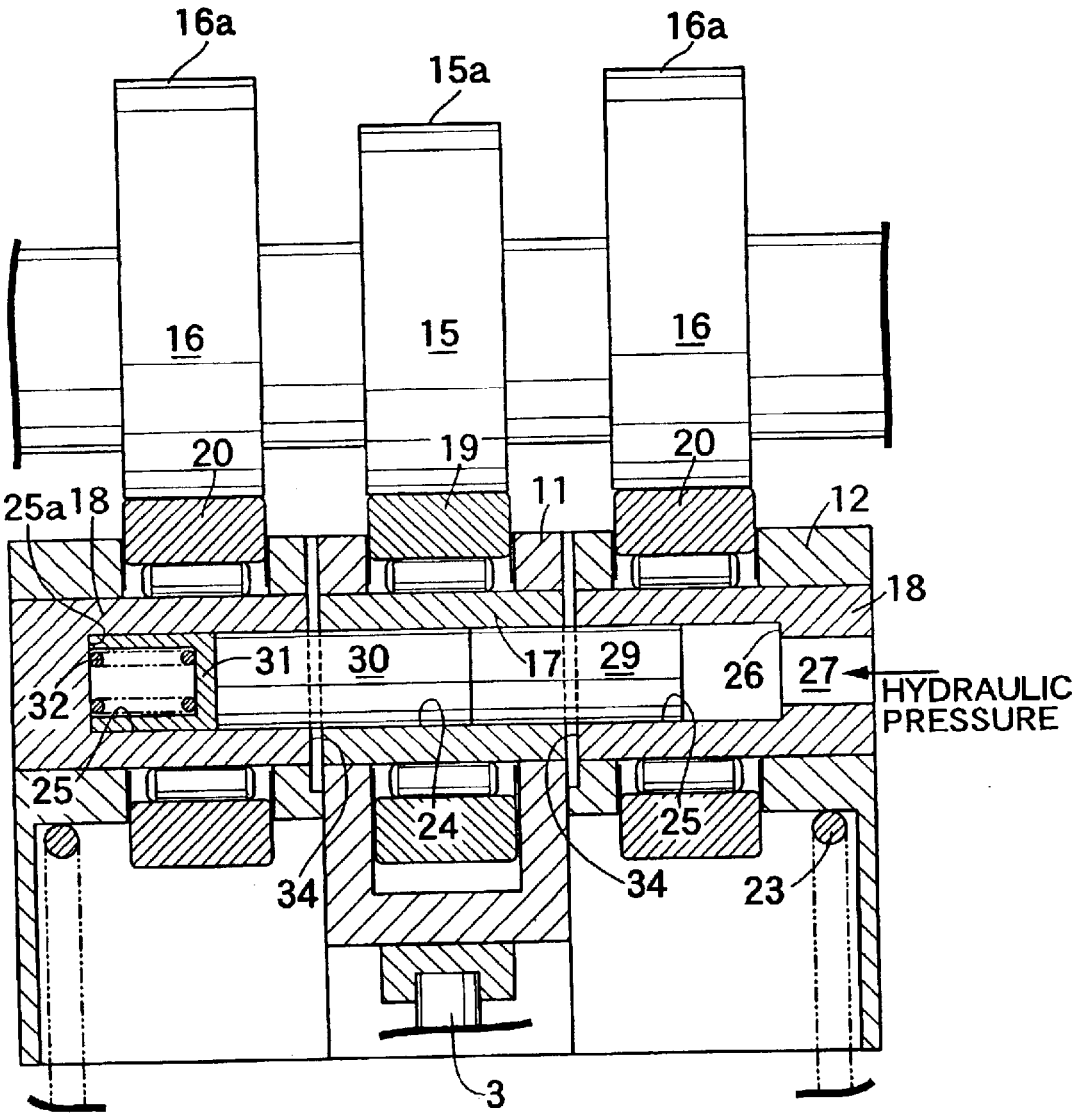
FIG. 42 is a view for explaining the operation and showing the high-speed mode.
Figure 43:
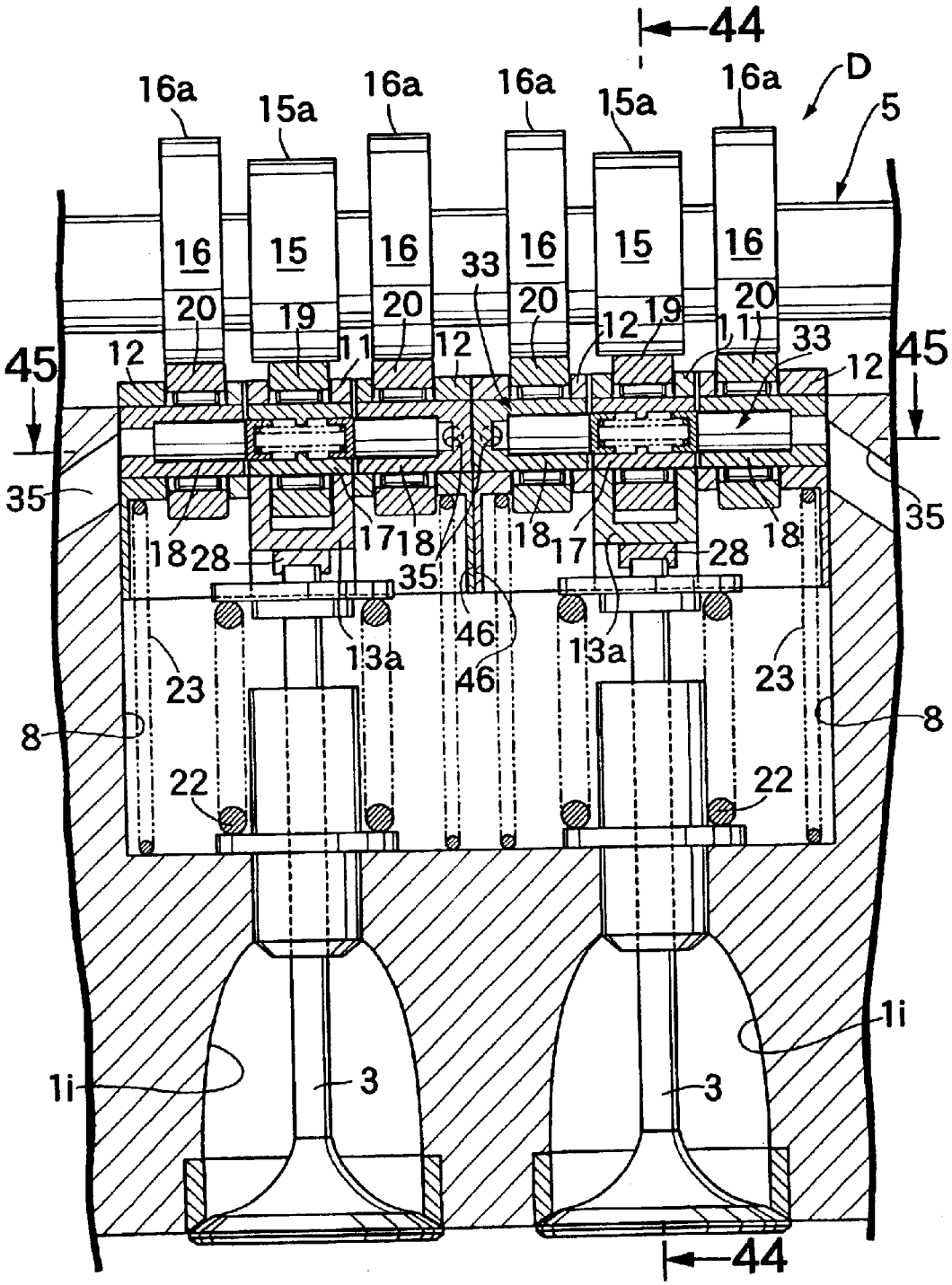
FIG. 43 is a vertical sectional plan view of a valve-operating system for a four-valve and single-camshaft type internal combustion engine according to a twelfth embodiment of the present invention.
Figure 44:
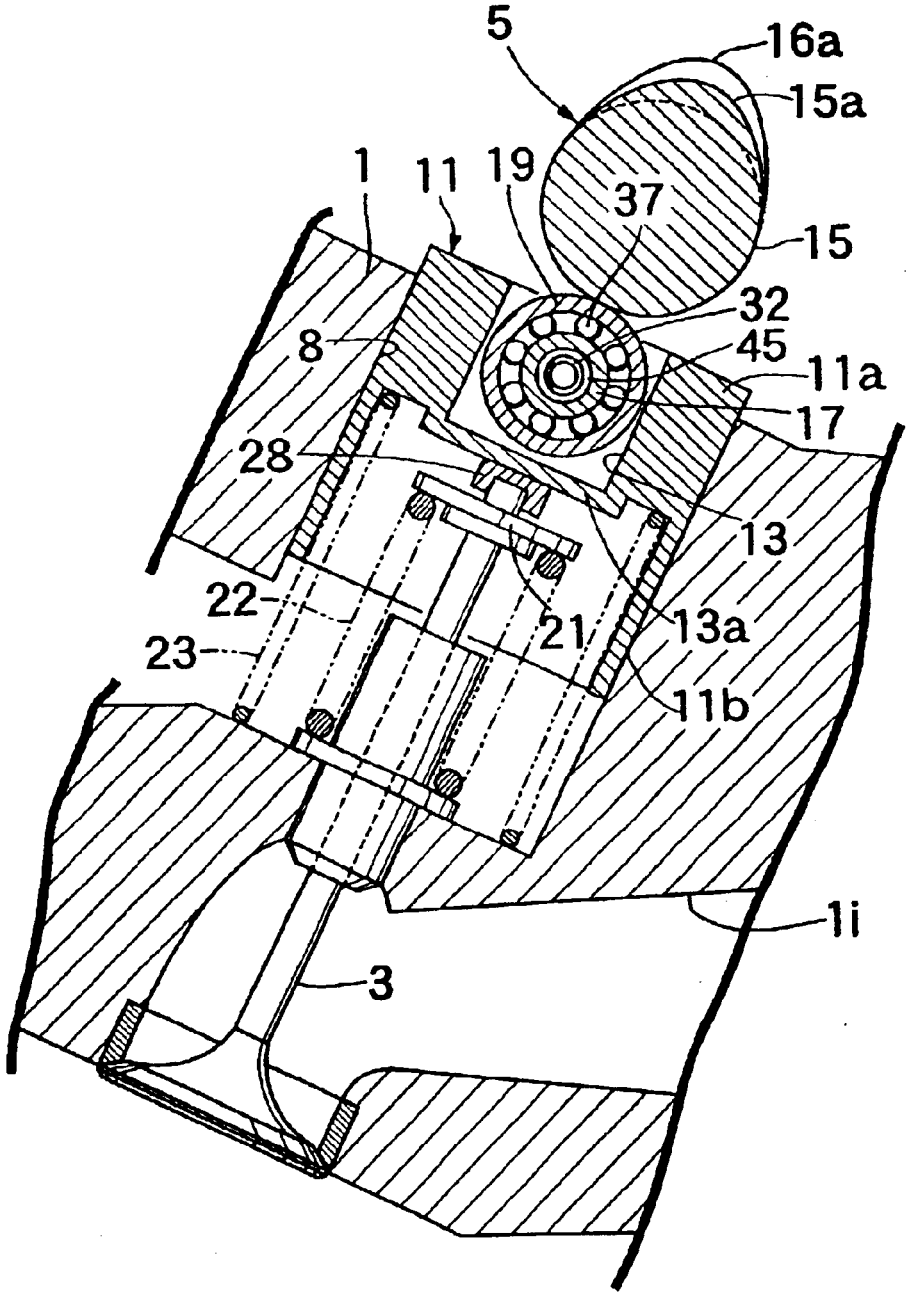
FIG. 44 is a sectional view taken along a line 44—44 in FIG. 43.
Figure 45:
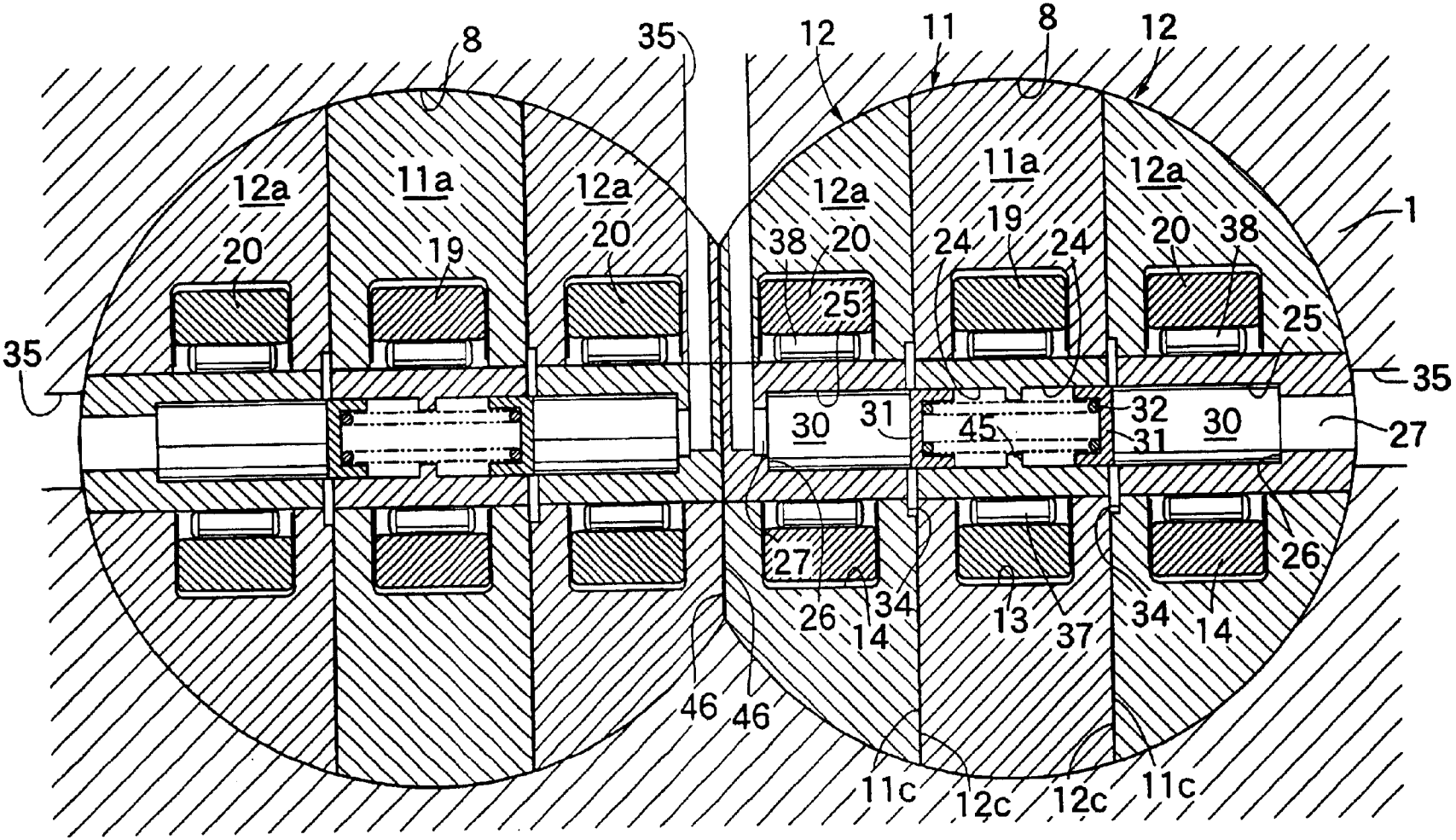
FIG. 45 is an enlarged sectional view taken along a line 45—45 in FIG. 43.

When the engine then reaches a high-speed operational range to permit a hydraulic pressure to be supplied from the oil passage 35 to the hydraulic pressure chamber 27, the urging piston 29 pushes the connecting plunger 30 and the return piston 31 by the action of the hydraulic pressure in the hydraulic pressure chamber 27 against the biasing force of the return spring 32. However, if the main and subsidiary cams 15 and 16, 16 are in contact with the upper surfaces of the main and subsidiary rollers 19 and 20, 20 at points other than the base circle-portions at that time, respectively, positions of the main guide bore 24 in the main valve lifter 11 and the subsidiary guide bore 25 in the subsidiary valve lifter 12 are staggered from each other. Therefore, the urging piston 29 is once stopped in a position where it is in abutment against the flat face 11*c* of the main valve lifter 11, and the connecting plunger 30 is once stopped in abutment against a bottom surface of the relief recess 34 on the side of the return piston 31, as shown in FIG. 41, thereby providing a switchover preparative state.

When the base circle-portions of the main and subsidiary cams 15 and 16, 16 are brought simultaneously into contact with the main and subsidiary rollers 19 and 20, 20 from that state, the main and subsidiary guide bores 24 and 25, 25 are brought in line with one another. The period of contact of the base circle-portions of the main and subsidiary cams 15 and 16, 16 with the main and subsidiary rollers 19 and 20, 20 is relatively long and hence, the urging piston 29 urges the connecting plunger 30 by the action of hydraulic pressure in the hydraulic pressure chamber 27, thereby putting the return piston 31 into abutment against the end wall 25*a* of the subsidiary guide bore 25 with the return piston 31 received therein (see FIG. 42). Thus, the connecting means 33 is brought into the connecting state in which the relative sliding movement of the valve lifters 11 and 12 is impossible, and the valve-operating device D is brought into a high-speed mode.

Therefore, the subsidiary cam 16 having the large-height lift portions 16*a* opens and closes the intake valve 3 through the valve lifters 11 and 12 by cooperation with the valve spring 22, and the small-height lift portion 15*a* of the main cam 15 is raced relative to the main valve lifter 11.

Even in the eleventh embodiment, the movement corresponding to the profiles of the main and subsidiary cams 15 and 16, 16 can be provided smoothly to the main and subsidiary valve lifters 11 and 12, because the main and subsidiary rollers 19 and 20, 20 are carried on the main and subsidiary valve lifters 11 and 12 to come into contact with the main and subsidiary cams 15 and 16, 16. Moreover, each of the upper end faces of the main and subsidiary valve lifters 11 and 12, which are not in contact with the main and subsidiary cams 15 and 16, only needs to have an extent enough to ensure that the main and subsidiary roller housings 13 and 14, 14 accommodating the main and subsidiary rollers 19 and 20, 20 are opened and hence, it is possible to provide reductions in diameters of the main and subsidiary valve lifters 11 and 12 and accordingly, a reduction in size of the valve-operating device D.

If the main and subsidiary valve lifters 11 and 12 in the eleventh embodiment are disposed in two sets adjacent each other according to the eighth embodiment shown in FIGS. 30 and 31 or the ninth embodiment shown in FIGS. 32 and 33, the valve-operating device for a 4-valve and twin-camshaft type internal combustion engine can be constructed compactly.

A twelfth embodiment of the present invention shown in FIGS. 43 to 47 will be described below.

The twelfth embodiment of the present invention is applied to a 4-valve and twin-camshaft type internal combustion engine, and a valve-operating device D for intake valves 3, 3 will be described below.

An intake camshaft 5 is disposed immediately above the intake valves 3, 3 to extend in a direction of arrangement of the intake valves 3, 3. Each of two sets of valve lifters mounted in correspondence to the pair of valves 3, 3 comprises a central main valve lifter 11, and a pair of subsidiary valve lifters 12, 12 disposed on opposite side of and adjacent the main valve lifter 11. In this case, the subsidiary valve lifters 12, 12 disposed inside the two sets of main valve lifters 11, 11 have flat faces 46, 46 formed on their outer peripheral surfaces to abut against each other. A pair of lifter guide bores 8, 8 are provided in the cylinder head 1 to receive the two sets of valve lifters therein for sliding movement, and disposed in a partially overlapped relation. The flat faces 46, 46 are disposed on a border between both of the lifter guide bores 8, 8.

Each of the main and subsidiary valve lifters 11 and 12, 12 in each set includes a thicker head portion 11*a*, 12*a*, 12*a*, and thinner arcuate skirt portion 11*b*, 12*b*, 12*b* extending downwards from a lower surface of the head portion 11*a*, 12*a*, 12*a* and continuous to an arcuate outer peripheral surface. The head portions 11*a* and 12*a*, 12*a* of the main and subsidiary valve lifters 11 and 12, 12 are provided with main and subsidiary roller housings 13 and 14, 14, in which main and subsidiary rollers 19 and 20, 20 are accommodated, respectively. The main and subsidiary rollers 19 and 20, 20 are rotatably carried on main and subsidiary roller support shafts 17 and 18, 18 press-fitted in the main and subsidiary valve lifters 11 and 12, 12 with needle bearings 37 and 38, 38 interposed therebetween, respectively.

On the other hand, the camshaft 5 is formed with a main cam 15 which is in contact with an upper surface of the main roller 19, and a pair of subsidiary cams 16, 16 of the same shape, which are in contact with upper surface of the subsidiary rollers 20, 20. There is no difference of height between base circle-portions of the main and subsidiary cams 15, 16, 16, but a lift portion 16*a* of each of the subsidiary cams 16 is formed higher in level than a lift portion 15*a* of the main cam 15. Therefore, the main cam 15 is used for a low speed, and the subsidiary cams 16, 16 are used for a high speed. In order to avoid the interference of the main and subsidiary cams 15 and 16, 16 and upper end faces of the main and subsidiary valve lifters 11 and 12, 12, the main and subsidiary rollers 19 and 20, 20 are disposed so that their upper surfaces protrude at a predetermined height from the upper end faces the main and subsidiary valve lifters 11 and 12, 12.

Each of the subsidiary roller housings 14, 14 has a bottom surface opened so that a lower surface of each of the subsidiary rollers 20, 20 is exposed, in order to reduce the weight of the head portion 11*a* of the main valve lifter 11 to the utmost, but the main roller housing 13 is provided with a bottom wall 13*a* which covers a lower surface of the main roller 19, and a stem end of the intake valve 3 disposed at the center of the lifter guide bore 8 is in abutment against a lower surface of the bottom wall 13*a* through a shim 28. A coiled valve spring 22 is mounted between a flange-shaped retainer 21 fixed to a stem of the valve 3 and the cylinder head 1 for biasing the valve 3 in a closing direction, i.e., toward the main cam 15. Common coiled lifter springs 23 for biasing the main and subsidiary valve lifters 11 and 12, 12 toward the main and subsidiary cams 15 and 16, 16 are mounted between lower surfaces of the head portions 11*a* and 12*a*, 12*a* of the main and subsidiary valve lifters 11 and 12, 12 and the cylinder head 1 in proximity to inner surfaces of the skirt portions 11*b* and 12*b*, 12*b*.

The main roller support shaft 17 is formed so that its opposite ends are continuous to the flat faces 11*c*, 11*c* on opposite sides of the main valve lifter 11, and each of the subsidiary roller support shafts 18 is formed so that its opposite ends are continuous to the corresponding subsidiary valve lifter 12 and an outer peripheral surface. The main roller support shaft 17 is provided with a pair of main guide bores 24, 24 which open into its opposite end faces and arranged coaxially on opposite sides of a central annular positioning stopper 45. Each of the subsidiary roller support shaft 18 is provided with a subsidiary guide bore 25 which opens into the flat face 12*c*, and a hydraulic pressure chamber 27 leading to the subsidiary guide bore 25 through an annular step 40.

Connecting plungers 30, 30 are slidably received in the subsidiary guide bores 25, 25, respectively, and return pistons 31, 31 are slidably received in the main guide bores 24, 24, respectively, as well as a common return spring 32 for biasing the return pistons 31, 31 toward the connecting plungers 30, 30 is accommodated in the main guide bores 24, 24. The main and subsidiary guide bores 24 and 25, 25 are formed at the same diameter, so that when the main and subsidiary cams 15 and 16, 16 are brought simultaneously into contact with the upper surfaces of the main and subsidiary valve lifters 11 and 12, 12, i.e., when the upper surfaces of all the valve lifters 11 and 12, 12 are brought in line with one another, the connecting plungers 30, 30 can be moved into and out of the corresponding subsidiary guide bores 25, 25 in the main valve lifter 11. A connecting means 33 is formed by the connecting plungers 30, the return piston 31, the return spring 32 and the hydraulic pressure chamber 27.

In order to avoid the interference of a tip end of each of the connecting plungers 30 and an opening of the corresponding main guide bore 24 or the interference of a tip end of the return piston 31 and an opening of the corresponding subsidiary guide bore 24 due to a manufacture error in the non-connecting state of the connecting means 33, a relief recess 34 similar to that in each of the previous embodiments is provided in at least one of the opposed flat faces 11*c* and 12*c* of the main and subsidiary valve lifters 11 and 12.

Oil passages 35, 35 are provided in the cylinder head 1 to communicate with the hydraulic pressure chamber 27, 27. The oil passages 35, 35 are selectively connected to a hydraulic pressure supply source such as a hydraulic pump and a low-pressure oil reservoir through a common switchover valve (not shown).

The operation of the twelfth embodiment will be described below.

Figure 46:
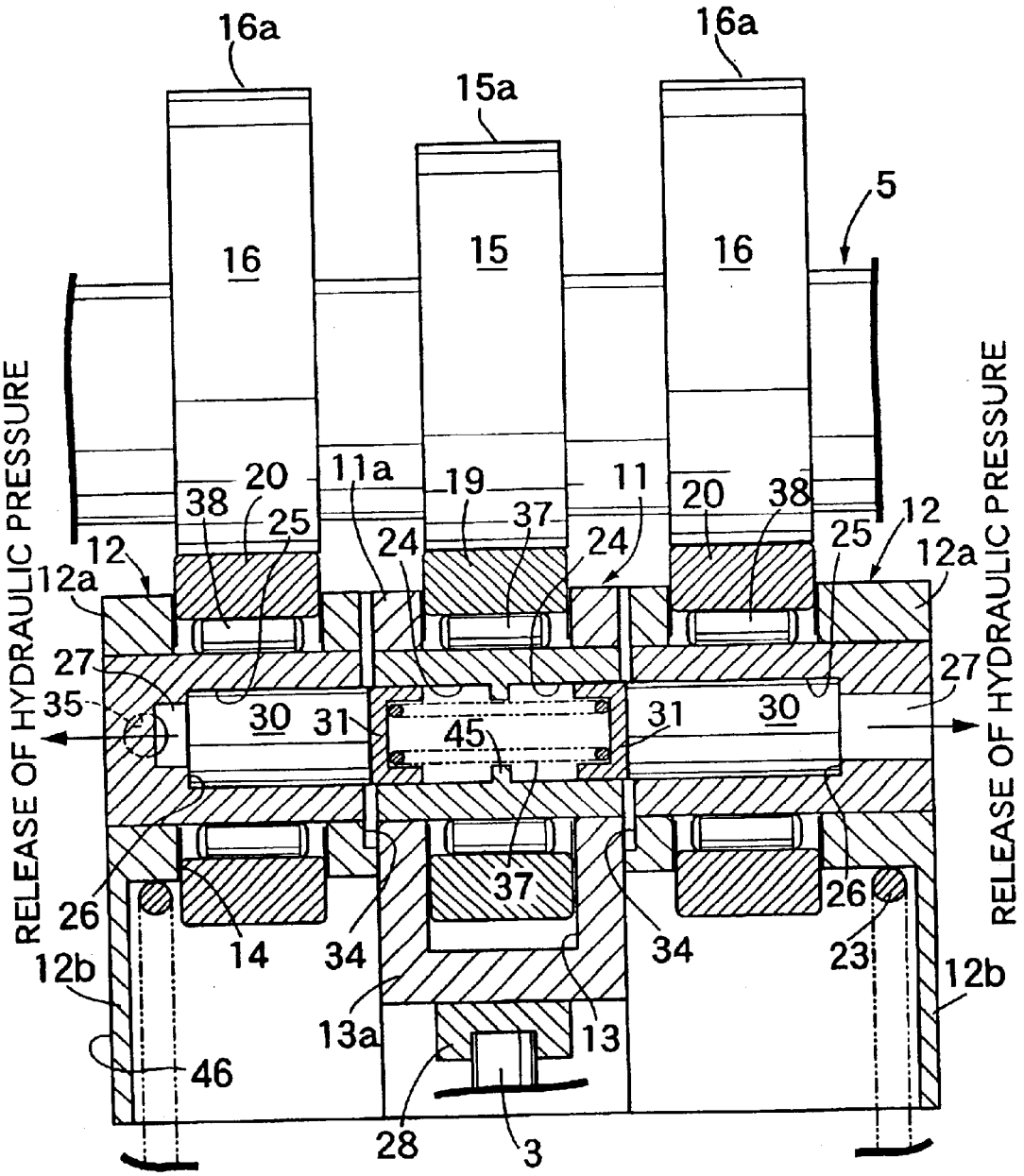
FIG. 46 is an enlarged view of essential portions of FIG. 43 (showing a low-speed mode)
Figure 47:
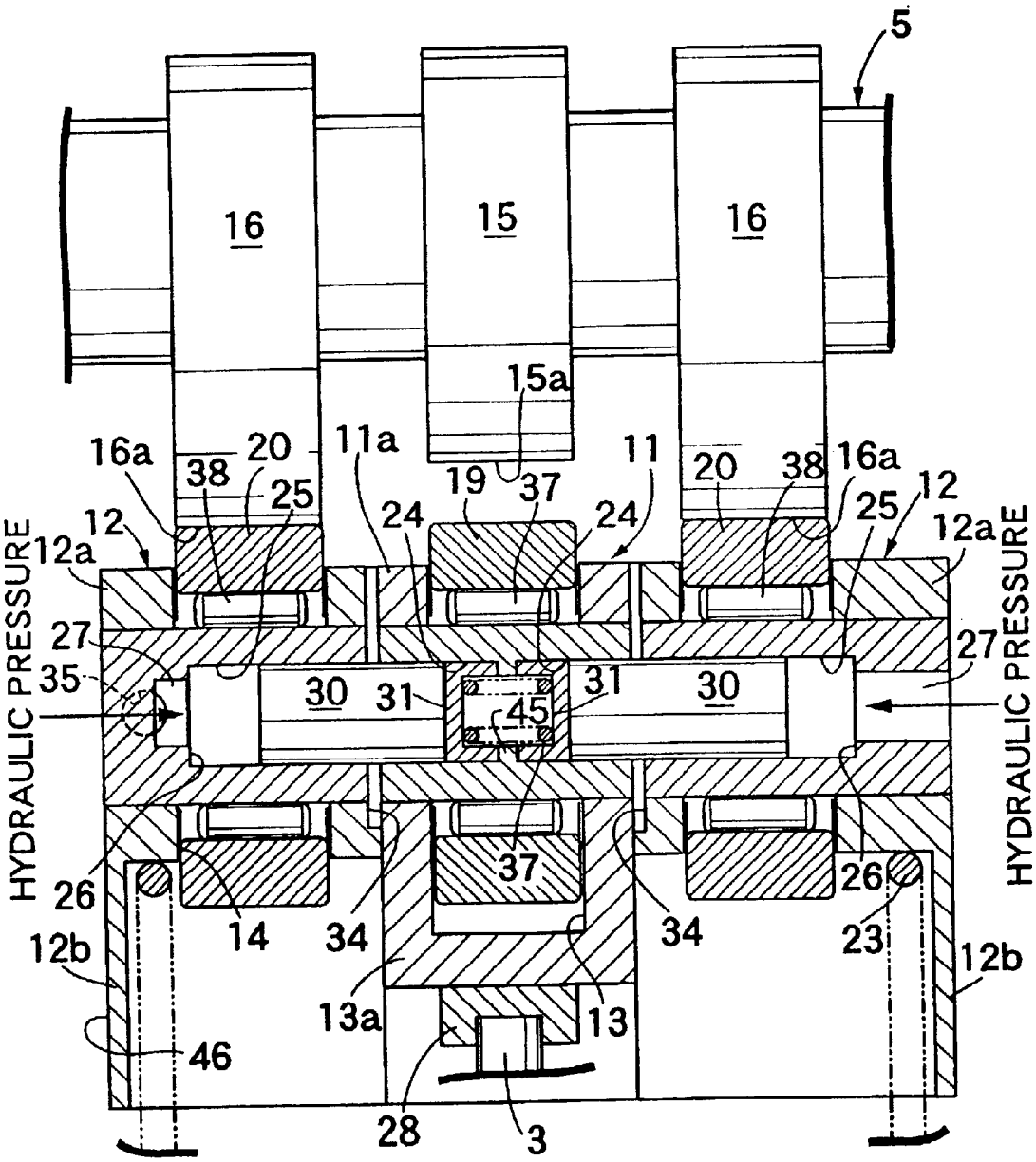
FIG. 47 is a view for explaining the operation and showing a high-speed mode.
Figure 48:
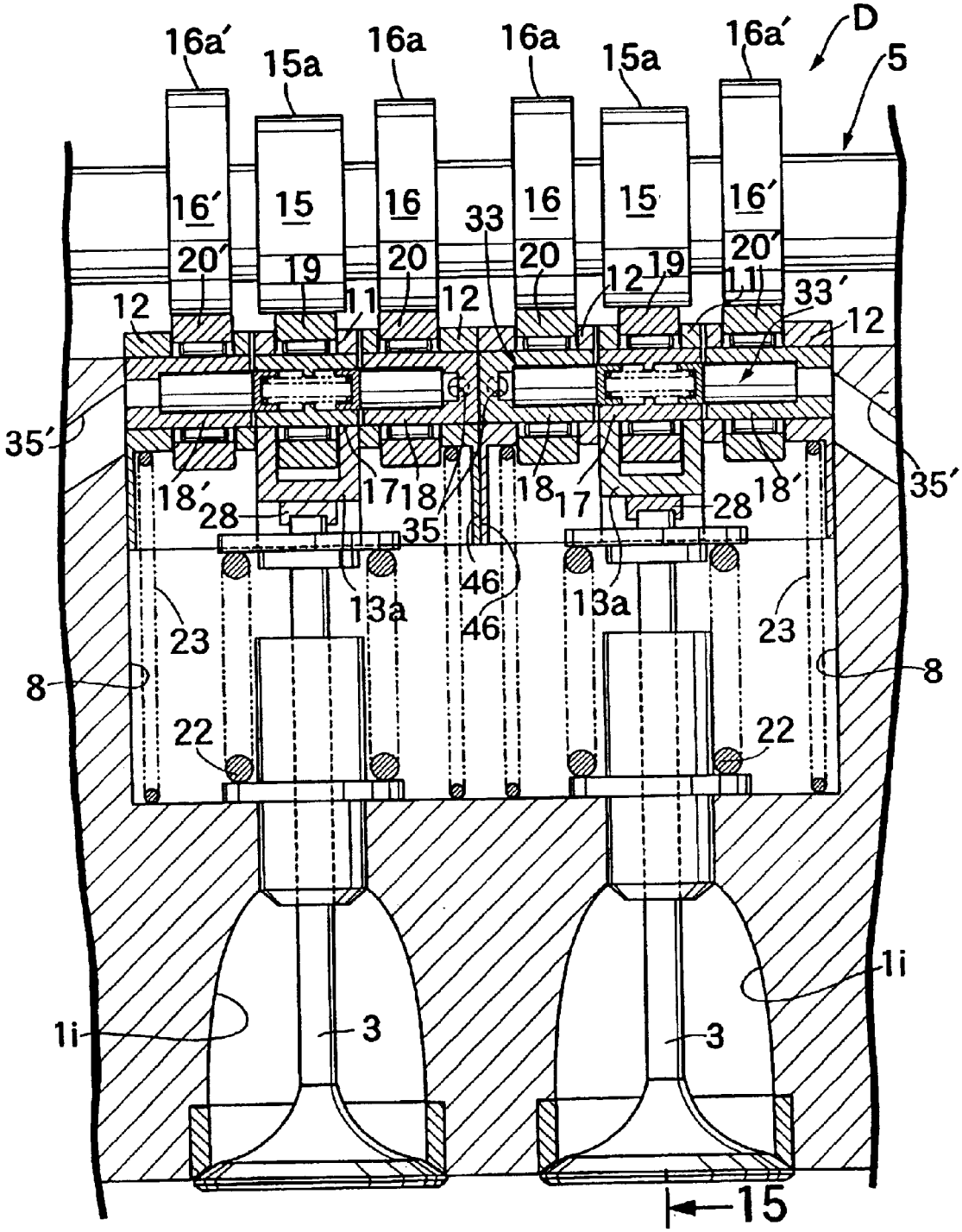
FIG. 48 is a vertical sectional plan view of a valve-operating system for a four-valve and single-camshaft/three mode type internal combustion engine according to a thirteenth embodiment of the present invention.
Figure 49:
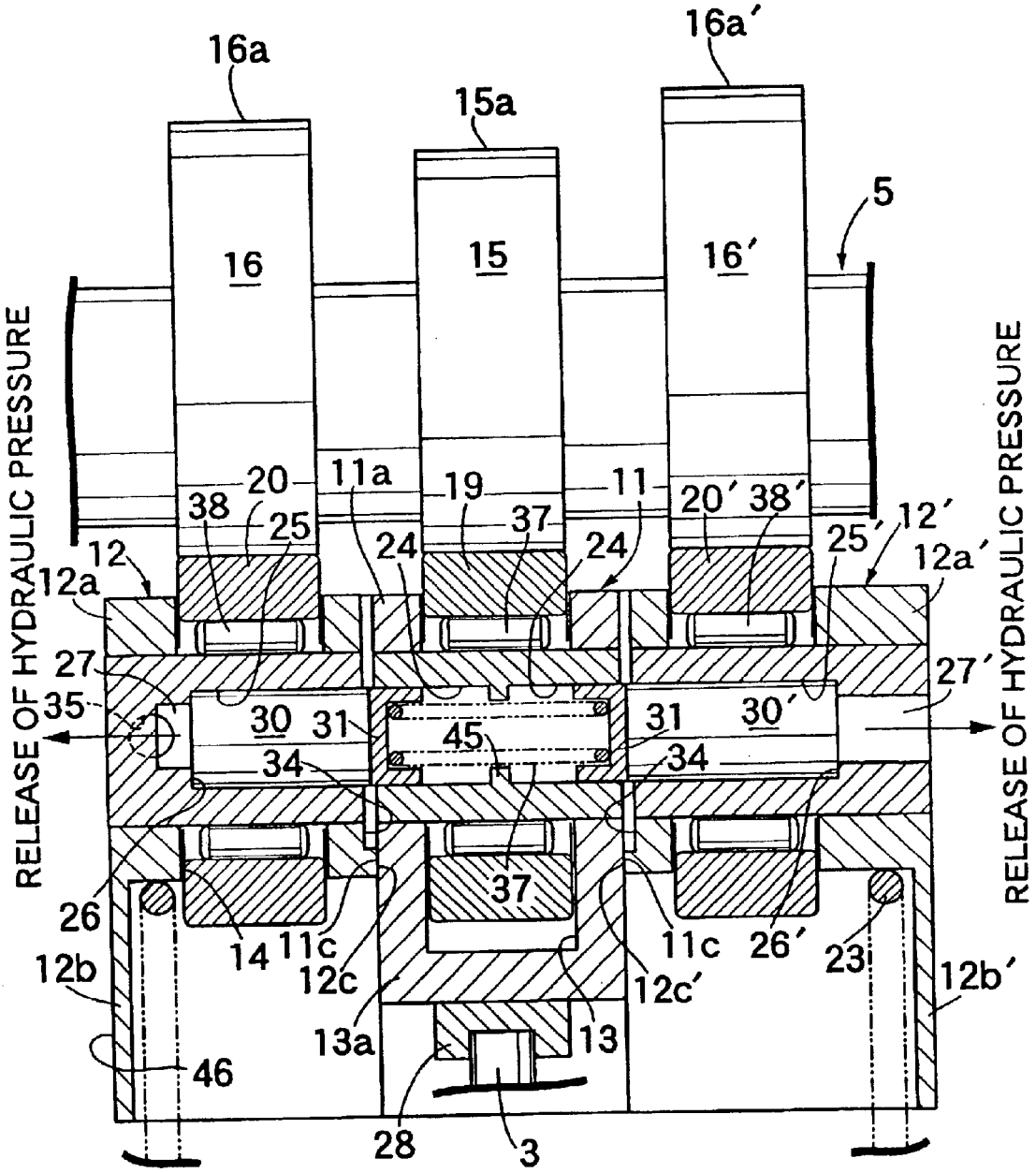
FIG. 49 is an enlarged view of essential portions of FIG. 48 (showing a low-speed mode)

In low-speed and medium-speed operational ranges of the internal combustion engine, the hydraulic pressure chambers 27, 27 are opened into the oil reservoir through the oil passages 35, 35 to bring the connecting means 33 into a disconnecting state. If the disconnecting state is achieved, the return pistons 31, 31 retain the connecting plungers 30, 30 in positions of abutment against the annular steps 40, 40 of the subsidiary guide bores 24, 24 by the action of a biasing force of the return spring 32, as shown in FIG. 46.

At this time, each of the connecting plungers 30 has its tip end facing to the relief recess 34, and the connecting means 33 is brought into a non-connecting state in which the relative sliding movement of the main and subsidiary valve lifters 11 and 12, 12 is possible, and the valve-operating device D is brought into a low-speed mode. When the camshaft 5 is rotated in the low-speed mode, the main and subsidiary cams 15 and 16, 16 are rotated, while being always in contact with the corresponding main and subsidiary rollers 19 and 20, 20 and hence, the movement corresponding to profiles of the main and subsidiary cams 15 and 16, 16 can be provided smoothly to the main and subsidiary valve lifters 11 and 12, 12 by the rotation of the main and subsidiary rollers 19 and 20, 20. Moreover, each of upper end faces of the main and subsidiary valve lifters 11 and 12, 12, which are not in sliding contact with the main and subsidiary cams 15 and 16, 16, only needs to have an extent enough to ensure that the main and subsidiary roller housings 13 and 14, 14 are opened and hence, it is possible to achieve reductions in diameters of the main and subsidiary valve lifters 11 and 12, 12 and accordingly, a reduction in size of the valve-operating device D.

Thus, the main cam 15 causes the opening and closing motions of the valve 3 through the main valve lifter 11 by cooperation with the valve spring 22, but the subsidiary cams 16, 16 only reciprocally move the subsidiary valve lifters 12, 12 uselessly with a stroke larger than that of the main valve lifter 11 by cooperation with the lifter spring 23 and do not participate in the opening and closing of the valve 3. Therefore, the opening and closing characteristic of the valve 3 in this case depends on a cam profile of the main cam 15 having the small-height lift portion 15*a*, and the low-speed and medium-speed performance of the engine can be enhanced.

In this case, the upper end of the lifter spring 23 is supported on the lower surfaces of the head portions 12*a*, 12*a* of the pair of subsidiary valve lifters 12, 12 disposed on the opposite side of the main valve lifter 11 and hence, the lifter spring 23 cannot be inclined, despite the relative movement of the main and subsidiary valve lifters 11 and 12, 12 due to a difference in lift between the main and subsidiary cams 15 and 16, 16, and an unbalanced load can be avoided.

When the engine reaches a high-speed operational range to permit a hydraulic pressure to be supplied from the oil passages 35, 35 to the hydraulic pressure chambers 27, 27, the connecting plungers 30, 30 push the return pistons 31, 31 by the action of the hydraulic pressure in the hydraulic pressure chambers 27 against the biasing force of the return spring 32. However, if the main and subsidiary cams 15 and 16, 16 are in contact with the main and subsidiary rollers 19 and 20, 20 at points other than the base circle-portions at that time, positions of the main guide bore 24 and the subsidiary guide bore 25 are staggered from each other. Therefore, the connecting plunger 30 is once stopped in a position where it is in abutment against a side face of the main valve lifter 11, thereby providing a switchover preparative state.

When the base circle-portions of the main and subsidiary cams 15 and 16, 16 are brought simultaneously into contact with the main and subsidiary rollers 19 and 20, 20 from that state, the main and subsidiary guide bores 24 and 25 are brought in line with each other. The period of contact of the base circle-portions of the main and subsidiary cams 15 and 16, 16 with the main and subsidiary rollers 19 and 20, 20 is relatively long and hence, each of the connecting plungers 30 urges the return piston 31 by the hydraulic pressure in the hydraulic pressure chamber 27 against the biasing force of the return spring 32, thereby putting the return spring 31 into abutment against the annular stopper 45 of the main guide bore 24 (see FIG. 47). Thus, the connecting means 33 is brought into the connecting state in which the relative sliding movement of the main and subsidiary valve lifters 11 and 12, 12 is impossible, and the valve-operating device D is brought into a high-speed mode.

Therefore, the subsidiary cams 16, 16 having the large-height lift portions 16*a* open and close the valve 3 through the main and subsidiary valve lifters 11 and 12, 12 by cooperation with the valve spring 22, and the small-height lift portion 15*a* of the main cam 15 is raced relative to the main roller 19. The opening/closing characteristic of the valve 3 in this case depends on the profile of the subsidiary cam 16 having the large-height lift portion 16*a*, and an enhancement in high-speed performance of the engine can be provided.

In this case, the valve spring 22 and the lifter spring 23 in a parallel relation to each other exhibit repulsive forces to the main and subsidiary valve lifters 11 and 12, 12 in their connected states and hence, a sum total of the repulsive forces is applied to all of the valve lifters 11 and 12, 12. Therefore, notwithstanding all of the valve lifters 11 and 12, 12 have been integrated, resulting in an increased inertia mass, the inertia forces of all of the valve lifters 11 and 12, 12 can be suppressed effectively, whereby the jumping of the valve 3 is prevented, and moreover, the return responsiveness of all of the valve lifters 11 and 12, 12 and accordingly, the closing responsiveness of the valve 3 can be enhanced to contribute to a further enhancement in high-speed performance.

Moreover, in the high-speed mode, the pair of subsidiary valve lifters 12, 12 have been connected to the opposite sides of the main valve lifter 11, and the operating forces of the pair of subsidiary cams 16, 16 are applied equally to the opposite sides of the main valve lifter 11 through the subsidiary valve lifters 12, 12 and the connecting plungers 30, 30. Therefore, the main valve lifter 11 can be operated in a non-inclined appropriate attitude.

When the engine is returned again to the low-speed and medium-speed operational ranges, whereby the hydraulic pressure in each of the hydraulic pressure chambers 27, 27 is released to the oil reservoir, the following is obvious: Each of the return piston 31 pushes the corresponding connecting plunger 30 back to the original position with the repulsive force of the return spring 32 and hence, the connecting means 33 is brought into the non-connecting state in which the relative sliding movement of the main and subsidiary valve lifters 11 and 12, 12 is possible.

The other constructions are the same as those in the first embodiment and hence, portions or components corresponding to those in the eighth embodiment of the present invention shown in FIGS. 30 and 31 are designated by like reference characters in FIGS. 43 to 47, and the description of them is omitted.

Finally, a thirteenth embodiment of the present invention shown in FIGS. 48 to 51 will be described below.

The thirteenth embodiment of the present invention is also applied to a 4-valve and twin-camshaft type internal combustion engine, and a valve-operating device D for intake valves 3, 3 will be described below.

Each of two sets of valve lifters mounted in correspondence to a pair of valves 3, 3 comprises a central main valve lifter 11, and first and second subsidiary valve lifters 12 and 12' disposed on opposite sides of and adjacent the main valve lifter 11. In this case, the first subsidiary valve lifters 12, 12 disposed inside the two sets of main valve lifters 11, 11 have flat faces 46, 46 formed on their outer peripheral surfaces to abut against each other.

Each of the main and first and second subsidiary valve lifters 11, 12 and 12' includes a thicker head portion 11*a*, 12*a*, 12'*a*, and a thinner arcuate skirt portion 11*b*, 12*b*, 12*b*' extending downwards from a lower surface of the head portion 11*a*, 12*a*, 12'*a* and continuous to an arcuate outer peripheral surface. The head portions 11*a*, 12*a* and 12*a*' of the main and first and second subsidiary valve lifters 11, 12 and 12' are provided with main and first and second subsidiary roller housings 13, 14 and 14', respectively, in which main and first and second subsidiary rollers 19, 20 and 20' are accommodated, respectively. The main and first and second subsidiary rollers 19, 20 and 20' are rotatably carried on main and first and second subsidiary roller support shafts 17, 18 and 18' press-fitted in the main and first and second subsidiary valve lifters 11, 12 and 12' with needle bearings 37, 38 and 38' interposed therebetween, respectively.

On the other hand, a camshaft 5 is formed with a main cam 15 which is in contact with an upper surface of the main roller 19, and first and second subsidiary cams 16 and 16' which are located on opposite sides of the main cam 15 to come into contact with upper surfaces of the first and second subsidiary rollers 20 and 20'. There is no difference of height between base circle-portions of the main and first and second subsidiary cams 15, 16 and 16', but lift portions 16*a* and 16*a*' of the first and second subsidiary cams 16 and 16' are formed higher in level than a lift portion 15*a* of the main cam 15, and the lift portion 16*a* of the first subsidiary cam 16 is formed higher in level than the lift portion 16*a*' of the second subsidiary cam 16'. Therefore, the main cam 15 is used for a low speed; the first subsidiary cam 16 is used for a medium speed, and the second subsidiary cam 16' is used for a high speed. In order to avoid the interference of the main and first and second subsidiary cams 15, 16 and 16' and upper end faces of the main and first and second subsidiary valve lifters 11, 12 and 12', the main and first and second subsidiary rollers 19, 20 and 20' are disposed so that their upper surfaces protrude at a predetermined height from the upper end faces of the main and first and second subsidiary valve lifters 11, 12 and 12'.

The other constructions are similar to those in the twelfth embodiment, except for a point that members and portions on the side of the second subsidiary valve lifter 12' disposed outside the main valve lifter 11 in each pair are designated by reference characters each affixed with "'", and a point that oil passages 35 and 35' leading to hydraulic pressure chambers 27 and 27' are selectively connected to hydraulic pressure supply sources such as a hydraulic pump and low-pressure oil reservoirs through switchover valves (not shown) operated individually. Therefore, portions or components corresponding to those in the twelfth embodiment are designated by the same reference characters except for the reference characters each affixed with "'" in FIGS. 48 to 51, and the description of them is omitted.

Figure 50:
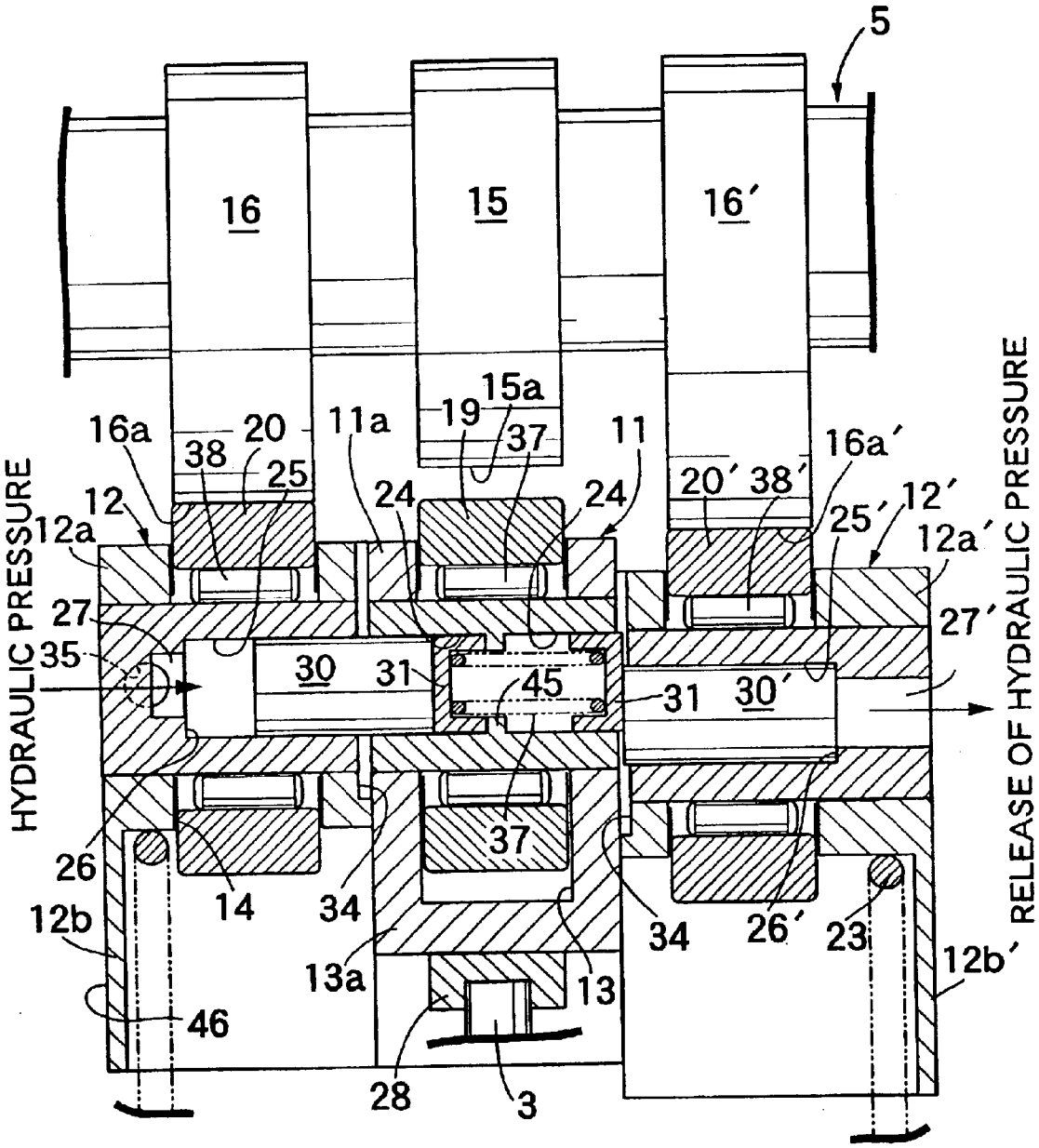
FIG. 50 is a view for explaining the operation, similar to FIG. 49, but showing a medium-speed mode.

The operation of the thirteenth embodiment will be described below. In a low-speed operational range of the internal combustion engine, the hydraulic pressure chambers 27 and 27' on the side of the first and second subsidiary valve lifters 12 and 12' are opened into the oil reservoirs through the oil passages 35 and 35' to bring connecting means 33 and 33' into their disconnecting states. If the disconnecting states are achieved, the return pistons 31, 31 retain the connecting plungers 30 and 30' in positions of abutment against annular steps 40 and 40' of subsidiary guide bores 24 and 24' with a biasing force of the return spring 32, as shown in FIG. 50. At this time, each of the connecting plungers 30 and 30' has its tip end facing to a relief recess 34, and the connecting means 33 and 33' are brought into disconnecting states in which the relative sliding movement of the main and first and second subsidiary valve lifters 11, 12 and 12' is possible, and the valve-operating device D is brought into a low-speed mode. When the camshaft 5 is rotated in the low-speed mode, the main and first and second subsidiary cams 15, 16 and 16' are rotated, while being always in contact with the corresponding main and first and second subsidiary rollers 19, 20 and 20'. Therefore, the movement corresponding to each of the profiles of the main and first and second subsidiary cams 15, 16 and 16' can be provided smoothly to the main and first and second subsidiary valve lifters 11, 12 and 12' by the rotation of the main and first and second subsidiary rollers 19, 20 and 20'.

The main cam 15 causes the opening and closing motions of the valve 3 through the main valve lifter 11 by cooperation with the valve spring 22, but the first and second subsidiary cams 16 and 16' only reciprocally move the first and second subsidiary valve lifters 12 and 12' uselessly with a stroke larger than that of the main valve lifter 11 by cooperation with the lifter spring 23 and do not participate in the opening and closing of the intake valve 3. The opening and closing characteristic of the valve 3 in this case depends on the cam profile of the main cam 15 having the small-height lift portion 15*a*, and the low-speed performance of the engine can be enhanced.

When the engine then reaches a medium-speed operational range, a hydraulic pressure is supplied from one of the oil passages 35 only to the hydraulic pressure chamber 27 on the side of the first subsidiary valve lifter 12. Then, the connecting plunger 30 pushes the return piston 31 by the hydraulic pressure in the hydraulic pressure chamber 27 against the biasing force of the return spring 32. However, if the main and first subsidiary cams 15 and 16 are in contact with the main and first subsidiary rollers 19 and 20 at points other than the base circle-portions at that time, respectively, positions of the main guide bore 24 and the first subsidiary guide bore 25 are staggered from each other. Therefore, the connecting plunger 30 is once stopped in a position where it is in abutment against a side face of the main valve lifter 11, thereby providing a switchover preparative state.

When the base circle-portions of the main and first subsidiary cams 15 and 16 are brought simultaneously into contact with the main and first subsidiary rollers 19 and 20 from that state, the main and first subsidiary guide bores 24 and 25 are brought in line with each other. The period of contact of the base circle-portions of the main and first subsidiary cams 15 and 16 with the main and first subsidiary rollers 19 and 20 is relatively long and hence, the connecting plunger 30 urges the return piston 31 by the hydraulic pressure in the hydraulic pressure chamber 27 against the biasing force of the return spring 32, thereby putting the return piston 31 into abutment against the annular stopper 45 of the main guide bore 24. The connecting means 33 is brought into the connecting state in which the relative sliding movement of the main and first subsidiary valve lifters 11 and 12 is impossible, and the valve-operating device D is brought into a medium-speed mode.

Therefore, the first subsidiary cam 16 having the medium-height lift portion 16*a* opens and closes the valve 3 through the main and first subsidiary valve lifters 11 and 12 by cooperation with the valve spring 22, and the small-height lift portion 15*a* of the main cam 15 is raced relative to the main roller 19. Therefore, the opening/closing characteristic of the valve 3 in this case depends on the cam profile of the first subsidiary cam 16 having the medium-height lift portions 16*a*, and an enhancement in medium-speed performance of the engine can be provided.

When the engine reaches a high-speed operational range, a hydraulic pressure is supplied from the other oil passage 35' to the hydraulic pressure chamber 27' on the side of the second subsidiary valve lifter 12' by the hydraulic pressure in the hydraulic pressure chamber 27 remaining maintained. Then, the connecting plunger 30' pushes the return piston 31' by the hydraulic pressure in the hydraulic pressure chamber 27' against the biasing force of the return spring 32. However, if the main and second subsidiary cams 15 and 16' are in contact with the main and second subsidiary rollers 19 and 20' at points other than the base circle-portions at that time, respectively, positions of the main guide bore 24 and the second subsidiary guide bore 25' are staggered from each other. Therefore, the connecting plunger 30' is once stopped in a position where it is in abutment against the side face of the main valve lifter 11, thereby providing the switchover preparative state.

When the base circle-portions of the main and second subsidiary cams 15 and 16' are brought simultaneously into contact with the main and second subsidiary rollers 19 and 20' from that state, the main and second subsidiary guide bores 24 and 25' are brought in line with each other. The period of contact of the base circle-portions of the main and second subsidiary cams 15 and 16' with the main and second subsidiary rollers 19 and 20' is relatively long and hence, the connecting plunger 30' urges the return piston 31' by the hydraulic pressure in the hydraulic pressure chamber 27' against the biasing force of the return spring 32 to put the return piston 31' into abutment against the annular stopper 45 of the main guide bore 24. Thus, the connecting means 33' is also brought into the connecting state in which the relative sliding movement of the main and second subsidiary valve lifters 11 and 12' is impossible, and the valve-operating device D is brought into the medium-speed mode.

Therefore, the second subsidiary cam 16' having the largest-height lift portion 16*a*' opens and closes the valve 3 through the main and subsidiary valve lifters 11 and 12' by cooperation with the valve spring 22, and the lift portions 15*a* and 16*a* of the main and first subsidiary cams 15 and 16 lower in height than the lift portion 16*a*' of the second subsidiary cam 16' are raced relative to the main and first subsidiary rollers 19 and 20. Therefore, the opening and closing characteristic of the valve 3 in this case depends on the profile of the second subsidiary cam 16 having the largest-height lift portion 16*a*', and an enhancement in high-speed performance of the engine can be provided.

Figure 51:
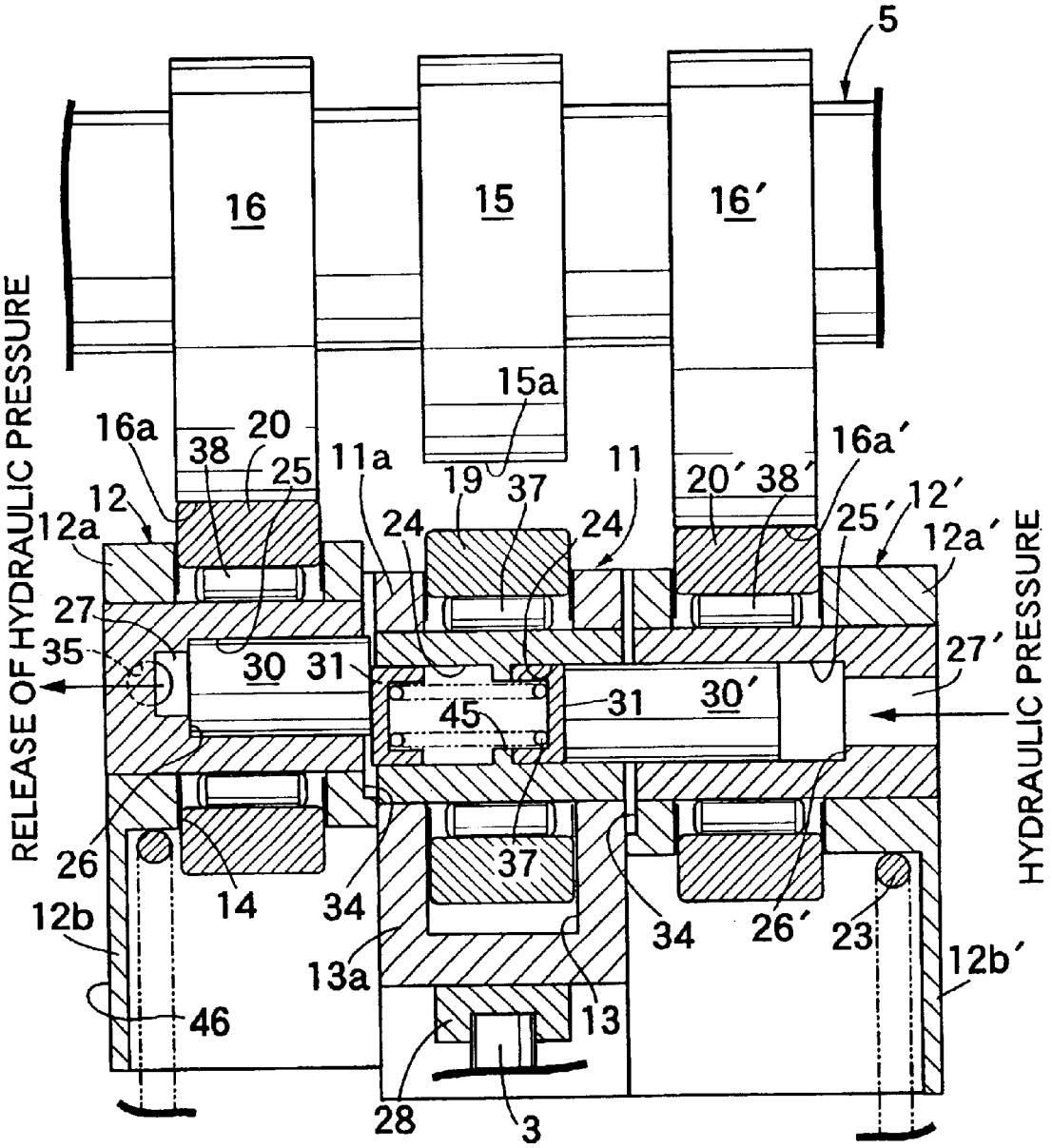
FIG. 51 is a view for explaining the operation, similar to FIG. 49, but showing a higher-speed mode.
Figure 52B:
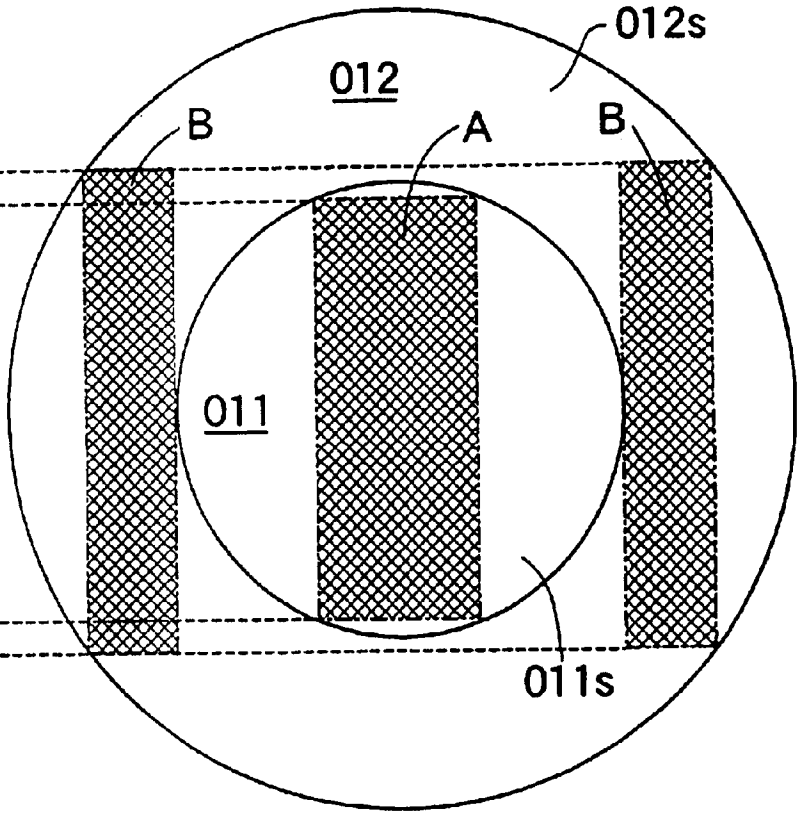
FIG.52B (RELATED ART)
FIGS. 52A and 52B are a vertical sectional view and a plan view of a conventional valve-operating system.
Figure 52A:
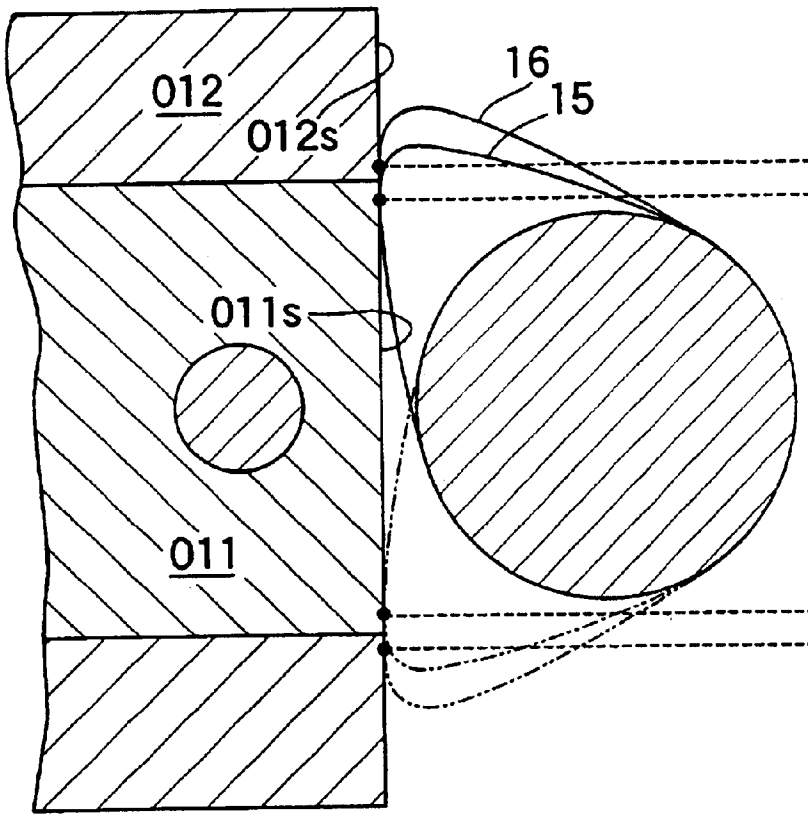
FIG.52A (RELATED ART)

In the high-speed mode, the connecting state of the connecting means 33 on the side of the first subsidiary valve lifter 12 may be maintained, but in order to reduce the inertia mass of a system comprising the valves 3, 3 to the utmost, it is effective to release the hydraulic pressure in the hydraulic pressure chamber 27 on the side of the first subsidiary valve lifter 12 into the oil reservoir to bring the connecting means 33 into the non-connecting state, whereby the first subsidiary valve lifter 12 is disconnected from the main valve lifter 11, as shown in FIG. 51.

When the engine is returned again to the low-speed operational range to permit the hydraulic pressures in both of the hydraulic pressure chambers 27 and 27' to be released into the oil reservoirs, the following is obvious: the return pistons 31 and 31' push the corresponding connecting plungers 30 and 30' back to the original positions by the repulsive forces of the return spring 32 and hence, both of the connecting means 33 and 33' are brought into the non-connecting states in which the relative sliding movement of the main and first and second subsidiary valve lifters 11, 12 and 12' is possible.

In this manner, according to the thirteenth embodiment, any of the three different operational modes can be provided to the valves 3, 3 of the engine by separating the first and second subsidiary valve lifters 12 and 12' from the main valve lifter 11, by connecting only the first subsidiary valve lifter 12 to the main valve lifter 11 and by connecting the second subsidiary valve lifter 12' to the main valve lifter 11 by cooperation with the main cam 15, the first subsidiary cam 16 and the second subsidiary cam 16'.

What is claimed is:

1. A valve-operating system for an internal combustion engine, comprising:

a main valve lifter moved in unison with valve mounted in an engine body;

first and second subsidiary valve lifters adjoining said main valve lifter and slidable relative to said main valve lifter;

a main cam for providing a first operational mode to the valve through said main valve lifter;

a subsidiary cam capable of operating said subsidiary valve lifter with a lift amount larger than said main cam in a direction to open the valve;

main and subsidiary guide bores provided in said main and subsidiary valve lifters to extend in a direction perpendicular to a direction of operation of said main and subsidiary valve lifters; and connecting means having a connecting member for moving between a non-connecting position where said connecting member is received in only one of said main and subsidiary guide bores and a connecting position where said connecting member is received in both of said guide bores, so that when said main and subsidiary valve lifters are connected to each other by the connecting state of said connecting means, said subsidiary cam provides a second operational mode to the valve, in which said valve is opened more largely than in said first operational mode, wherein said main and subsidiary valve lifters have flat faces relatively slidably superposed on each other, and are formed so as to be slidably received in a common lifter guide bore in the engine body, said flat faces being formed to extend in parallel to an axis of said lifter guide bore, and said main and subsidiary guide bores are provided in said main and subsidiary valve lifters so as top open into said corresponding flat faces, respectively, and wherein the first and second subsidiary valve lifters are disposed on opposite sides of said main valve lifter, and the first and second subsidiary cams moved at different lift amounts are disposed in correspondence to said first and second subsidiary valve lifters, so that said main valve lifter can be connected individually to said first and second subsidiary valve lifters through the first and second connecting members.

2. A valve-operating system for an internal combustion engine, comprising:

a main valve lifter moved in unison with a valve mounted in an engine body;

a subsidiary valve lifter adjoining said main valve lifter and slidable relative to said main valve lifter, wherein the main and subsidiary valve lifters are slidably received in a lifter guide bore of a substantially circular cross section, said main valve lifter being positioned near a center of the lifter guide bore and associated with the valve;

a main cam for providing a first operational mode to the valve through said main valve lifter;

a subsidiary cam capable of operating said subsidiary valve lifter with a lift amount larger than said main cam in a direction to open the valve;

main and subsidiary guide bores provided in said main and subsidiary valve lifters to extend in a direction perpendicular to a direction of operation of said main and subsidiary valve lifters; and connecting means having a connecting member for moving between a non-connecting position where said connecting member is received in only one of said main and subsidiary guide bores and a connecting position where said connecting member is received in both of said guide bores, so that when said main and subsidiary valve lifters are connected to each other by the connecting state of said connecting means, said subsidiary cam provides a second operational mode to the valve, in which said valve is opened more largely than in said first operational mode, wherein said main and subsidiary valve lifters have flat faces relatively slidably superposed on each other, said flat faces being formed to extend in parallel to an axis of said lifter guide bore, and said main and subsidiary guide bores are provided in said main and subsidiary valve lifters so as to open into said corresponding flat faces, respectively, wherein a hydraulic pressure chamber is connected to an outer end of the subsidiary guide bore in the subsidiary valve lifter through an annular step, and wherein the outer end of the subsidiary guide bore in the subsidiary valve lifter is closed by a closing plug fitted in the main valve lifter.

3. A valve-operating system for an internal combustion engine, comprising:

a main valve lifter moved in unison with a valve mounted in an engine body;

a subsidiary valve lifter adjoining said main valve lifter and slidable relative to said main valve lifter, wherein the main and subsidiary valve lifters are slidably received in a lifter guide bore of a substantially circular cross section, said main valve lifter being positioned near a center of the lifter guide bore and associated with the valve;

a main cam for providing a first operational mode to the valve through said main valve lifter;

a subsidiary cam capable of operating said subsidiary valve lifter with a lift amount larger than said main cam in a direction to open the valve;

main and subsidiary guide bores provided in said main and subsidiary valve lifters to extend in a direction perpendicular to a direction of operation of said main and subsidiary valve lifters; and connecting means having a connecting a member for moving between a non-connecting position where said connecting member is received in only one of said main and subsidiary guide bores and a connecting position where said connecting member is received in both of said guide bores, so that when said main and subsidiary valve lifters are connected to each other by the connecting state of the connecting means, said subsidiary cam provides a second operational mode to the valve, in which the valve is opened more largely than in the first operational mode, wherein a roller is carried on at least one of said main and subsidiary valve lifters to come into contact with the corresponding cam, wherein a hydraulic pressure chamber is connected to an outer end of the subsidiary guide bore in the subsidiary valve lifter through an annular step, and wherein the outer end of the subsidiary guide bore in the subsidiary valve lifter is closed by a closing plug fitted in the main valve lifter.

* * * * *